US012798847B2

(12) United States Patent
Graham et al.

(10) Patent No.: US 12,798,847 B2
(45) Date of Patent: Nov. 17, 2026

(54) MODULAR CONTAINER WITH IMPROVED PERFORMANCE

(71) Applicant: Eco.Logic Brands Inc., Manteca, CA (US)

(72) Inventors: Romeo Graham, Montreal (CA); Julie Corbett, Oakland, CA (US); Robert D. Watters, Ottawa (CA)

(73) Assignee: ECO.LOGIC BRANDS INC., Manteca, CA (US)

( * ) Notice: Subject to any disclaimer, the term of this patent is extended or adjusted under 35 U.S.C. 154(b) by 107 days.

(21) Appl. No.: 17/798,802

(22) PCT Filed: Feb. 10, 2021

(86) PCT No.: PCT/US2021/017463

§ 371 (c)(1),
(2) Date: Aug. 10, 2022

(87) PCT Pub. No.: WO2021/163198

PCT Pub. Date: Aug. 19, 2021

(65) Prior Publication Data

US 2023/0054953 A1 Feb. 23, 2023

Related U.S. Application Data

(60) Provisional application No. 63/077,396, filed on Sep. 11, 2020, provisional application No. 62/972,475, filed on Feb. 10, 2020.

(51) Int. Cl.
*B65D 55/08* (2006.01)
*B65D 23/02* (2006.01)
(Continued)

(52) U.S. Cl.
CPC ..... *B65D 55/08* (2013.01); *B65D 23/02* (2013.01); *B65D 53/02* (2013.01); *B65D 65/466* (2013.01); *B65D 2565/385* (2013.01)

(58) Field of Classification Search
CPC ..... B65D 55/08; B65D 23/02; B65D 53/02; B65D 65/466; B65D 2565/385
(Continued)

(56) References Cited

U.S. PATENT DOCUMENTS 1,522,975 A 1/1925 Phillips
3,851,812 A * 12/1974 Bittel ..... B65D 47/265 229/5.5
(Continued)

FOREIGN PATENT DOCUMENTS

CN 109153475 A 1/2019
CN 110053852 A 7/2019
(Continued)

OTHER PUBLICATIONS

Extended European Search Report for European Application No. 21753288.6; Report Mail Date Apr. 12, 2024 (12 Pages).
(Continued)

*Primary Examiner* — Steven A. Reynolds
(74) *Attorney, Agent, or Firm* — CANTOR COLBURN LLP

(57) ABSTRACT

A container includes: a pulp-formed shell configured to contain a material therein, the pulp-formed shell having an opening through which the material may pass, the pulp-formed shell being formed from a first material; and, a collar having one or more engagement features configured to engage at least a portion of the pulp-formed shell by pinching, indenting, deforming, or any combination of pinching, indenting and deforming, at least a portion of the pulp-formed shell, the collar being formed from a second material.

21 Claims, 47 Drawing Sheets

(51) Int. Cl.
*B65D 53/02* (2006.01)
*B65D 65/46* (2006.01)

(58) Field of Classification Search
USPC ..... 206/524.1; 220/359.4, 788, 613; 229/5.5
See application file for complete search history.

(56) References Cited

U.S. PATENT DOCUMENTS

| | | | | |
|---|---|---|---|---|
| 4,241,864 | A * | 12/1980 | Kessler | B65D 15/08 229/5.8 |
| 4,700,867 | A * | 10/1987 | Dutt | B65D 15/08 220/495.05 |
| 4,852,792 | A * | 8/1989 | Hale | B65D 15/06 229/5.5 |
| 5,722,782 | A | 3/1998 | Rosenthal | |
| 6,116,448 | A | 9/2000 | Fragos | |
| 7,467,734 | B2 | 12/2008 | Bocola | |
| 8,322,559 | B2 * | 12/2012 | Kuzelka | B65D 15/08 220/613 |
| 9,156,223 | B2 * | 10/2015 | Stolzman | B65D 43/0231 |
| 10,173,829 | B2 | 1/2019 | Sawyers | |
| 10,526,105 | B2 | 1/2020 | Guertin | |
| 10,743,636 | B2 | 8/2020 | Bushell | |
| 2005/0260025 | A1 | 11/2005 | Kurihara et al. | |
| 2006/0021998 | A1 | 2/2006 | Bocola | |
| 2008/0179276 | A1 * | 7/2008 | Lohrman | B29C 45/16 215/253 |
| 2009/0283526 | A1 * | 11/2009 | Pierce | B65D 43/022 220/789 |
| 2010/0252617 | A1 | 10/2010 | Dayton et al. | |
| 2011/0220652 | A1 | 9/2011 | Corbett et al. | |
| 2011/0290798 | A1 | 12/2011 | Corbett et al. | |
| 2015/0321798 | A1 | 11/2015 | Isogai | |
| 2016/0272388 | A1 * | 9/2016 | Slack | B65D 25/32 |
| 2017/0355487 | A1 * | 12/2017 | Guertin | B32B 1/00 |
| 2020/0255206 | A1 | 8/2020 | Freedman et al. | |

FOREIGN PATENT DOCUMENTS

| | | | |
|---|---|---|---|
| DE | 4120969 | A1 | 5/1992 |
| GB | 428909 | A | 5/1935 |
| GB | 2548399 | A | 9/2017 |
| JP | H0259180 | U | 4/1990 |
| JP | 2000025853 | A | 1/2000 |
| JP | 3068009 | B2 | 7/2000 |
| JP | 2002059180 | A | 2/2002 |
| JP | 3848469 | B2 | 9/2006 |
| KR | 102031206 | B1 | 10/2019 |
| WO | 0126978 | A1 | 4/2001 |
| WO | 02090209 | A1 | 11/2002 |
| WO | 2010116223 | A2 | 10/2010 |
| WO | 2013036695 | A1 | 3/2013 |
| WO | 2017009706 | A1 | 1/2017 |
| WO | 2022055921 | A1 | 3/2022 |

OTHER PUBLICATIONS

Partial Extended European Search Report for European Application No. 21753288.6; Report Mail Date Jan. 22, 2024 (14 Pages).

International Search Report; International Application No. PCT/US2021/017463; International Filing Date: Feb. 10, 2021; Date of Mailing: Jun. 3, 2021; 5 pages.

International Search Report; International Application No. PCT/US2021/049859; International Filing Date: Sep. 10, 2021; Date of Mailing: Jan. 6, 2022; 4 pages.

Written Opinion of the International Searching Authority; International Application No. PCT/US2021/017463; International Filing Date: Feb. 10, 2021; Date of Mailing: Jun. 3, 2021; 6 pages.

Written Opinion of the International Searching Authority; International Application No. PCT/US2021/049859; International Filing Date: Sep. 10, 2021; Date of Mailing: Jan. 6, 2022; 7 pages.

Extended European Search Report issued in European Application No. 21867673.2 dated Oct. 4, 2024; 10 pages.

Office Action issued in corresponding Chinese Application No. 202180069367.7; Date of Issue: Jan. 19, 2026 (with English translation).

First Office Action issued in Chinese Application No. 202180013815.1 dated Nov. 18, 2025 with English translation.

Extended European Search Report issued in European Application No. 26187139.6 dated Sep. 8, 2026; 10 pages.

* cited by examiner

MODULAR CONTAINER WITH IMPROVED PERFORMANCE

BACKGROUND

Recycling programs are dependent on their ability to quickly sort through vast amounts of materials and convert them into products of value. The viability of recycling programs, at present, is thus hampered by low integrity materials that diminish in value through iterations of recycling and use. Many plastics fall into this category, and impose high conversion costs while returning minimal value to recycling centers. Conversely, some materials, such as aluminum, demand high prices while simultaneously being relatively easy to recycle. Some containers are composite containers that are made of different and unlike materials that are laminated together making it difficult to separate therefore render them unrecyclable.

BRIEF SUMMARY

A need exists for improved products that are easily recyclable and/or compostable. A further need exists for products with components that may be easily separable.

Constructing products with a higher proportion of degradable materials is a tractable solution for improving the efficacy of recycling programs. Readily degradable materials are easier to separate from recyclable matter than non-degradable materials such as thermoset plastics, and confer the additional benefit of having lower recalcitrance when dispersed into the environment. The packaging systems can ensure reduction in proportion of non-degradable materials, such as plastic, by utilizing the structural properties of degradable outer components and reducing the amount of plastic required. The plastic in the disclosed systems is only present for barrier properties to protect the product.

To ensure the long-term health of curbside recycling programs and to lessen our reliance on plastics, there is a need to build packaging systems that leverage materials that are renewable, degradable, easy to separate and economical to recycle.

Accordingly, an embodiment includes a container having: a pulp-formed shell configured to contain a material therein, the pulp-formed shell having an opening through which the material may pass, the pulp-formed shell being formed from a first material; and, a collar having one or more engagement features configured to engage at least a portion of the pulp-formed shell by pinching, indenting, deforming, or any combination of pinching, indenting and deforming, at least a portion of the pulp-formed shell, the collar being formed from a second material.

Additional aspects and advantages of the present disclosure will become readily apparent to those skilled in this art from the following detailed description, wherein only exemplary embodiments of the present disclosure are shown and described, simply by way of illustration of an example mode contemplated for carrying out the present disclosure. As will be realized, the present disclosure is capable of other and different embodiments, and its several details are capable of modifications in various obvious respects, all without departing from the disclosure. Accordingly, the drawings and description are to be regarded as illustrative in nature, and not as restrictive.

BRIEF DESCRIPTION OF THE DRAWINGS

The novel features of the invention are set forth with particularity in the appended claims. A better understanding of the features and advantages of the present invention will be obtained by reference to the following detailed description that sets forth illustrative embodiments, in which the principles of the invention are utilized, and the accompanying drawings of which:

FIGS. 33A, 3B, 33C, and 33D, illustrate various views of a squeezable shell with collar and liner, in accordance with an embodiment.

DETAILED DESCRIPTION

Figure 1A:
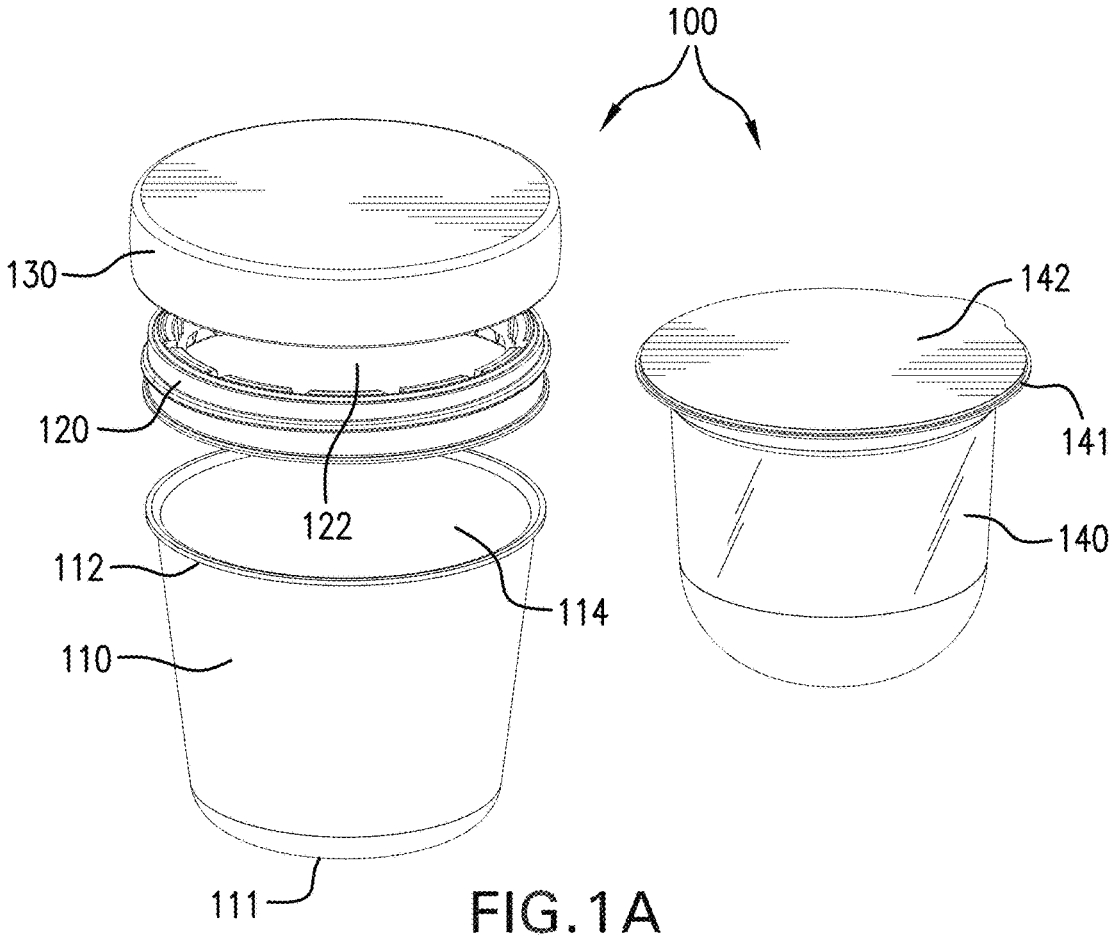
FIG. 1A shows an example set of modular components that may be assembled to construct a container in accordance with an embodiment.

While example embodiments of the invention have been shown and described herein, it will be obvious to those skilled in the art that such embodiments are provided by way of example only. Numerous variations, changes, and substitutions will now occur to those skilled in the art without departing from the invention. It should be understood that various alternatives to the embodiments of the invention described herein may be employed in practicing the invention.

The invention described herein provides multi-part containers. Various aspects of the invention described herein may be applied to any of the particular applications set forth below or for any other types of containers or materials in containers. The invention may be applied as a standalone device, or as part of an integrated packaging system. It shall be understood that different aspects of the invention can be appreciated individually, collectively, or in combination with each other.

A container may be configured to contain materials. In some instances, the materials may be liquids. Liquids may include aqueous solutions, organic solutions, oils, emulsions, and slurries. In some instances, the materials may be particulate materials. Particulate materials may include granular products, food, pellets, pebbles, grains, powders, or other materials. Particulate materials may include solid materials. In some instances, the multi-part container may be configured to contain a mixture of different materials. In some instances, said mixtures are combinations of liquids and particulate materials. The container may be configured to isolate the contained materials from a surrounding environment. The container may contain edible materials in a food-safe manner.

In some embodiments of the present invention, the multi-part containers may have pulp-formed or pulp-molded shells. As used herein, the term shell refers to a structure that substantially encloses one or more inner spaces, but with an opening for access to dispensing of the material contained therein. A shell may partially enclose the inner space, or completely enclose the inner space with the attachment of a closure. A shell may be rigid, malleable, or soft, and may have additional structural characteristics not limited to those listed herein above. Furthermore, a shell may be comprised of one or more than one object. In some instances, a shell may be formed from two or more parts. Parts of the shell may be connected to one another with aid of an adhesive, overlapping features, interlocks, or any other configurations.

In some instances, one or more hinge may be provided that may allow one or more portions of a shell to open and/or close.

As used herein, the terms 'pulp-formed shell' or 'pulp-molded shell' refers to any shell in which a portion of the material comprising the shell is derived from pulp, fiber, paper, or a related material, and said terms are herein used interchangeably. The pulp-molded shell can comprise type-2 molded fiber, type-2A thermoformed fiber, type-3 thermoformed fiber, type-4 thermoformed fiber, molded fiber, matched tool molded fiber, X-RAY formed fiber, infrared formed fiber, microwave formed fiber, vacuum formed fiber, structural fiber, compression formed fiber, wet press fiber, wet press with hot after press formed fiber, sheet stock, recycled plastic or any other structural material. The material used for forming the pulp-molded shell may be, but need not be, food-grade. In some instances, a pulp-molded shell may be a container. Any description herein of a pulp-molded shell may also apply to thermoformed materials and vice versa. The shell may be formed from a pre-used or recycled material. In some embodiments, the shell may or may not be formed from non-virgin material.

The containers of the present invention may have any shape. In some instances, the containers may be round. Alternatively, the containers may be cubic or rectilinear. The containers may have sharp corners or may have rounded corners. The shell may be molded into a desired three-dimensional shape. The shell may include one or more parts that are not limited to a two-dimensional plane. The shells may form shapes of jars, bottles, sticks, tubes, blocks, buckets, or any other type of shape.

In some instances, the containers may have liners. The liners may be partially or entirely contained within one or more pulp-molded shells. The liners may enclose inner-spaces, and thus may be capable of acting as containers. The liners may also be made out of any suitable material, including polymers, alloys, glass, or plant fibers. In some embodiments, the liners contain multiple elements that may be comprised of different materials and which may have different properties, such as malleability and temperature tolerance. The liners may be formed or attached to an interior surface of a shell. Alternatively, the liners may hang loosely or need not match the interior surface of the shell. The liners may include bags. The liners may include thermoformed plastics. The liners may be blow-molded. The liners may be formed of metals, such as aluminum, steel or other materials. The liners may be applied to the interior surface as a coating, forming a membrane or barrier. Once applied it can be connected to a collar, fitment, or not. The liners may be rigid, semi-rigid, or malleable. Alternatively, the containers need not have liners.

In some embodiments, the pulp-molded shell may be formed of any agri-fiber, such as pulp. The container may be formed from one of more processed forms of agri-fiber suitable for molding and/or thermoforming. In some instances, the container may be formed of a material other than cardboard or paper (e.g., corrugated fiberboard and news paper), because, for example, cardboard may be too rigid and paper may be too flexible/compliant to undergo the molding and/or thermoforming process desired. Any of the materials that may be used to form the container may be used in any of the embodiments described herein. Any discussion of pulp herein may also apply to any of the materials (e.g., fiber molding, natural fibers, biodegradable or compostable materials) that may be used to form a container. Additives may be used to impart added characteristics such as strength, moisture resistance, odor control, fungal or bacterial-growth resistance. The container may be formed from a combination of materials, or different components of the container may be formed from the same material or different materials.

In some instances, a part thickness from pulp mold thermoforming is less than 2 mm max. The part thickness may be less than or equal to 5 mm, 4 mm, 3 mm, 2 mm, 1 mm, or 0.5 mm. In other instances such as wet molded pulp, thickness may be greater than or equal to 2 mm, 6 mm, 10 mm, or 20 mm.

In some instances, material used to form the container may be treated. For instance, treatment of the pulp molded surface/shell may be provided. Spray treatment to an internal shell may help seal the pulp. The interior and/or exterior surface of the container may be sprayed. In some instances, a vacuum formed layer of thin film may be provided. The thin film may be provided on an interior and/or exterior surface of the container. In some instances a Nano particulate treatment to the film can be added for additional barrier characteristics. Application of a nano-particulate coating, as an example a vermiculite clay platelet nano particle, can be applied directly to the pulp formed surfaces in order to decrease the permeability of the pulp formed parts to liquid, powder, air, aroma or gases.

Treatment to the pulp-molded shell may be used to make the shell waterproof or water resistant. Alternatively, the treatment may be used to prevent fine particulate materials from escaping from the container. Alternatively, no extra treatment to the shell may be required.

As used herein, the term 'attached' describes a relationship between two or more elements which are fixed to either, in contact with, or in close proximity to, each other. The elements may be portions of the same object, or of separate objects. In some instances, attachment may be facilitated by two or more elements being fastened, locked, inter-threaded, gripped, pierced or stuck, relative to each other. In some instances, a connection may be facilitated by adhering elements to one-another, such as by soldering, welding, thermo-welding, or gluing. In some instances, the term 'attached' may refer to multiple different attachment methods employed simultaneously. Any number of the elements comprising a multi-part container may have structural features (e.g. threading) that facilitate their attachment to other elements of the multi-component container. In some instances, an attachment may be made with merely a mechanical connection without requiring adhesive, soldering, welding, melting, and so forth.

The present disclosure provides a container with modular components. In some instances, at least some of the modular components may be handled differently after use of the product. The modular components may be disposed of or treated in a different manner. For instance, the modular components may be separately recyclable and compostable. In some embodiments, one or more components of the container can be recycled or reusable while the other components may be formed of pulp-molded materials or renewable materials. For instance, a collar and/or lid of the container may be formed of recyclable or reusable material (e.g., plastic, metal) while the shell of the container is formed of compostable material (e.g., pulp-formed, pulp-molded). Alternatively, the collar and/or lid may be formed of a compostable material. In some instances, the collar or lid may have a liner that is integral to the collar or lid, and the liner may also be recyclable or reusable. When a liner is integral to a collar or lid, it may be formed of the same material as the collar or lid, and/or be handled in the same manner. Such individually recyclable and compostable modular components may be assembled to form a container having flexible recyclable/renewable level. For instance, by selecting different combinations of the recyclable/renewable modular components, at least 10%, 20%, 30%, 40%, 50%, 60%, 70%, 80%, 90% of the container may be formed of compostable materials. This may beneficially provide a sustainable container by reducing plastic while leveraging materials that are renewable, degradable, easy and economical to recycle.

A container as provided herein may be assembled with modular components. Such modular components may comprise structures and features allowing for convenient and easy assembly/disassembly such that the recyclable modular component (e.g., collar) may be reused while the composable component (e.g., shell) can be swapped out with anew modular component. For instance, a packaging system of the present disclosure may allow for different components to be selected from a list of components depending on the intended contents to be packaged (e.g., type of contents, amount of contents) for forming a container.

In some embodiments, the recyclable or reusable components of the container may comprise a collar. The collar may be formed of recyclable or reusable materials (e.g., plastic, metal) to provide support to the neck of the container and strengthen the overall performance of the container. The collar may provide features to enable use of a reclosable lid, such as threads or ribs for a snap-fit closure lid. In some embodiments, the recyclable or reusable components of the container may comprise a lid which can be reused. In some cases, the collar and/or lid may be reusable while the shell part (e.g., pulp-molded shell) may be discarded and replaced with a compostable shell part when it is worn out.

Reference is now made to the various enumerated figures provided herewith, where like elements are named alike even though they may be enumerated differently in the different figures. Certain like features may be enumerated with a preceding numeral that relates to the correlating figure number in which the like feature is illustrated. As such, it will be appreciated that a pulp-molded shell depicted in one figure may be similar or have similar characteristics as a pulp-molded shell depicted in another figure even though they are enumerated differently. The pulp-formed or pulp-molded shell may herein be referred to simply as a 'shell'.

FIG. TA provides an example of a multi-part container 100 having a pulp-formed or pulp-molded shell 110, a collar 120, a closure 130 and optionally a liner or secondary container 140. The container may be manufactured so that two or more of the components are attached, integral, or so that all of the components are separate. For example, the collar and liner may be manufactured as a single piece or may be manufactured as separate pieces capable of later becoming attached. In some embodiments, one or more of the components of the container may be designed to become attached to one or more of the other components of the container. For example, the collar may be designed to grip the pulp-molded shell and liner providing improved support to the shell or to resist rotation when applying or removing a threaded closure. The gripping features may also provide a secure connection between the collar and the shell to resist the removal forces of a snap-type closure. In a container with 2 or more shell parts, the collar may provide retention features to keep the shells assembled correctly. The container may have an inner-space capable of holding a material. In some embodiments, this inner space is defined by a concavity in the container architecture.

The pulp-formed shell 110 may have any proportions and shape, and may be formed from one, two, or more pulp-molded shells. In some embodiments, portions of two or more shells may overlay partially or fully with respect to each other. For example, a first pulp-formed shell may have the appropriate shape and dimensions to uniformly cover portions of one or more surfaces of a second pulp-formed shell. The two or more shells may also be combined to form architectures that are distinct from any of the individual shell components. For example, two shells may combine top-to-bottom or side-to-side to form shell structures with greater dimensions than any of the individual shell units.

In some embodiments, the pulp-formed shell may have a bottom surface 111. This bottom surface may be shaped so as to permit the shell to rest on this bottom surface. In some embodiments, this bottom surface may be flat so as to permit the container to rest upon an underlying surface.

The pulp-molded shell may also have one or more openings. For example, the pulp-molded shell may have a shape resembling a cylinder or elongated box with one closed end and one open end. In these embodiments, the closed and open ends may have different shapes and dimensions, while the sides may be flat or have even or uneven curvature. The container may have any shape including, but not limited to jugs, bottles, tubs, boxes, dispensers, or any other shape.

In some embodiments, the multi-part container comprises one or more collars 120 that may be designed so as to attach to or cover a portion of the pulp-molded shell. The collars may have one or more threaded, ribbed, barbed, clamped, grooved, crimped or hooked features that allow the collar to grip or attach to the pulp-molded shell. The collars may include one or more features that may be at least partially embedded into a portion of the pulp molded shell. In some instances, the collars may include one or more features that may at least partially pierce or deform a portion of the pulp-molded shell. In some embodiments, the collars contain these features within one or more concave spaces that can overlap with an edge, surface or other portion of the pulp-molded shell. For example, a collar may have a groove that contacts the inside and outside faces of the pulp shell. The collar may be attached to the shell with aid of an adhesive. The collar may be capable of remaining on the shell without requiring an adhesive. The collar may be formed from a different material as the shell. The collar may be formed from the same material as the shell. The collar may be formed from a material that is more durable than the shell. In some instances, the collar may be formed from a material that is harder, more rigid, and/or stronger than the material of the shell.

The collars may also be designed to mate with one or more closures 130. The closure may be designed so that it fully or partially covers one or more openings 122 defined by the collar and pulp-molded shell. In some embodiments, the closure may lock or tighten against the collar. The closure may be removable and/or reattachable with the collar. For example, the closure may have threading that is complimentary to threading on the collar, or the closure may contain a groove that fits tightly against a protrusion on the closure.

In some embodiments, no liner is required. In these embodiments, materials held by the container may directly contact the pulp-molded shell. For example, materials may contact the inner-surface of a pulp-molded shell that is shaped as an open cylinder. In other embodiments, a liner 140 may be provided. The liner may be a pouch, bag, rigid container, or other object capable of holding one or more materials. The liner may be formed from a flexible material such as a polymer or from a stiff material such as an alloy. The liner may be capable of being fully or partially encapsulated by the pulp-molded shell, and may be capable of fitting in, connecting to, contacting or resting on the collar. For example, the liner may optionally be designed with a protrusion 141 that can fit over a portion of the collar and may also fit below the surface of the closure. In some embodiments, a portion of the liner may be designed to mate with a closure. For example, the liner may be designed with a protrusion that extends out from the pulp-molded shell and contains an opening that may mates with a closure.

The liner may also comprise one or more liddings 142. These liddings may be connected to the liner, or connected to the collar and may fully or partially seal one or more openings in the liner. In some embodiments, the materials comprising the liddings are different than those comprising the liner, and the liddings and liner may have different physical properties. In other embodiments, the liner and lidding are comprised of the same materials.

Figure 1B:
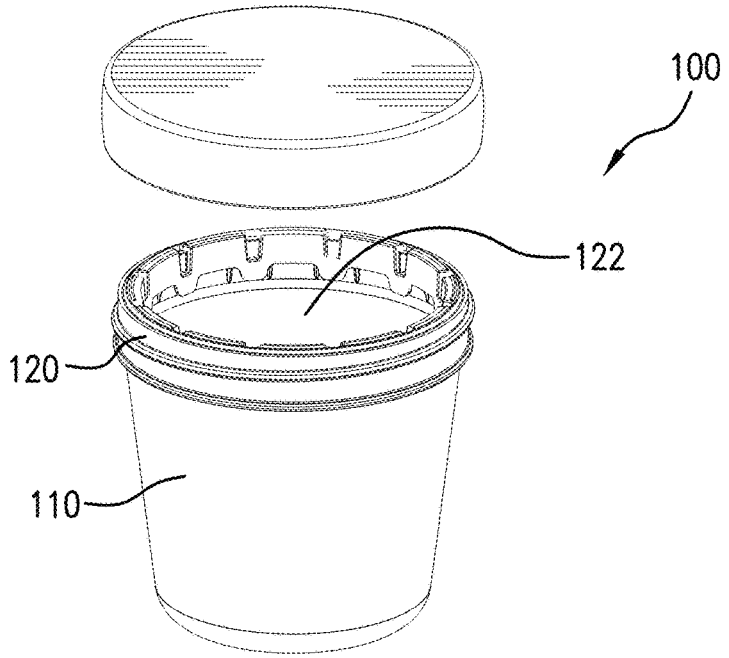
FIG. 1B shows a collar connected to a pulp-molded shell, in accordance with an embodiment.

FIG. 1B illustrates a possible embodiment in which the collar and pulp-molded shell from FIG. TA are attached. In some embodiments, the attachment is purely mechanical. For example, the collar may have a groove that fits over an edge of the pulp-molded shell and applies pressure against one or more sides of the pulp-molded shell, thus conferring some degree of attachment between the two articles. In some embodiments, the collar may first be made to rest on the pulp-molded shell, and subsequently be compressed, crimped, distorted using heat, or mechanically distorted, so as to modify its contact with the pulp-molded shell. In some embodiments, the collar may be attached to the pulp-molded shell by one or more adhesives.

Figure 2A:
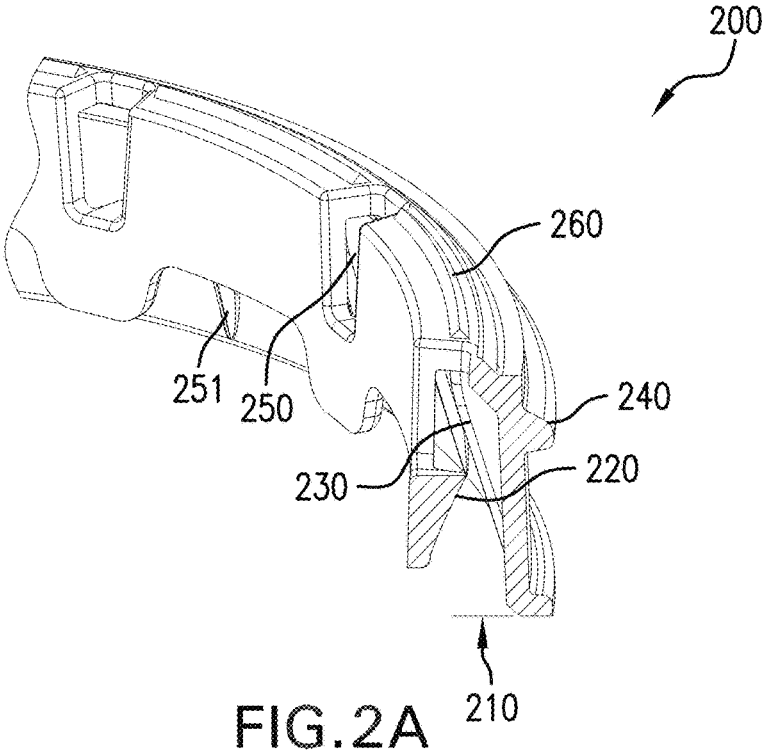
FIGS. 2A, 2B, and 2C, illustrate partial schematic side, bottom, and top views of a collar that may attach to a pulp-molded shell, in accordance with an embodiment.
Figure 2B:
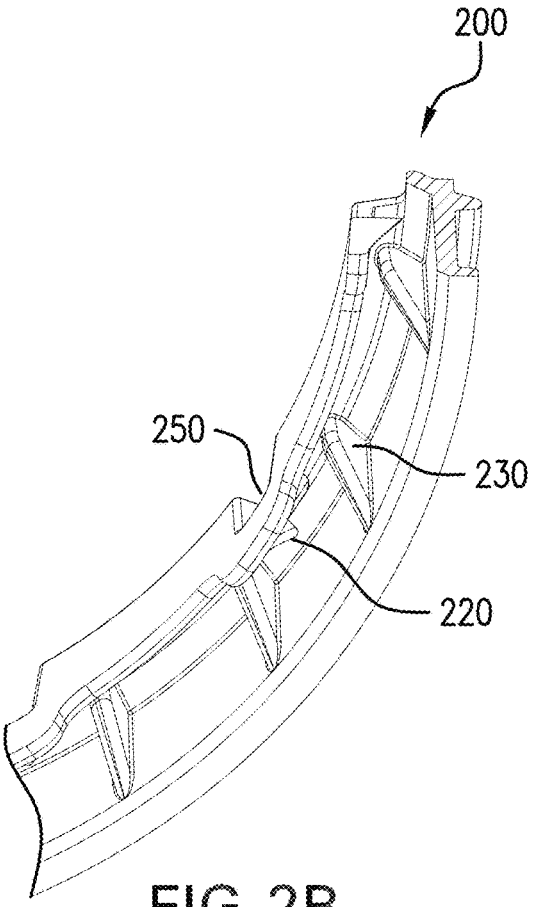
Figure 2C:
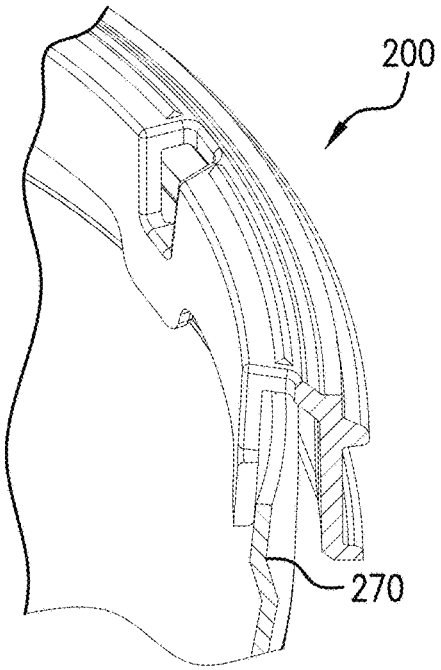

FIGS. 2A-2C provide an example of a partial section of a collar 200 for the container. The collar may be dimensioned so that it may cover one or more edges of the pulp-molded shell. The collar may cover and/or contact an outer surface of the pulp molded shell. The collar may cover and/or contact the outer surface at or near a neck 112 of the shell and/or an edge of an orifice 114 of the shell 110 (best seen with reference to FIG. TA). Alternatively, or in addition, the collar may cover and/or contact an inner surface of the shell. The collar may cover and/or contact an inner surface of a neck of the shell. The collar may cover and/or contact both an outer and inner surface of a neck of the shell. The neck may optionally have a substantially vertical orientation. The collar may optionally have a substantially vertical orientation when attached to the shell and the shell is standing upright. In some embodiments, the collar has a concave architecture that defines an inner-space 210 comprising one or more inner-surfaces that are dimensioned to fit over a portion of the pulp-molded shell. The collar inner-surfaces may contain protrusions such as barbs 220, ribbing 230, pips, edges or threading. Any description herein of a barb or other type of feature may refer to any type of feature that may pierce or deform a portion of the shell when the barb is pressed against the shell with sufficient force. Any description herein of a barb or other type of feature may refer to any type of feature that may be at least partially embedded into the shell when pressed against the shell with sufficient force. These features may provide means for securing the collar against the pulp-molded shell. For example, the collar inner-space may contain ribbing and barbs that apply gripping pressure to the pulp-molded shell. The ribbing and barbs may be arranged together to deform the pulp-molded shell. The ribbing may assist in allowing the barbs to at least partially pierce the shell. The ribbing may allow the barb to have enough force to pierce the underlying shell without causing the shell to deform in an unwanted manner. In an embodiment, this pressure is sufficient to secure the collar to the pulp-molded shell, while still being able to remove the collar from the shell for ease of recycling. The collar may contain features that pinch, pierce, indent and/or partially deform at least a portion of the pulp-molded shell. These features may grip or otherwise engage an outer surface of the shell, an inner surface of the shell or any other portion of the shell. These features may grip or otherwise engage an inner surface of a neck, an outer surface of a neck, or any portion around the orifice of the shell. In some instances, the features may be designed to contact both inner and outer surfaces of the shell.

The collar may also have features on its outside surfaces. For example, the outside surface of the collar may have protrusions 240 or intrusions 250 and 251. Intrusion 250 can be a clearance feature that allows the collar molding to reach and form the internal barb features 220 in its working state or position. As depicted in FIGS. 2A and 2B, barb 220 is shown on the inside face of the inside wall of the collar, but other embodiments a barb 220 type of feature can be located on the inside of the outside wall of the collar. In some embodiments, these collar surface features aid in connecting the collar to the pulp-molded shell, the closure, or the liner. For example, the collar may have a protrusion, such as a thread 240 that the closure can fit over or rest on. The collar may have intrusions that are formed from shut off openings over inner-surface features, such as barbs. The incorporation of intrusions and barbs can be executed so that there is no orientation requirement with the shell if the orifice of the shell is circular. The outer surface of the collar may also contain an energy director bead 260, which may allow the collar to be welded (e.g., heat or ultrasonic). In some instances, welding and/or adhesives may be used to aid in securing the collar to the shell.

The collar may include one or more intruding and/or protruding portions that may be configured to mate or complement a feature of the shell or any other portion of the container with which the collar is to mate. The complementary and/or interlocking shapes may allow the collar to be secured to the shell. Any gripping, pinching, indenting, deforming, and/or piercing, features may also be used to allow the collar to be removably secured to the shell. The collar may be secured to the shell in a way that prevents undesirable rotation or removal of the collar from the shell. The connection between the collar and the shell may be considered to be permanent during normal use of the container, but the connection may be defeated by certain types of operations. For example, crushing or twisting the shell may allow the connection of the collar to the shell to release. This release facilitates separation and disposal of the components that may have different recycling characteristics. In an embodiment, the collar, subsequent to be attached to the pulp-formed shell, is configured to be detachable from the pulp-formed shell by a user, or by recycling equipment configured to crush the container.

FIG. 2B shows the same collar as FIG. 2A with a view from the bottom.

As is illustrated in FIG. 2C, the shell may be deformed by features of the collar. Deforming features may be ribbing, barbs, pips, grooves, etc. Such deforming features may interact with a pulp shell 270.

The collar may have a substantially circular shape, elliptical shape, square shape, rectangular shape, or any other shape suitable for a purpose disclosed herein. The collar may include features all around the circumference of the collar. The features may be substantially evenly spaced around the circumference of the collar. Alternatively, the features may be clustered and/or evenly spaced to provide higher density at certain areas.

Figure 3A:
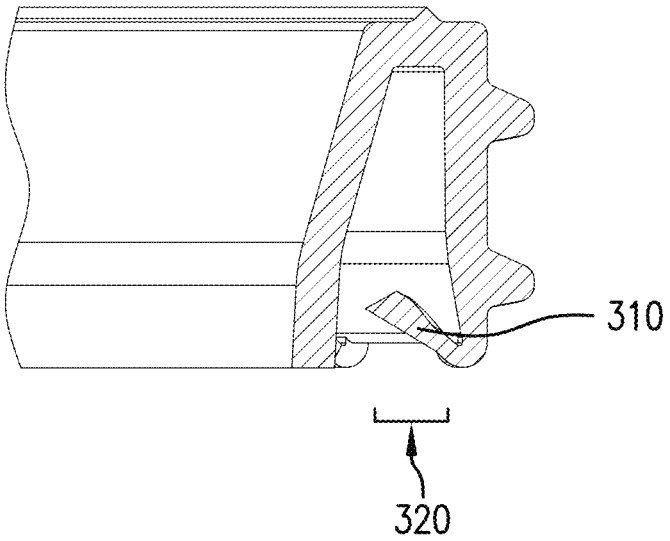
FIG. 3A illustrates a partial schematic side view of a collar that contains barbs that may bend upon insertion of a pulp-molded shell into the collar groove, in accordance with an embodiment.
Figure 3B:
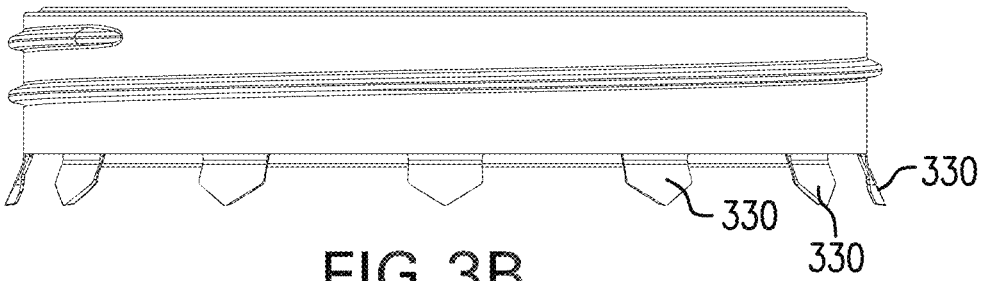
FIG. 3B illustrates a schematic side view of the collar of FIG. 3A with its barbs pointing outward, in accordance with an embodiment.
Figure 3C:
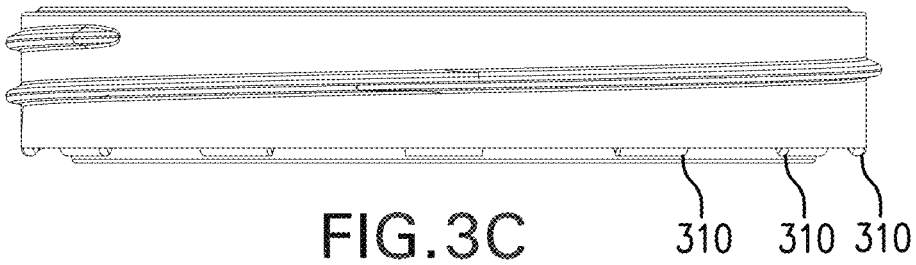
FIG. 3C illustrates a schematic side view of the collar of FIG. 3A with its barbs turned inside of the collar groove, in accordance with an embodiment.

FIG. 3A-3C illustrate a collar that contains barbed protrusions 310. FIG. 3A illustrates the cross section of an example of a collar. As previously described, the collar may contain an inner-space 320 defined by a concave curvature in the collar structure. In some embodiments, the collar may contain protrusions 310, such as barbs, that extend into this inner-space. The protrusions may have a pointed end. The protrusions may be capable of piercing or gripping into the shell with the pointed end. The protrusions may or may not have hooks or similar features. Any description herein of a protrusion or barb may apply to any other type of feature, such as features that pierce, grip, or deform an underlying shell when sufficient pressure is applied. A protrusion may have any shape. The protrusion may have a pointed end or a rounded end. The protrusion may be substantially flat, or may have a curved or bent feature, such as a hook. The collar may also contain a protrusion that extends away from the inner-space 320. The protrusions may be capable of adopting more than one position. For example, the collar may contain protrusions that are capable of being moved between positions outside of the inner-space 320 and inside of the inner-space 320. In some instances, the protrusions may be integrally formed on the collar. The protrusions may be formed from a material that when bent, substantially retains its shape absent an outside force.

In some embodiments, contacting the collar with the pulp-molded shell may change the positions of some collar features. For example, a collar may have protrusions 330 that become bent inside of the collar inner-space when the collar is brought into contact with a pulp-molded shell. Such repositioning of collar components may aid in securing the collar to other components of the multi-part container, such as the pulp-molded shell. In some embodiments, the contact with the shell may cause the protrusions to bend inwards. The shell may be inserted adjacent to the protrusions and gripped by the protrusions. In some instances, some inward bending may be caused manually or with aid of a device. The neck of the shell may then be inserted into the inner-space of the collar, or provided adjacent to the protrusions and be gripped by the protrusions as the neck is inserted.

The collar may be formed from a deformable material such as plastic, or metal. Examples of materials that may be used for the collar may include aluminum, brass, steel, copper, zinc, HDPE, LDPE, PP, PET, Nylon, or PEEK.

The collar may be formed with the features, e.g., protrusions, in a first position (e.g., as illustrated in FIG. 3B). When the collar is attached to the shell, the features (e.g., protrusions), may be moved to a second position (e.g., as illustrated in FIG. 3C). The features may be bent into the second position. The features may be bent manually or with aid of a tool. The features can be bent before assembly of the collar to the shell or during the assembly of the collar to the shell. When the features are in the second position, the features may secure the collar to the shell. When the features are in the first position, the collar may not be secured to the shell.

Figure 4A:
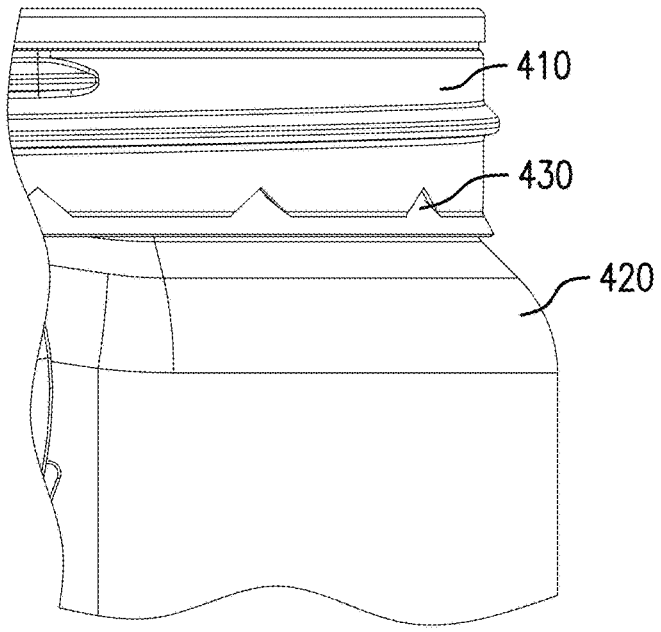
FIG. 4A illustrates a partial schematic side view of a barbed collar mounted on a pulp-molded shell, in accordance with an embodiment.

FIG. 4A shows an example of a metal collar 410 that is secured to a pulp-molded shell 420. In some embodiments, the collar may contain barbs 430 that point inward toward the center of the collar and contact the pulp-molded shell. This may beneficially allow the collar to be affixed to the shell part without rotating relative to the shell part. The barbs may be formed before the collar is affixed to the shell, or they may be formed after the collar is placed on the shell.

Figure 4B:
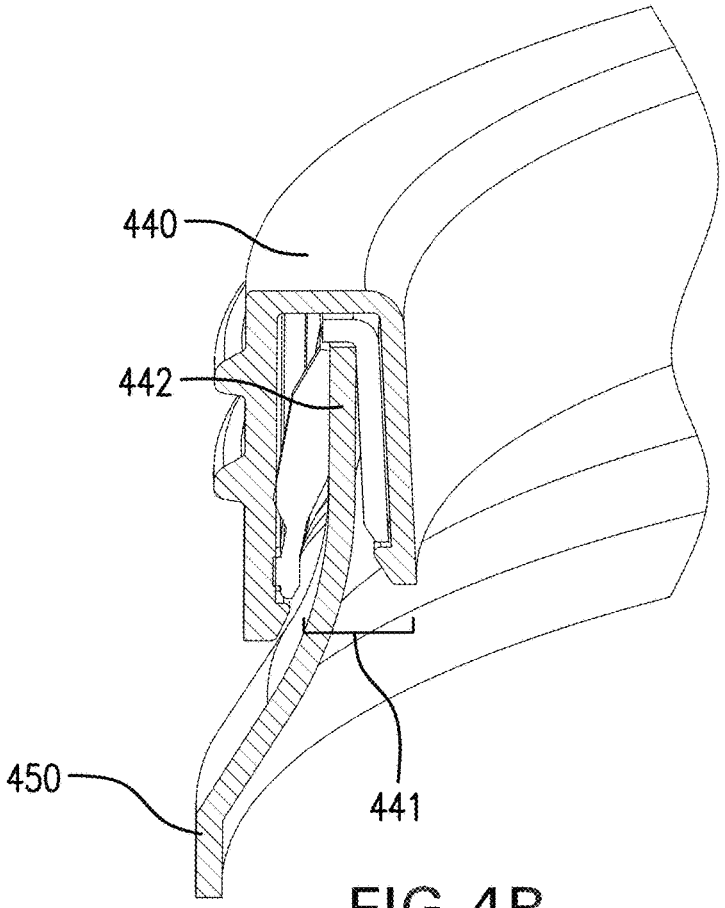
FIG. 4B illustrates a partial side cutaway view of a collar mounted on a pulp-molded shell, in accordance with an embodiment.

FIG. 4B illustrates a side cutaway view of a collar 440 which has an inner space 441 containing barbs 442 in contact with a pulp-molded shell 450. In some embodiments, these barbs are capable of piercing, deforming and/or pushing against the pulp-molded shell. In some embodiments, collar elements such as barbs may be capable of adopting multiple positions. For example, barbs positioned within the inner space of a collar may bend upwards towards the top of the collar when contacted by a pulp-molded shell, which could aid in securing the collar to the pulp-molded shell.

In some embodiments, the barbs may have a substantially triangular shape. In some instances, the barbs may be formed from folding slits in the collar at an angle. The barbs may form folded triangles from the side. The barb may be connected to the collar at a substantially horizonal line, a substantially vertical line, or a substantially angled line. The barbs may be positioned around the circumference around the collar. The barbs may or may not be substantially evenly spaced around the circumference of the collar.

Barbs and/or other protrusions may be located at a bottom of the collar (e.g., at or near a bottom edge of the collar). Barbs and/or other protrusions may be located at a top of the collar, or in an intermediary portion of the collar between a bottom and top edge of the collar.

Figure 5A:
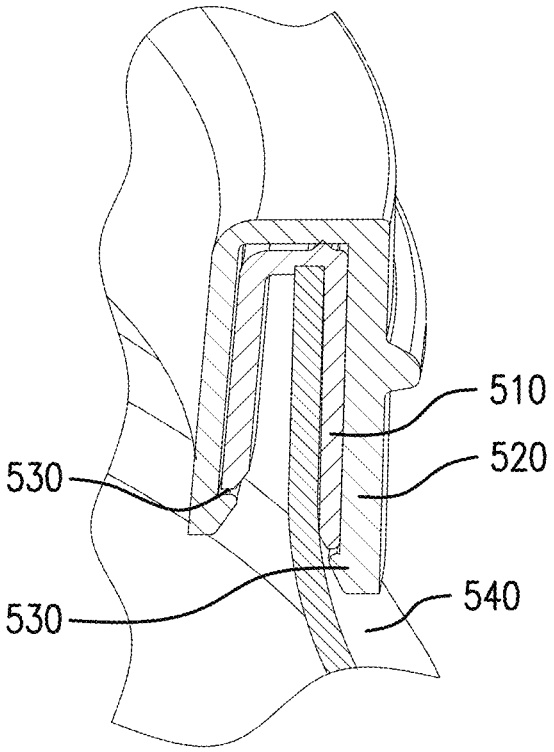
FIG. 5A illustrates a partial side cutaway view of two components of a collar that are mounted on a pulp-molded shell, in accordance with an embodiment.

FIG. 5A shows an example of nested collars in contact with a pulp-molded shell and a liner. A multi-part collar may be provided. The multi-part collar may include two or more portions, such as an inner collar 510 and an outer collar 520. In this example, the inner collar 510 may fit within the inner-space of the outer collar 520. An outer surface of the inner collar may contact an inner surface of the outer collar. The outer collar may optionally be substantially U-shaped (inverted U-shape) or include at least one set of overlapping features. The inner collar may be inserted within the U-shape and/or between the overlapping features of the outer collar. The inner collar may have a corresponding inverted U-shape and/or overlapping features. The outer collar may have one or more structural engagement features 530, such as grooves or shelves, that aid in holding or retaining the inner collar within the inner-space of the outer collar, and the collars may be capable of fitting over a pulp-molded shell 540, and furthermore may also be capable of gripping the pulp-molded shell. The inner collar may include one or more protrusions that may grip the pulp-molded shell. The pulp-molded shell may be sandwiched between an inner layer and outer layer of the inner collar. The inner collar may be sandwiched between an inner layer and outer layer of the outer collar. Air gaps may or may not be provided between the layers.

Figure 5B:
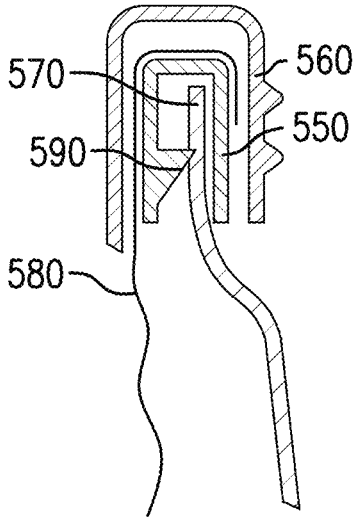
FIG. 5B illustrates a partial side section view of a liner gripped in between two components of a collar, and a pulp-molded shell secured to the inner component of the collar via a protrusion, in accordance with an embodiment.

FIG. 5B illustrates a side cutaway view of two nested collars 550 and 560 in contact with a pulp-molded shell 570 and a liner 580. Optionally, the liner may be provided between the inner collar 550 and the outer collar 560. The liner may be formed from a thin material, such as a plastic film, that may be inserted between the nested collars. The liner may be made from a plastic or an alloy. The liner may wrap over at least a portion of the inner collar. In some embodiments, one or more protrusions from the inner collar 590 may contact and may possibly assist in gripping the pulp-molded shell. The protrusions may comprise a pointed surface that may pierce and/or indent the pulp-molded shell. The protrusions may be teeth that may dig into the pulp-molded shell. In some embodiments, two or more of the collars, pulp-molded shell, and liner may be attached.

Figure 6:
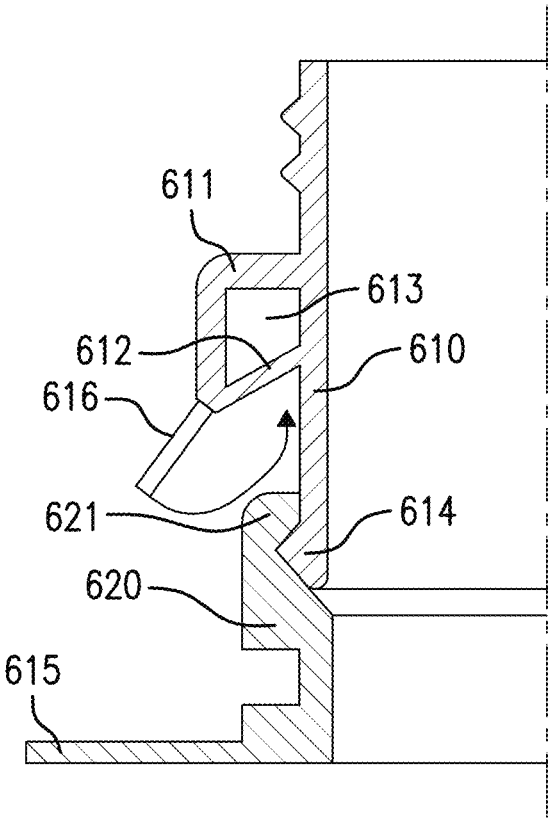
FIG. 6 illustrates a partial side section view of an interface with a lower fitment part that welds to a film liner that is snap-fit to an upper fitment part that carriers barb and thread features, in accordance with an embodiment.

FIG. 6 shows an example of a collar 610 with a neck finish 611 and locking feature 612 in contact with a weld fitment 620. The neck finish may extend outwards from the surface of the collar and may have a portion that overlaps a surface of the collar to form an inner region 613 therebetween. In some embodiments, the weld fitment may be welded to a liner. The weld fitment may be provided around an opening of the liner. A weld flange 615 may be provided. The weld flange may allow for welding to a film liner. The weld fitment may be provided around an orifice of the liner through which materials may pass. In some embodiments, complementary engagement features 614, 621 in the collar and weld fitment may allow the collar and weld fitment to form an attachment. In some embodiments, the collar locking feature may be capable of being repositioned between one or more alternate positions 616 from outside to inside of the inner region 613. The locking feature may be able to move between an outer position 616 and an inner position 612. The locking feature may include protrusions that may have a pointed feature. The locking feature may be moved into an inner position to grip a portion of a shell or weld fitment that is inserted within the neck finish. A shell or weld fitment may optionally be inserted into the inner region of the neck finish. In some embodiments, a shell may be inserted into the inner region of the neck finish and grabbed by the locking feature, while the engagement feature 621 in the weld fitment 620 mates with the complementary engagement feature 614 in the collar 610. The complementary engagement feature in the collar may include a shelf that may extend into a concave portion of the weld fitment.

As illustrated herein, multi-part collars may optionally be provided. The multi-part collars may include barbs or other types of protrusions that may be molded in a first position. The barbs and/or other protrusions may be locked into a second position when an outer collar is assembled to an inner collar.

Figure 7A:
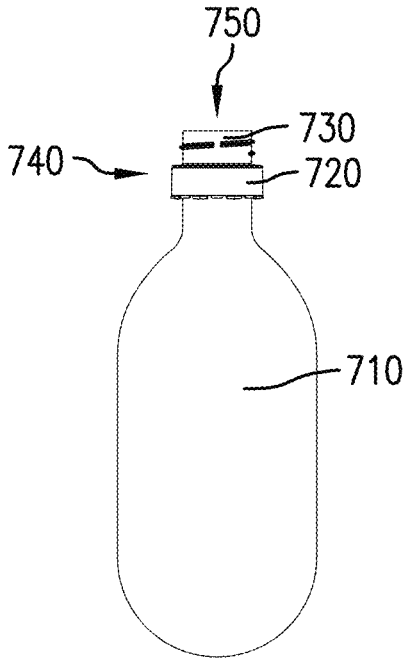
FIGS. 7A, 7B, 7C, 7D, 7E, and 7F, illustrate multiple views and designs of liners for the multi-part containers, in accordance with an embodiment.

FIG. 7A illustrates an example of a liner 710 with a collar 720. In some embodiments, the collar may be part of the liner (i.e., the liner and collar collectively form a single piece), while on other embodiments the collar and liner are physically distinct articles. The liner and collar may be formed as a single integral piece. In some instances, the collar and liner may be formed as separate pieces and may be attached to one another. In some instances, they may be removably attached to one another or may be permanently affixed to one another. In some embodiments, the liner contains features 730 that allow it to mate with a closure. For example, one end of the liner may contain a cylindrical neck 740 that terminates in an opening 750 and contains external thread features 730 that can facilitate mating with a closure having internal thread features.

As described herein above, the collar of the liner may comprise one or more protruding features that may be used to grip a shell that may be connected to the liner. The one or more protruding features may include one or more pointed features that may pierce or indent a portion of the shell. The collar may include an inner region into which the shell may be inserted. The protruding features may be bent inwards to grip the shell that is inserted into the collar.

Figure 7B:
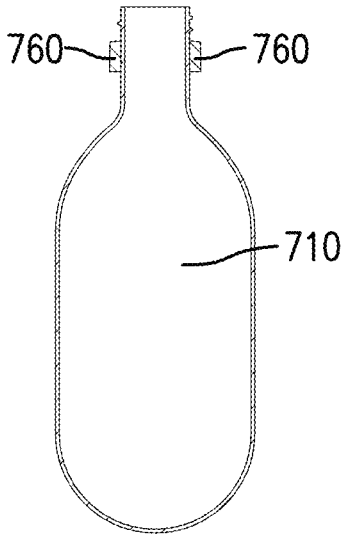

FIG. 7B illustrates a side view cross section of the liner and collar tandem depicted in FIG. 7A, and shows that in some embodiments the liner may have additional protrusions 760 on its outer surface. These protrusions may be located behind a portion of the collar, and aid in securing the pulp-molded shell to the liner-collar tandem. In alternative embodiments, protrusions may be formed on an inner surface of the collar.

Figure 7C:
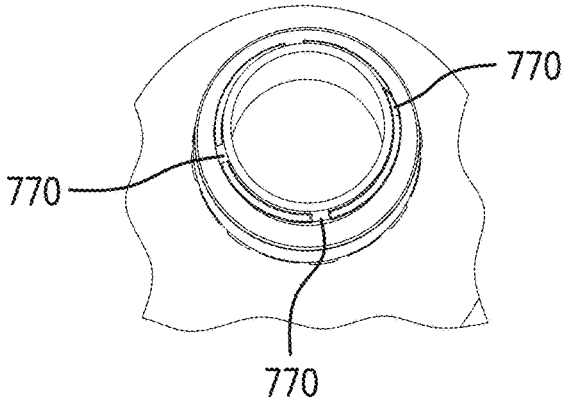

FIG. 7C shows a top down view of the liner-collar tandem from FIGS. 7A-7B, and shows that in some embodiments the collar may have indents or openings 770 on its surface. Indents, openings, shutoff, and similar features can be the result of the creation of barb or protrusion features, or for the purpose of deforming features to facilitate the gripping of the collar to the pulp shell(s).

Figure 7D:
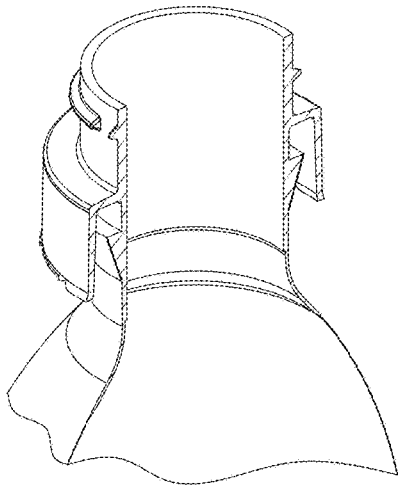

FIG. 7D shows a side on cutaway view of the liner-collar tandem of FIGS. 7A-7C.

Figure 7E:
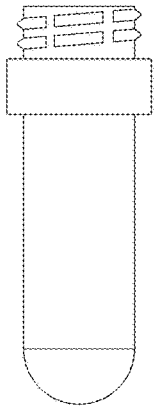
Figure 7F:
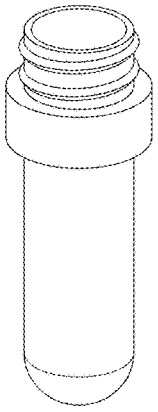

FIGS. 7E-7F show side views of liner-collar tandems in an injection molded state similar to the ones shown in FIGS. 7A-7D, where these are in an expanded state with a secondary blow molded process. This system can accept liners with diameters less that the orifice of the corresponding shell, or can incorporate liners that that are expanded to a cross-sectional diameter that is greater than the orifice of the corresponding shell.

Figure 8A:
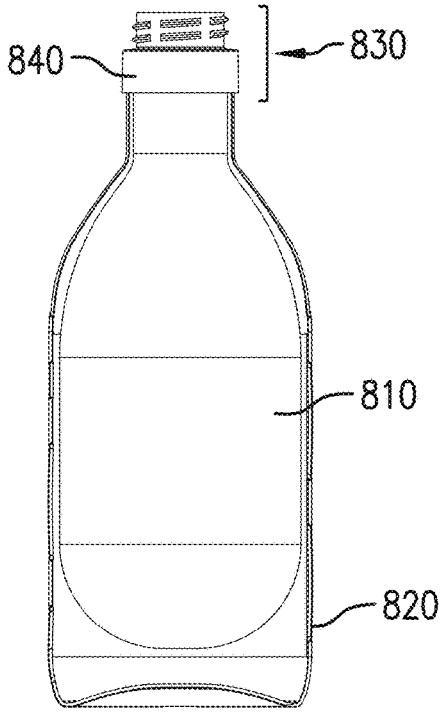
FIGS. 8A and 8B illustrate side cutaway views of a collared liner in its expanded state being inserted into and connected with a pulp-molded shell, in accordance with an embodiment.

FIG. 8A provides an illustration of a multi-part container. In some embodiments, a liner 810 may be housed inside of a pulp-molded shell 820. The pulp-molded shell may be constructed around the liner as a secondary step after the individual piece or pieces of the pulp-molded shell, or of multiple molded pulp shells being joined. have been created. In other embodiments, a preformed liner may first be inserted into a pulp-molded shell and then be expanded.

The liner may have components 830 that extend beyond the area enclosed by the pulp-molded shell. In some embodiments, this liner extension may itself comprise a collar 840. The collar may be integrally formed on the liner. In other embodiments, this collar is a separate distinct article that may be fit over the liner extension protruding from the pulp-molded shell. The collar may allow the liner to be secured to the pulp-molded shell. The collar may grip the shell relative to the liner in a manner similar to that described herein above.

Figure 8B:
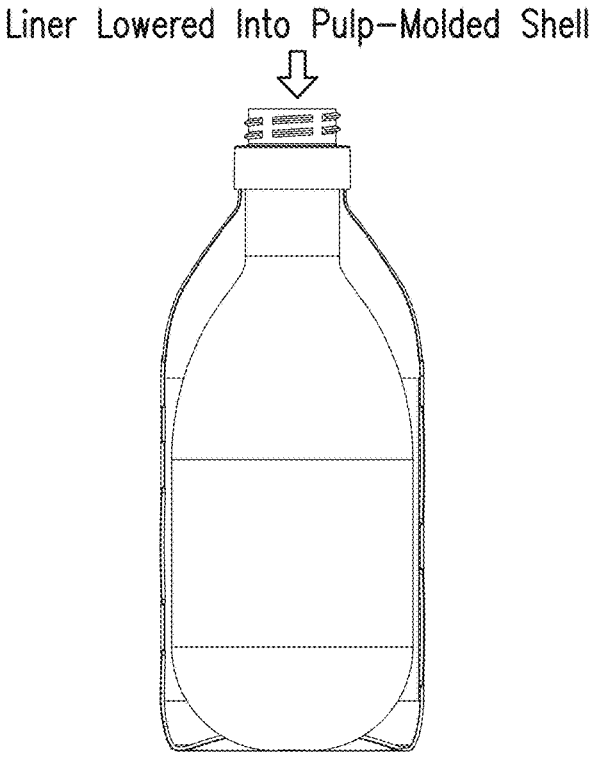

FIG. 8B depicts how the liner-collar tandem may be attached to the pulp-molded shell of FIG. 8A. In some embodiments, the collar and liner may be inserted over one or more edges of the pulp-molded shell, and may provide a pressure against or grip to the pulp-molded shell. In some embodiments, two or more of the components of the multi-part container (e.g., the pulp-molded shell and the liner) are attached with one or more adhesives.

Figure 9A:
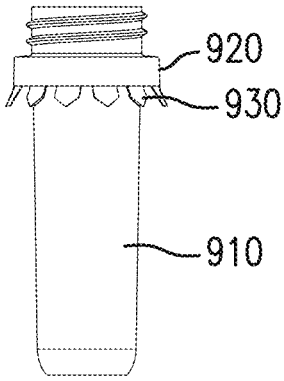
FIGS. 9A, 9B, and 9C, illustrate an example method for constructing a multi-part container, in accordance with an embodiment.
Figure 9B:
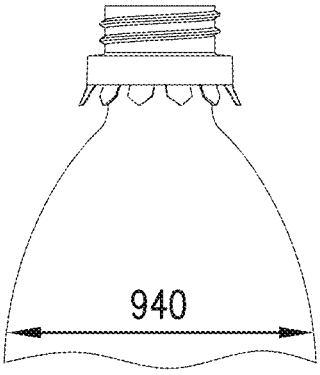
Figure 9C:
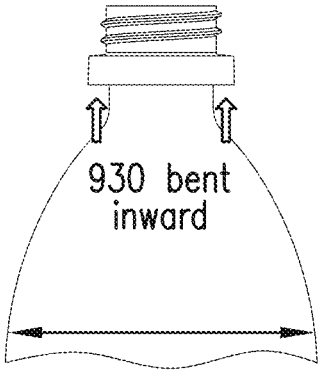

FIGS. 9A-9C depict a possible method for constructing a multi-part container. FIG. 9A depicts a preform comprising a liner 910 and collar 920 with outward-protruding barbs 930. The preform liner may initially be small enough to insert through a neck of a shell. The liner may be inserted into the shell. The shell may optionally enter an interior region of the collar, between an inner surface of the collar and the liner. FIG. 9B depicts the preform liner after the lower portion of the preform has been blow molded and expanded to a greater diameter 940. In other embodiments, other portions of the liner-collar tandem may be modified following the initial preform. The barbs may be inverted so as to point inward toward the liner, yielding the article depicted in FIG. 9C. In some embodiments, this article is then inserted into a pulp-molded shell. For example, the pulp-molded shell may be created to surround a portion of the liner-collar tandem, or the liner-collar tandem may be loaded into a pulp-molded shell via an opening that is subsequently closed. In other embodiments, the liner-collar tandem may be inserted into the pulp-molded shell prior to blow molding.

Figure 9D:
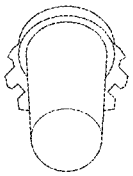
FIGS. 9D and 9E illustrate example preform and post-barb-inversion structures, in accordance with an embodiment.
Figure 9E:
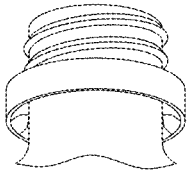

FIG. 9D and FIG. 9E show possible preform and post-barb-inversion structures, respectively. This illustrates how the protruding barbs may initially be in an open position (FIG. 9D), which will allow a shell to be inserted into a inner region between an inner surface of the collar, and the underlying liner. When the shell has been inserted, the barbs may then be folded inwards to grip the shell that is positioned therein (FIG. 9E). The barbs may be folded simultaneously or sequentially. The barbs may be folded with aid of a device or automated machine, or manually. The barbs may be folded at more than a 90 degree angle so that the pointed protrusions are angled upwards into the interior region of the collar. In an alternate embodiment, the barbs may be prefolded to the inside of the collar and then the shell inserted into the inner space of the collar and the barbs retain the shell.

Figure 10:
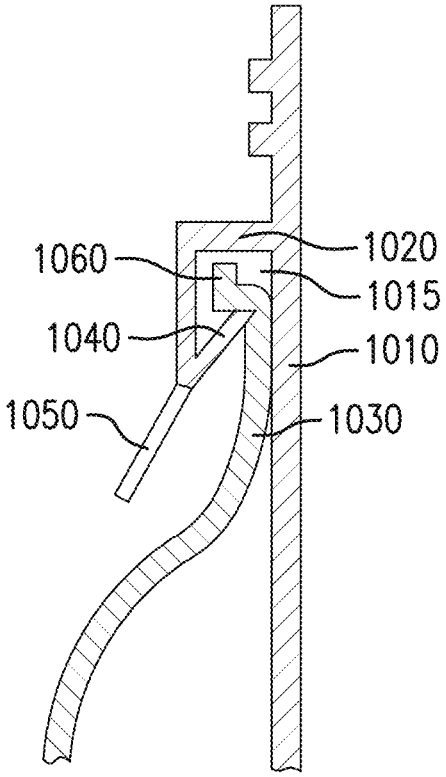
FIG. 10 illustrates a partial schematic side cutaway view of a pulp shell interlocking with a barbed collar, in accordance with an embodiment.

FIG. 10 shows an example of an injection molded preform 1010 with a collar 1020 that is in contact with a pulp-molded shell 1030. The collar may overlap at least a portion of the underlying preform. The collar may allow the creation of an inner-space 1015. In some embodiments, the injection molded preform may be a collar or a liner with a collar. In some embodiments, the liner, collar, or liner-collar tandem may have protrusions 1040 such as barbs which may be capable of being inverted between separate positions. For instance, the protrusions may move from an outer position 1050 to an inner position 1040. In some embodiments, the inner position may be at more than a 90 degree angle relative to a surface of the collar. The protrusions may be angled upwards and inwards. In some embodiments, the pulp-molded shell may have engagement features 1060 that contact the protrusions when said protrusions are in one or more of their possible positions. In some embodiments, the protrusion features are barbs and an engagement feature 1060 in the pulp shell engages with a secure mechanical connection to the internal collar position of the barb-enhancing the retention force with which the collar is secured to the shell compared to the pulp edge without an engagement feature 1060. This engagement feature 1060 can be annular where there is no particular angular orientation required between the collar and shell. In another embodiment, there are numerous engagement features 1060 and the installation of the collar to the shell is coordinated with the positioning of the barb features of the collar with the engagement features of the shell. For example, there may be a barb feature, where installation of the shell to the collar requires, and avoidance of the barb upon installation, and then a relative axial rotation between the shell and collar engages the barb 1040 with the engagement feature 1060. This contact may secure the pulp-molded shell to the liner, collar, or liner-collar tandem. In some embodiments, the protrusions may be manually repositioned prior to contact or attachment to a pulp-molded shell.

Figure 11A:
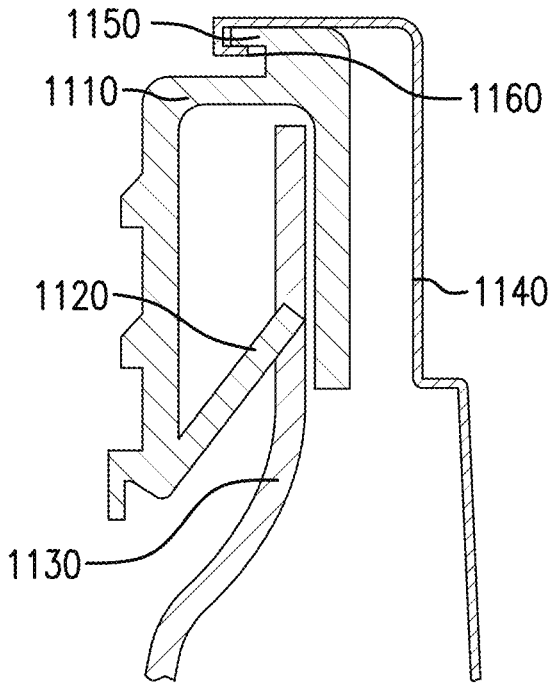
FIGS. 11A and 11B illustrate partial schematic side cutaway views of a collar that is simultaneously clasped onto a shell and a liner, in accordance with an embodiment.

FIG. 11A illustrates a multi-part container that comprises a collar 1110 that contains inward pointing barbs 1120 in contact with a pulp-molded shell 1130 and a liner 1140. In some embodiments, the pulp-molded shell is secured to the collar. This may be achieved by pressure exerted by the collar's inward pointing barbs or by other means. In some embodiments, the liner is secured to the collar. This may be achieved by interlocking or overlapping features 1150, 1160 on the collar and liner, respectively, or by other means.

Figure 11B:
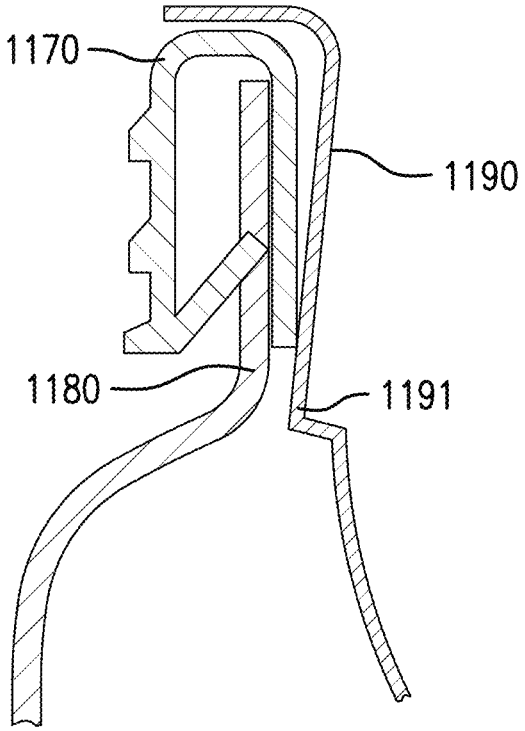

FIG. 11B illustrates an alternative embodiment of the invention, in which a collar 1170 is in contact with a pulp-molded shell 1180 and a liner 1190. In some embodiments, the liner is secured within the collar by an outward curvature 1191 of the liner that is wider than the narrowest internal portion of the collar.

Figure 12A:
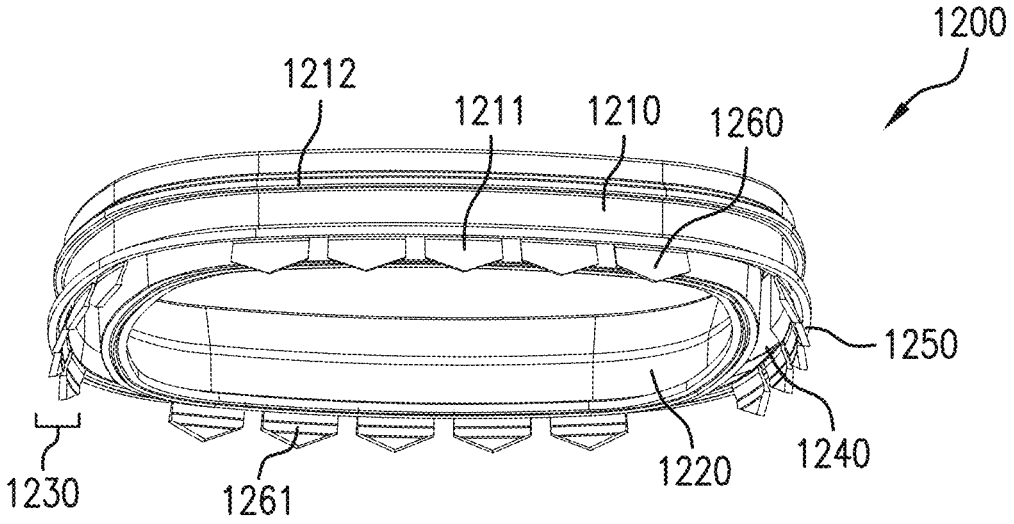
FIGS. 12A, 12B, 12C, 12D, and 12E, illustrate various views of an example of a collar with barbs, in accordance with an embodiment.

FIG. 12A illustrates an example of a collar 1200 for the container. The collar may have any number of shapes, including the elliptical shape depicted in FIG. 12A, and may have one or more surfaces, including outer-facing 1210 and inner-facing 1220 surfaces. These surfaces may have any number of features, including lips 1211 and bands 1212. In some embodiments, the collar may have one or more concavities 1230 that define features such as grooves or inner spaces. These concavities may themselves comprise arrays of features, such as inner 1240 and outer 1250 lips. In some embodiments the collar may contain protrusions 1260 such as barbs. In some embodiments, one or more protrusions may be capable of adopting two or more positions, as described herein above. The protrusions may have one or more features 1261 such as creases that may facilitate this repositioning. In some embodiments, protrusions lacking movement-facilitating features such as creases may be capable of being repositioned.

Figure 12B:
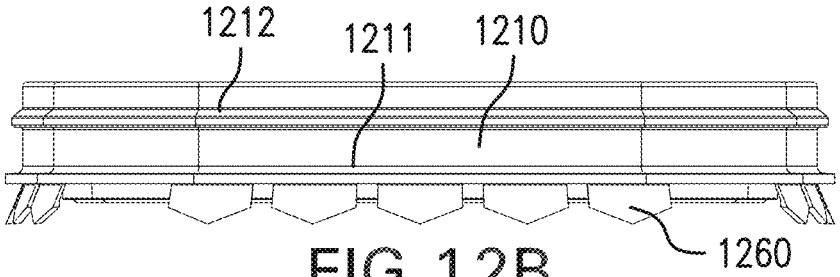

FIG. 12B provides a side view of the collar depicted in FIG. 12A.

Figure 12C:
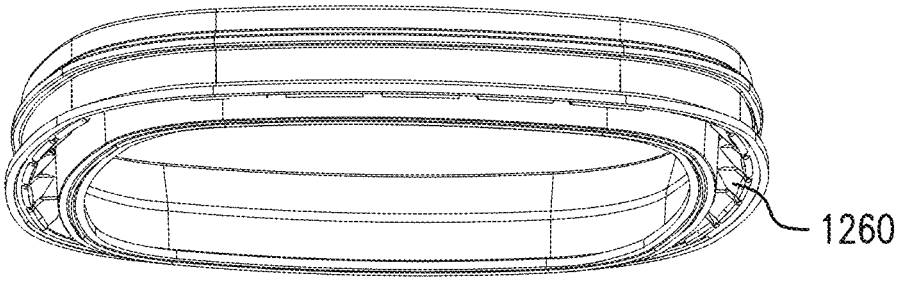
Figure 12D:
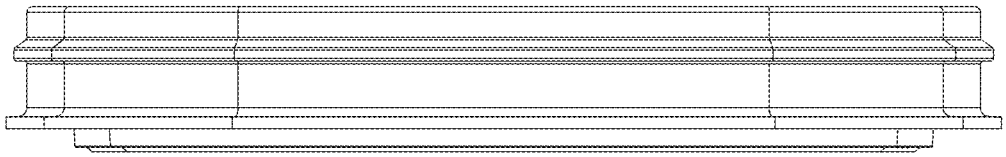

FIGS. 12C-12D illustrate the collar from FIGS. 12A-12B with its protrusions 1260 bent in towards its center and contained within an inner space of the collar. In some embodiments, all of the protrusions may be repositioned between two or more positions. In some embodiments, only some of the protrusions may be repositioned between the two or more positions. In some embodiments, other elements of the collar may be reshaped, repositioned, twisted, or bent.

Figure 12E:
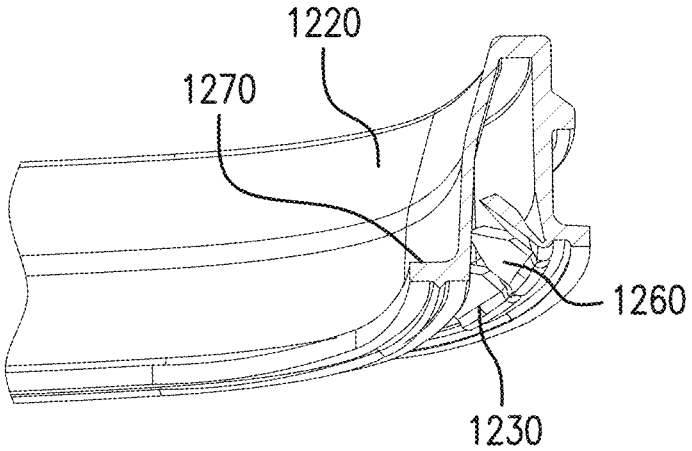

FIG. 12E illustrates a cutaway view the collar from FIGS. 12A-12D with protrusions 1260 positioned inside of an inner space 1230. In some embodiments, the collar may have lips 1270.

In any of the embodiments described herein, the features that may engage with the shell, such as protrusions or barbs that may pierce or deform the shell, may also prevent the collar from rotating relative to the shell. In some embodiments, an antirotational effect may be provided. The collar may be able to withstand rotational force without slipping or moving in either direction (e.g., clockwise and counter clockwise). In some instances, the collar may be able to withstand the same degree of rotational force equally in both directions. In some instances, the collar may be able to withstand a greater rotational force in a first direction as opposed to a second direction. In some instances, the collar may be able to withstand a greater rotational force vs an axial force (e.g., pulling the collar up from the neck). Alternatively, the collar may withstand the same amount of rotational and axial force, or greater axial force than rotational force. In some instances, the collar may be able to withstand a rotational force (e.g., torque) of at least 0.1 Nm, 0.5 Nm, 1 Nm, 1.5 Nm, 2 Nm, 2.5 Nm, 3 Nm, 4 Nm, 5 Nm, 7 Nm, 10 Nm, 15 Nm, 20 Nm or more. The collar may be able to withstand such force without slipping or moving relative to the shell by relying on the above noted features, such as the protrusions (e.g., without requiring adhesive, welding, soldering, or any other type of non-mechanical attachment).

Figure 13A:
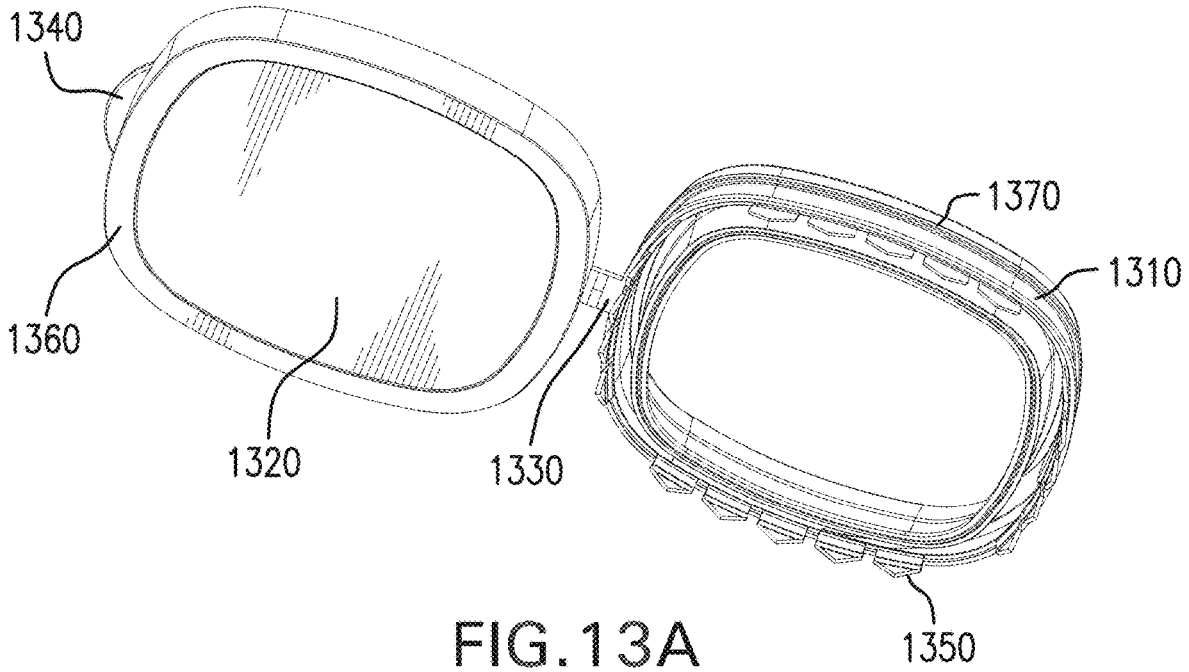
FIGS. 13A, 13B, 13C, 13D, and 13E, illustrate various views of an example of a collar that is attached to a closure, in accordance with an embodiment.

FIG. 13A shows an example of a collar 1310 and a closure 1320. In some embodiments, a collar may be directly connected to a closure, or may be connected to a closure by one or more connecting elements 1330, for example by tabs or linkers or a flexible hinge. These connecting elements may be made of any number of materials which may be the same as or different than the materials comprising the collar or closure.

Collars and closures may have any number of distinct structural features. For example, the closure may have one or more tabs 1340 that may provide a surface for gripping, or the collar may have features such as protrusions or barbs 1350 that facilitate its attachment to another element, such as a pulp-molded shell. In some embodiments, the collar and closure may have features that affect the ways in which the collar and closure can contact or connect. For example, the closure may have a raised region 1360 on atop outer surface that can be designed to accommodate a portion of the collar, or the collar may have rims 1370 on one or more of its surfaces that aid in securing the closure to the collar. In some embodiments, the collar and/or closure may have multiple regions with different thicknesses and/or mechanical properties, which may help facilitate attachment and/or detachment of the collar and closure. For example, a closure may have thin walls that are capable of bending when said closure is being fit over a collar.

Figure 13B:
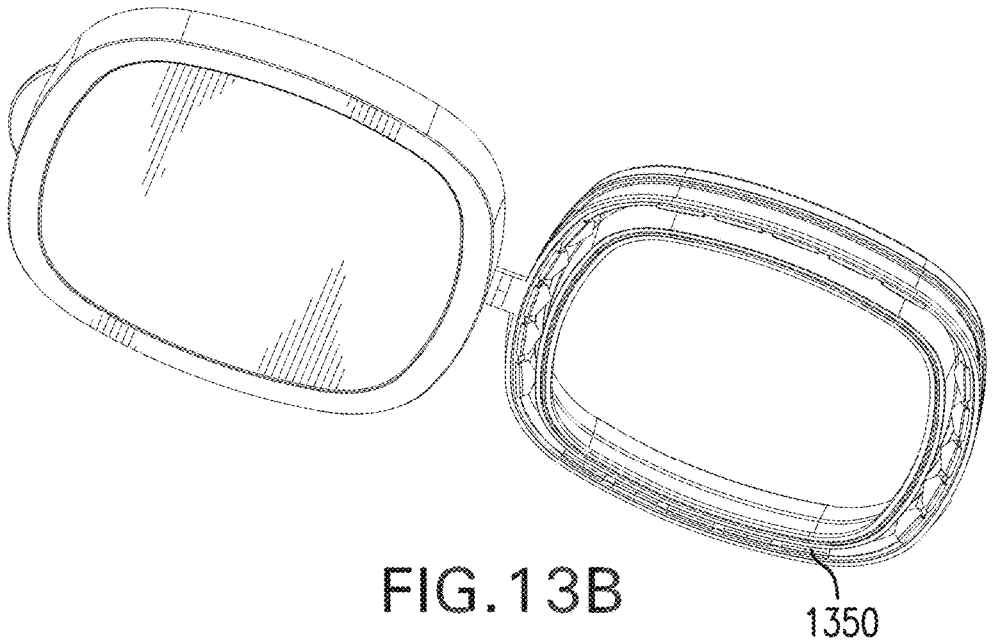

FIG. 13B shows the collar and closure of FIG. 13A, wherein the protrusions, barbs 1350 of the collar have been repositioned within an inner space of the collar. In some embodiments, the repositioning of the protrusions, barbs may be achieved by purely mechanical means. In some embodiments, the repositioning of the protrusions, barbs may be achieved by other means, such as heating, cooling, chemically treating, irradiating, sonicating or in some other way affecting a collar or other element of a container.

Figure 13C:
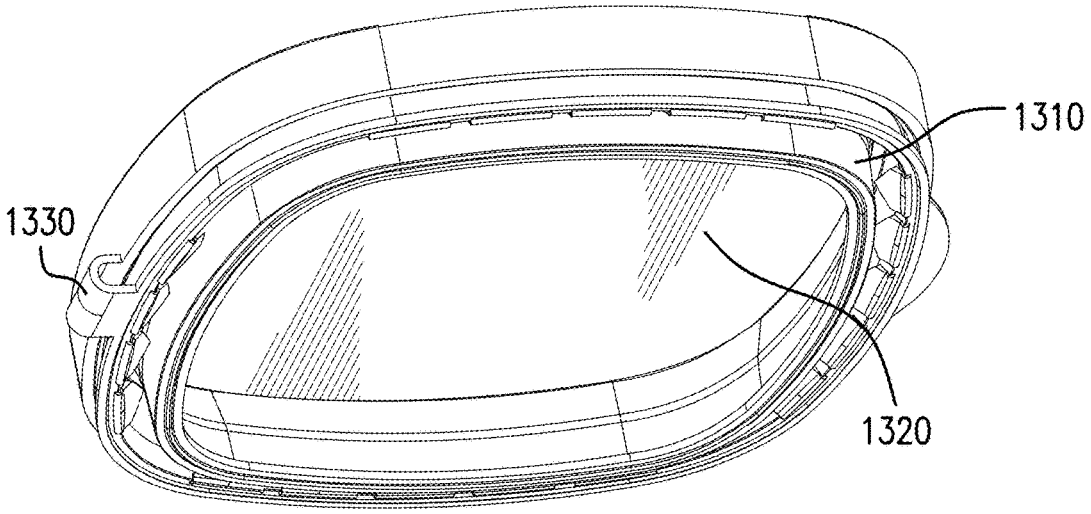
Figure 13D:
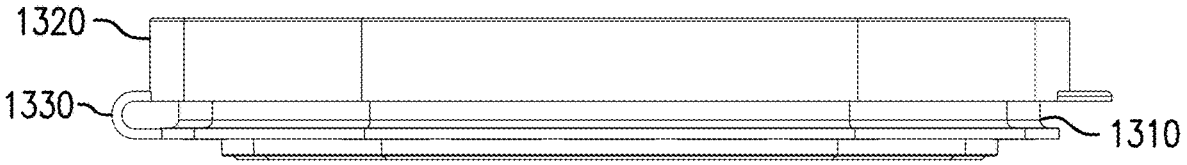

FIGS. 13C-13D show the collar and closure of FIGS. 13A-13B, wherein the collar 1310 and closure 1320 have been repositioned so that the closure is covering the collar. In some embodiments, a closure may be capable of attaching to a collar. In some embodiments, the closure may contact the collar without forming an attachment. When present, the connecting element or elements 1330 may be capable of bending, twisting, rotating or distorting in any number of other ways. In some embodiments, multiple connecting elements provide one or more mechanisms for controlling the movement of a collar relative to a closure. For example, the connecting element may be a hinge that limits the range of motion of the closure relative to the collar.

Figure 13E:
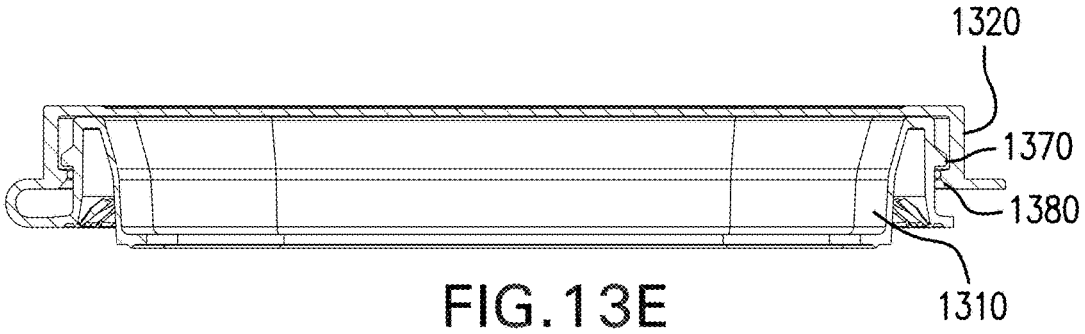

FIG. 13E illustrates a side cutaway view of the collar 1310 and closure 1320 of FIGS. 13A-13D, and shows one of many possible designs which may facilitate attachment of the collar and closure. In some embodiments, the collar and closure may have respective protrusions 1370 and 1380 on one or more of their surfaces that may aid in their attachment and may provide resistance against the collar and closure being spatially separated. In some embodiments, a collar and a closure may have different dimensions, such as outer and inner diameters, which may aid in a closure covering and/or attaching to a collar. In some embodiments, a collar and closure may have a single orientation in which they are capable of forming an attachment. In other embodiments, a collar and closure may be capable of forming an attachment from two or more orientations. The closure may be connected to the collar. For instance, the closure may be connected via a hinge. Alternatively, the closure may be separate and separable from the collar. For instance, the closure may be a snap-fit cover that may completely separate from the collar.

Figure 14A:
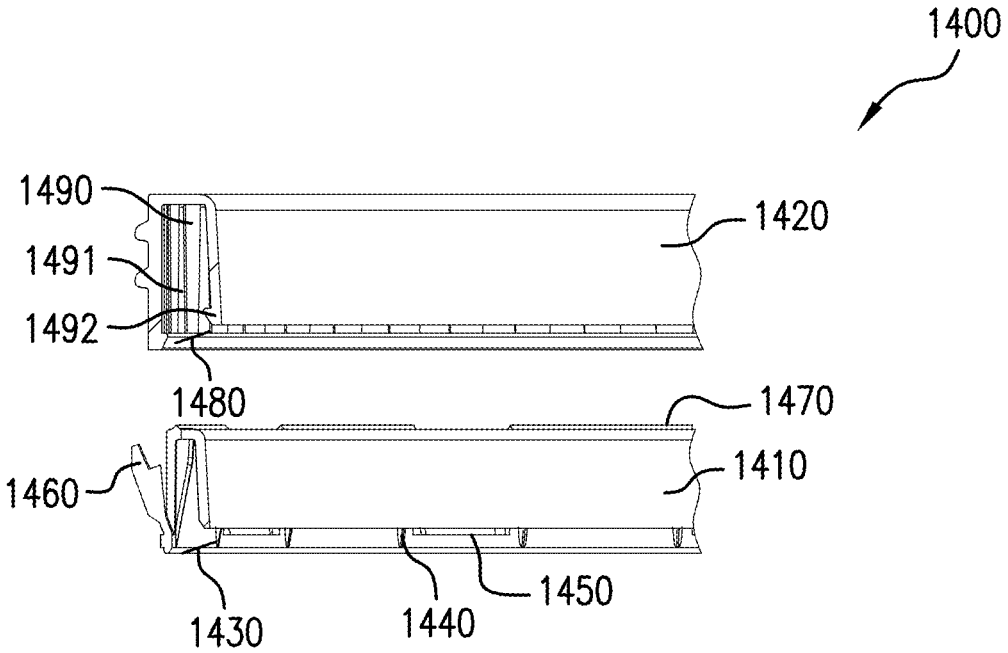
FIG. 14A illustrates a side view of a two collar system, in accordance with an embodiment.

FIG. 14A shows an example of a two collar system 1400, wherein a first collar 1410 and a second collar 1420 may have complimentary structural features which may allow the collars to become attached. In some embodiments, a collar may have one or more concave features which may define inner-spaces 1430 comprising one or more inner-surfaces. Inner-surfaces may contain protrusions 1440, concavities 1450, openings or other structural features. The first collar may also have features on its outer-surface or surfaces such as tabs 1460 or ridges 1470. In some embodiments, these features may affect the attachment of the second collar or other container element such as a closure. For example, protrusions on a collar outer surface may strengthen or weaken the attachment of a closure to the collar.

In some embodiments, the second collar may also have concavities which may define inner spaces 1480 comprising one or more inner-surfaces, and may have structural features on any of its surfaces, such as protrusions 1490, concavities 1491 or lips 1492. In some embodiments, these features may allow the second collar to nest against, attach to, stack against, clip onto, or in any other way associate with the first collar. In some embodiments, one or more features on the first or second collar may prevent two collars from attaching or associating.

Figure 14B:
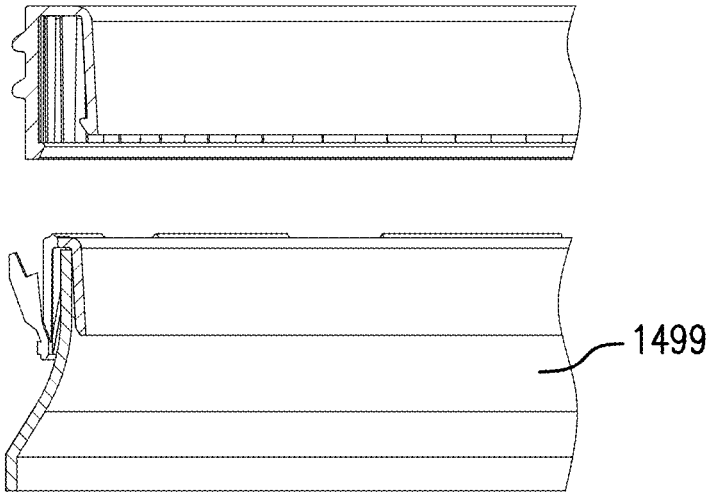
FIG. 14B illustrates a partial side view of the two collar system of FIG. 14A wherein one collar is mounted on a pulp-molded shell, in accordance with an embodiment.

FIG. 14B illustrates the two collar system of FIG. 14A with the second collar 1420 nested with the first collar 1410, and the first collar 1410 contacting a pulp-molded shell 1499.

Figure 15A:
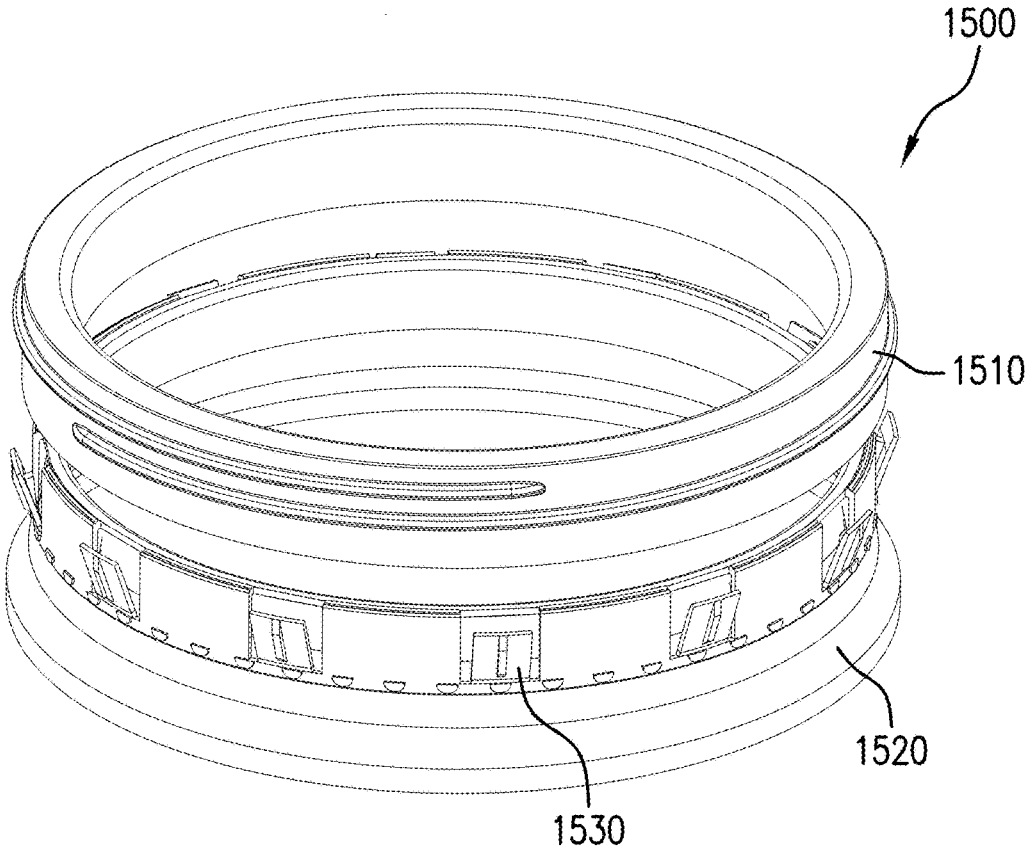
FIG. 15A illustrates two collar parts which may be assembled to form a single collar, in accordance with an embodiment.

FIG. 15A illustrates another example of a two collar system 1500 having a first collar 1510 and a second collar 1520 that may be assembled into a single collar 1500. In some embodiments, a collar may be assembled from two, three, four, five or more parts. In some embodiments, one or more of the parts may comprise features 1530 such as barbs that aid in creating attachments to other parts. In some embodiments, these features may be capable adopting multiple positions. For example, the second collar 1520 may have barbs 1530 that are molded in a first position and then locked into a second position when the second collar 1520 is connected with the first collar 1510, and the barbs 1530 engage with complementary features on an inner space of the first collar 1510.

Figure 15B:
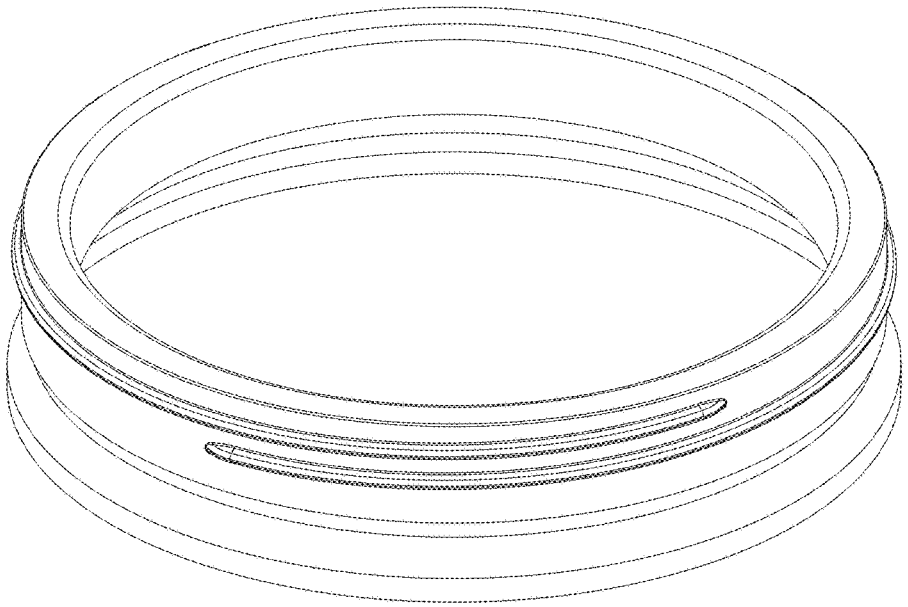
FIG. 15B illustrates the collar parts from FIG. 15A assembled to form a single collar, in accordance with an embodiment.

FIG. 15B illustrates the collar components of FIG. 15A assembled into a single collar 1500.

Figure 16:
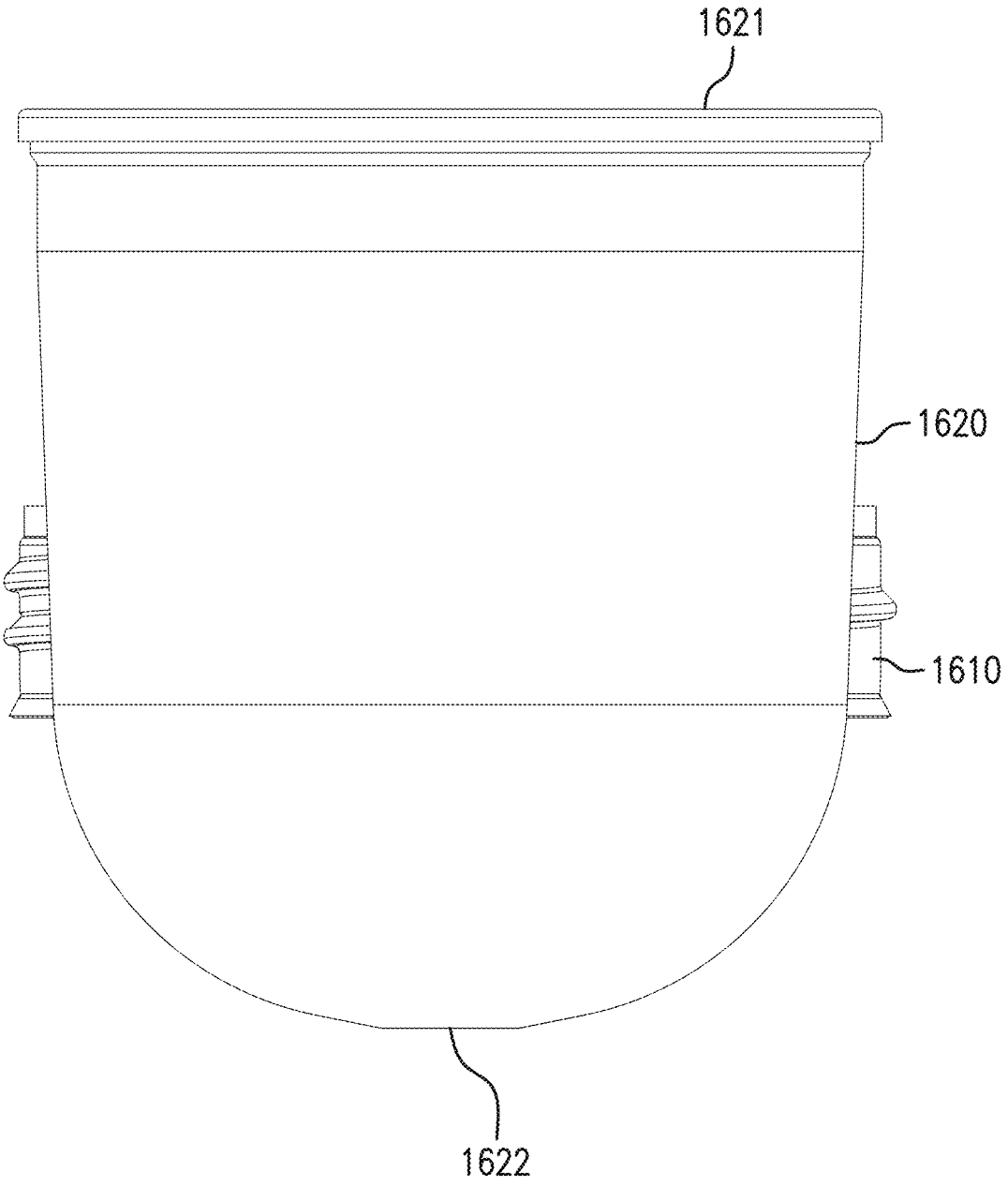
FIG. 16 illustrates a collar attached around a mid-portion of a liner, in accordance with an embodiment.

FIG. 16 illustrates a side cutaway view of a collar 1610 contacting a middle portion of a liner 1620 between its top 1621 and bottom 1622 ends. In some embodiments a collar may be attached to a middle portion of a liner. A collar may be attached to a smooth or textured portion of a liner by a wide range of means, including adhesive, piercing or crimping. The means of attachment may or may not deform the collar and/or liner.

Figure 17A:
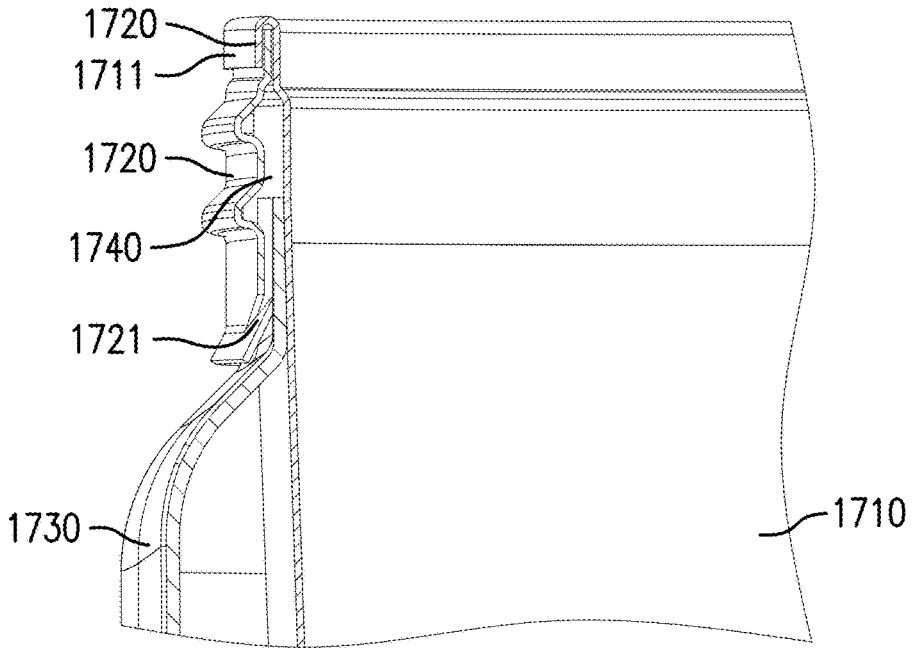
FIG. 17A illustrates a partial side cutaway view of a container comprising a liner, collar, and pulp-molded shell, in accordance with an embodiment.

FIG. 17A illustrates a side cutaway view of a portion of a container comprising a liner 1710, a collar 1720, and a pulp-molded shell 1730. The liner may have features 1711 such as grooves that may overlap an edge, surface or other portion of the collar. In some embodiments, these features may facilitate attachment of the liner to the collar.

In some embodiments, surfaces of the collar and liner may define an inner space 1740. This inner space may accommodate all or portions 1721 of one or more pulp-molded shells, as well as liner and/or collar features. For example, the collar may have barbs that point inwards toward the liner, which may be capable of contacting, deforming or piercing the pulp-molded shell and/or the liner, as described herein above. In some embodiments, collar and/or liner features may be formed during or after assembly of the collar or liner. For example, the partial removal of a pulp-molded shell from an inner space 1740 between a collar and liner may partially detach portions of the collar, thereby forming protrusions of the collar into said inner space.

Figure 17B:
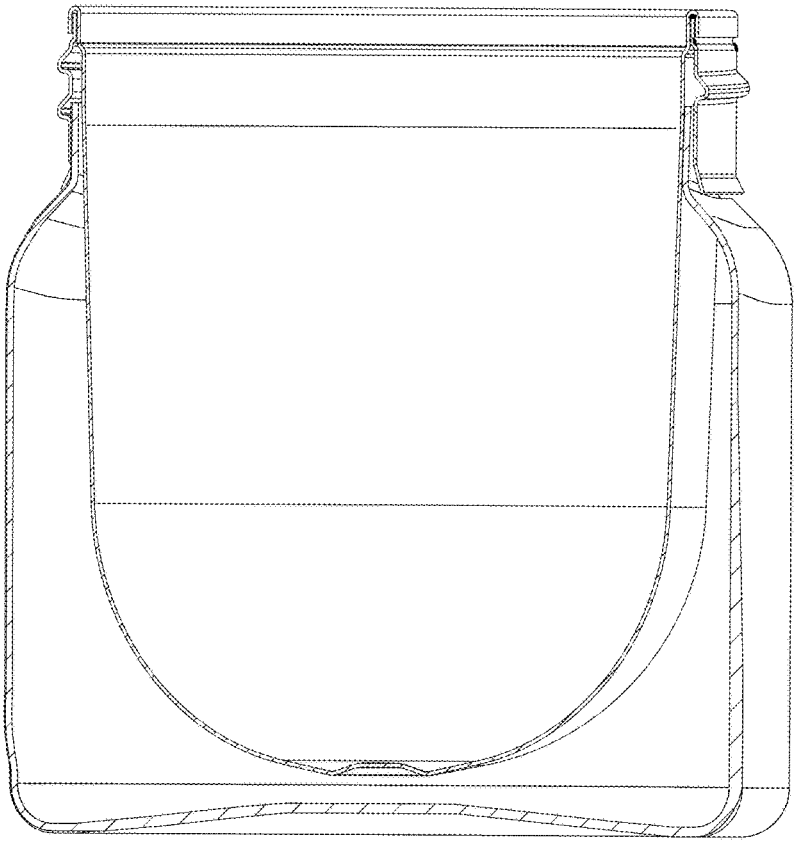
FIG. 17B illustrates a side cutaway view of the container shown in FIG. 17A, in accordance with an embodiment.

FIG. 17B illustrates a side cutaway view of the full container partially depicted in FIG. 17A.

Figure 18A:
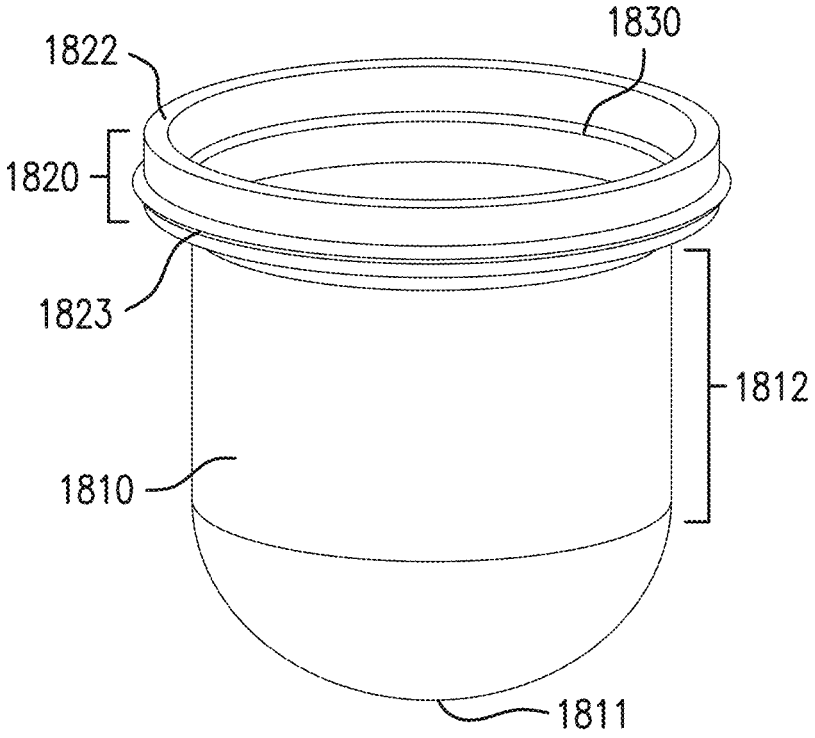
FIG. 18A illustrates an example collar with an integral liner, in accordance with an embodiment.

FIG. 18A illustrates an example of a liner 1810 with a collar 1820. The collar and liner may be integrated (i.e., provided as a single piece) or may be distinct and separate structures. The collar and liner may be integrally formed as a single piece. The collar and liner may be formed of the same material. The collar and liner may be formed of different material. The collar and liner may be molded to be formed together. The connection 1830 between the collar and liner may be smooth or may comprise a feature. The feature at the connection 1830 may inhibit the collar's movement relative to the liner. For example, the connection between the collar and liner may comprise a joint or groove that prevents the collar from bending outwards relative to an inner surface of the liner. The liner may comprise a curved or flat end 1811 and a cylindrical body 1812. The collar may be ring-shaped, and may comprise a flat, curved, or jagged upper surface 1822.

The collar may comprise a feature protruding from its outer surface 1823 (e.g., a rib or groove). The protruding feature can assist the collar in attaching to another piece, such as a closure. The protruding feature may also affect the collar's rigidity or pliability. For example, a rib or groove on the outer surface of the collar may provide resistance against structural deformations, including bends and twists.

Figure 18B:
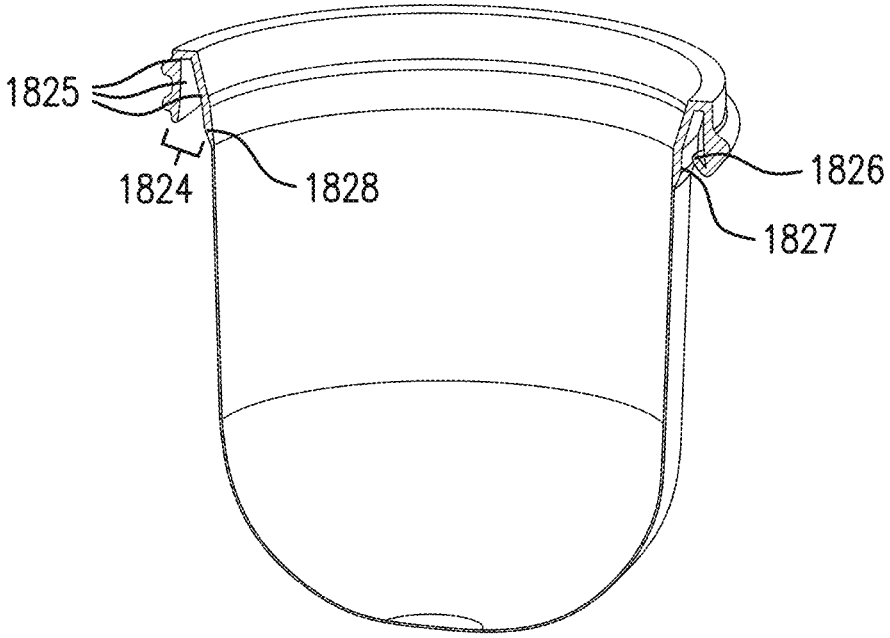
FIG. 18B illustrates a cross-sectional view of a collar with an integral liner, in accordance with an embodiment.

As is depicted in FIG. 18B, which provides a side view cross section of the liner and collar from FIG. 18A, the collar may comprise a concave architecture that defines an inner-space 1824 comprising one or more inner-surfaces 1825. The inner-space may comprise one or more features, such as protrusions 1826 or lips 1827. An inner-space feature may project toward the middle of the inner-space. The one or more features (e.g., protrusions 1826 or lips 1827) may extend outward from an inner one of the inner-surfaces 1825, or may extend inward from an outer one of the inner-surfaces 1825.

A plurality of inner surfaces 1825 may define an outer edge and an inner edge of the inner-space. One or more of these inner surfaces may be parallel with a wall of the liner (e.g., a surface of a cylindrical portion of the liner 1812). Two inner surfaces may be offset from parallel, and may thus impart a variable width upon the inner-space, which may aid in gripping an insert such as a pulp-molded shell.

The collar may comprise multiple regions with different thicknesses around the circumference of the collar. Furthermore, an individual segment of the collar 1828 may comprise multiple thicknesses. Such variable thicknesses may impart different degrees of rigidity to different portions of the collar. The collar may be thicker than the liner. The collar may also be formed from a different manufacturing process than the liner. For example, a structure may comprise an injection molded collar and a stretch blow molded liner. The rigidity of the collar may prevent deformation of the liner.

The thickness between portions of the collar and liner may vary. In some instances, the thickness may vary by at least 10%, 20%, 30%, 40%, 50%, 75%, 100% or 200%, with the collar being thicker than the liner.

Figure 18C:
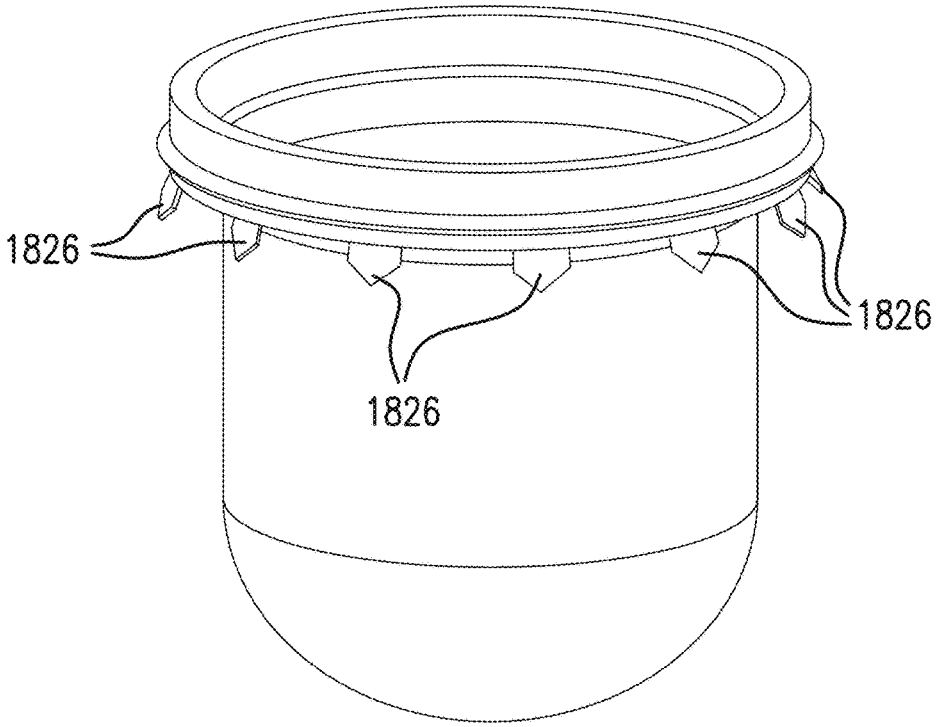
FIG. 18C illustrates a collar with an integral liner with protrusions projecting out, in accordance with an embodiment.
Figure 18D:
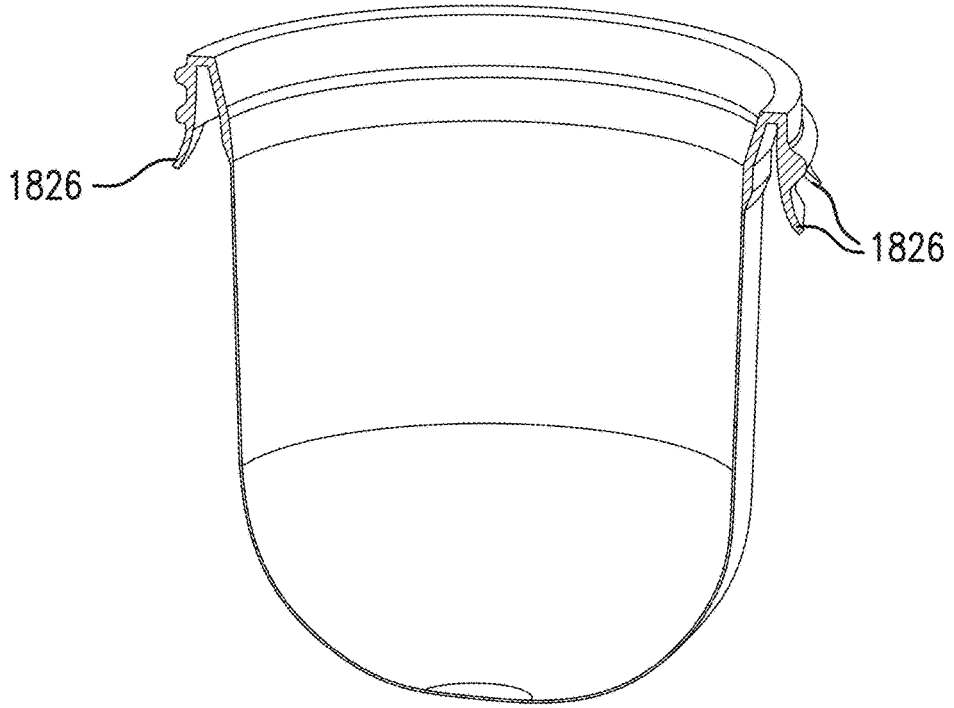
FIG. 18D illustrates a cross-sectional view of the collar with an integral liner with protrusions projecting out of FIG. 18C, in accordance with an embodiment.

An inner-space feature of the collar, such as a protrusion or barbs, may be capable of adopting a second position outside of the inner-space. FIG. 18C shows the liner and collar of FIGS. 18A and 18B, wherein a set of protrusions, such as barbs, 1826 have been repositioned from the collar inner-space to new positions outside of and projecting away from the collar inner-space. An inner-space feature may interconvert between positions upon insertion of a structure (e.g., a pulp-molded shell) into the inner-space of the collar. An inner-space feature may lock into place once it is positioned within the collar inner-space. The locking may be reversible. FIG. 18D provides a side view cross-section of the collar and liner of FIGS. 18A-18C, with protrusions 1826 positioned outside of the collar inner-space.

Figure 18E:
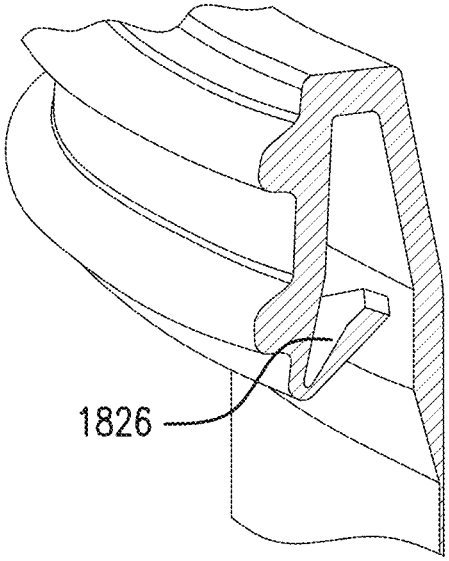
FIGS. 18E and 18F illustrate example close-up partial section views of a collar with a liner, in accordance with an embodiment.
Figure 18F:
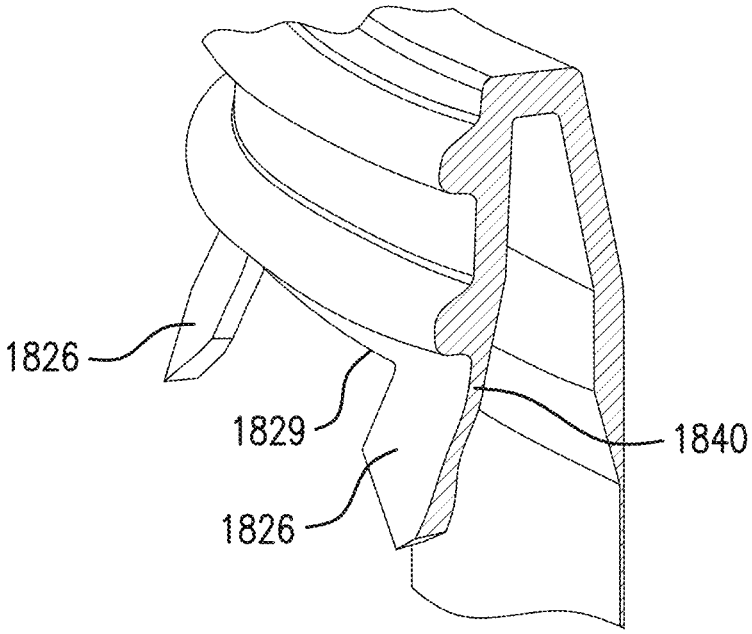

FIGS. 18E and 18F provide close up, side view cross sections of the collar and liner of FIGS. 18A-18D. FIG. 18E depicts the collar with protrusions 1826 positioned within its inner-space, while FIG. 18F depicts the collar with protrusions 1826 positioned outside of its inner-space. An inner-space feature may be attached to a surface that is outside of the inner-space, for example the bottom surface of an outer wall 1829 of the collar. The structure connecting the inner-space feature to the collar may be malleable, thereby imparting mobility to the inner-space feature at its point of attachment 1840 to the collar.

Figure 19A:
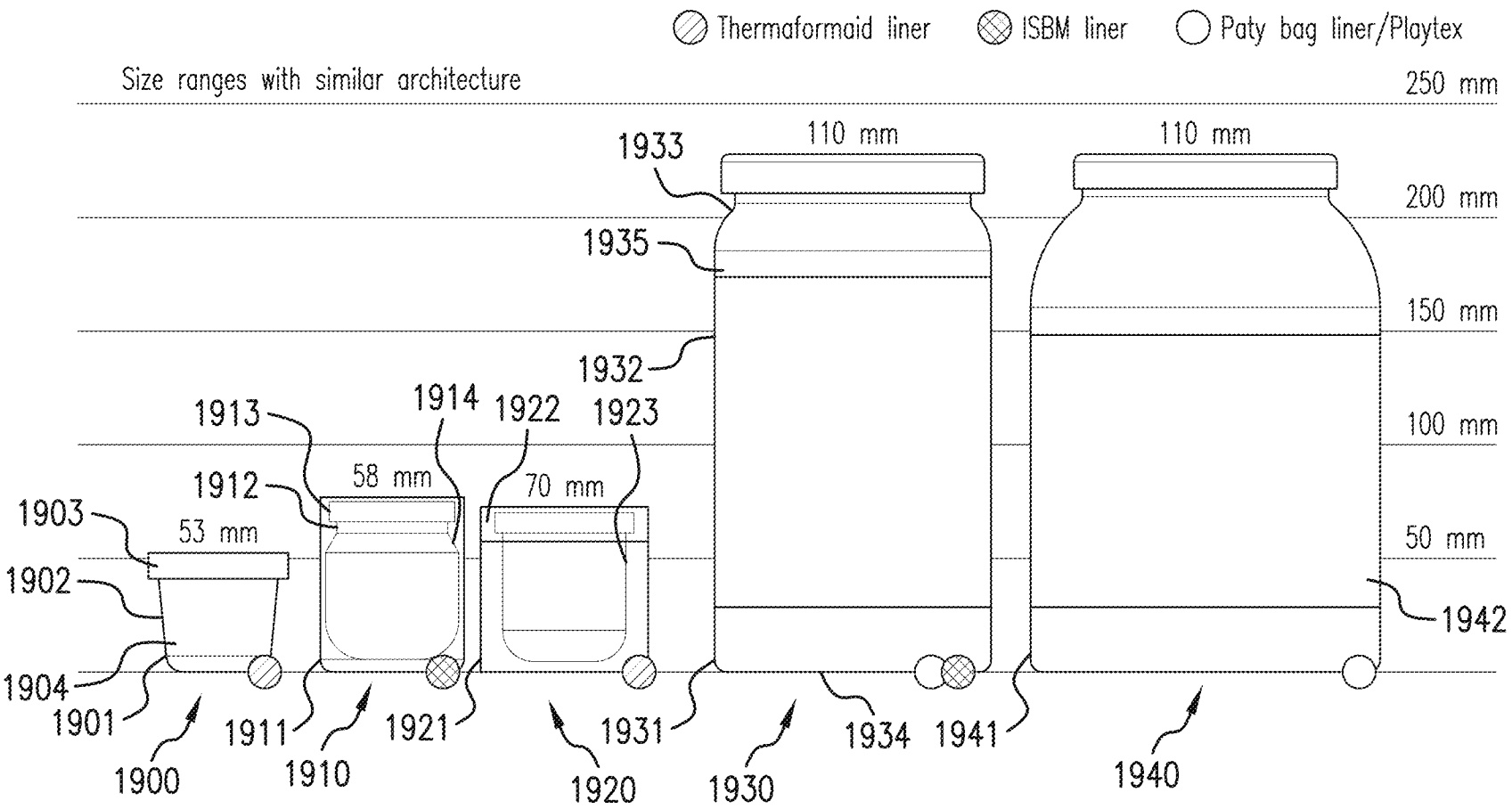
FIGS. 19A and 19B illustrate example side views of multiple containers, in accordance with an embodiment.

FIG. 19A provides side cutaway views for multiple containers 1900, 1910, 1920, 1930, & 1940 with pulp-molded shells 1901, 1911, 1921, 1931, & 1941. The pulp-molded shells can have a wide range of shapes and sizes. A container may have a volume less than or equal to 1 $cm^3$, 5 $cm^3$, 10 $cm^3$, 20 $cm^3$, 30 $cm^3$, 40 $cm^3$, 50 $cm^3$, 75 $cm^3$, 100 $cm^3$, 500 $cm^3$, 1000 $cm^3$, 5000 $cm^3$, or 10,000 $cm^3$. A container may have a volume greater than any of these values or falling within a range between any two of these values. A pulp-molded shell can have a greater diameter than its height (e.g., 1920), a greater height than its diameter (e.g., 1930), or roughly equal height and diameter. A pulp-molded shell may have straight sides 1932 or sloping sides 1902. A pulp-molded shell may narrow at portions 1933, for example near a container's neck. The container's neck and/or collar may have the greatest diameter for the container. Alternatively, the container's neck and/or collar may be at the same diameter as the rest of the container, or may be smaller than a greatest diameter of the container. A pulp-molded shell may have divots 1934, bumps, or other surface features, which may allow the pulp-molded shell to connect with other objects, such as a second pulp-molded shell. The surface feature may also increase the strength of the pulp-molded shell, or may enable deformation (e.g., twisting or bending) along or around a surface feature axis.

A container may comprise a collar (e.g., 1903, 1912, 1922). The collar may connect with the pulp-molded shell. For example, the pulp-molded shell may insert into an inner-space within the collar. Connection with the collar may physically distort the pulp-molded shell 1913, which may provide resistance against detachment. Connection with the collar may cause a portion of the collar to pierce, grip, deform, or embed into the shell.

A container may comprise a liner 1904, 1914, 1923, 1935, 1942. The liner may comprise a rigid or semi-rigid portion with a defined shape (e.g., 1914, 1923). A liner may also comprise a pliable portion with an undefined shape (e.g., 1942). A liner may fill nearly all of the space within a pulp-molded shell (e.g., 1935 or 1942), or may fill only a portion of the space within a pulp-molded shell (e.g., 1923). For some containers, the liner 1923 is uniformly narrower than the pulp-molded shell 1921. A liner may comprise a thermoformed liner, an injection stretched blow molded (ISBM) liner, or a poly bag liner. The liner may be separate from the collar or may be integrally formed with the collar.

Figure 19B:
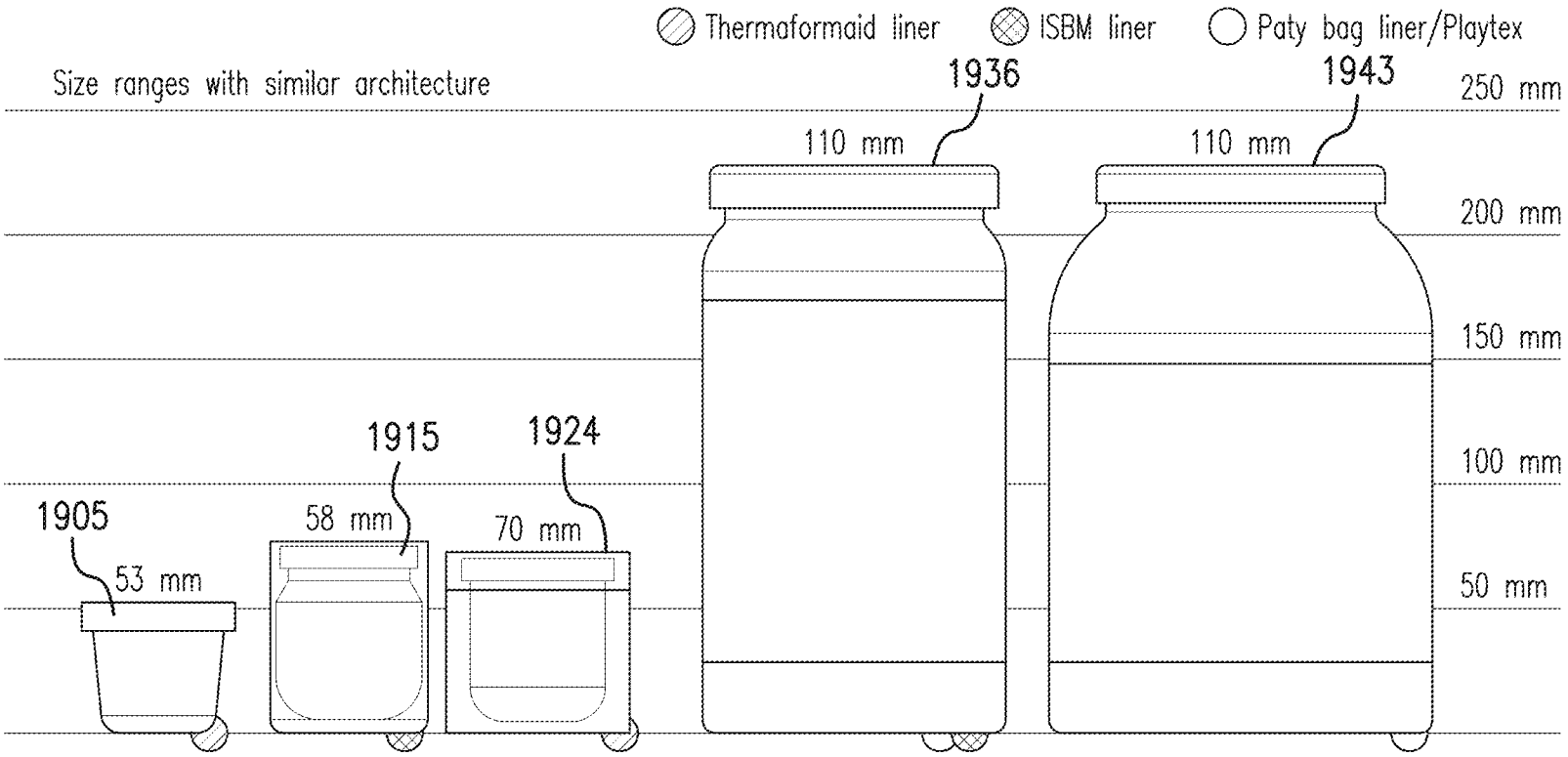

FIG. 19B provides solid-profile views of the containers from FIG. 19A. The five containers depicted have curved surfaces and roughly cylindrical or conical shapes. However, containers may assume a variety of shapes, including box, hexagonal, pentagonal, octagonal, pyramidal, oblong, and spherical. A container may comprise edges and curves.

Containers may comprise a closure 1905, 1915, 1924, 1936, 1943. The closure may comprise a narrower (e.g., 1943), wider, (e.g., 1905), or roughly equal overall outer width (e.g., 1915 and 1924) as the pulp-molded shell. The closures depicted in FIG. 19B have roughly circular profiles. However, a closure may comprise a variety of shapes, including circular, elliptical, and polygonal. A polygonal closure may comprise an edge or a curve in place of an edge.

A closure may be threaded relative to the collar, may be hinged, may be snapped on, may have interlocking features, or any other connection with the collar. The closure may or may not rotate relative to the collar when being attached to and/or separated from the collar.

Multiple components of a container (e.g., a liner, collar, and closure) may be fabricated by different processes, and may comprise different materials or identical materials. A liner, collar, and closure, or any combination thereof, may be fabricated as a single piece or as separate pieces. In some instances, two pieces (e.g., a collar and liner) are combined into a single piece, for example by ultrasonic welding.

Figure 20A:
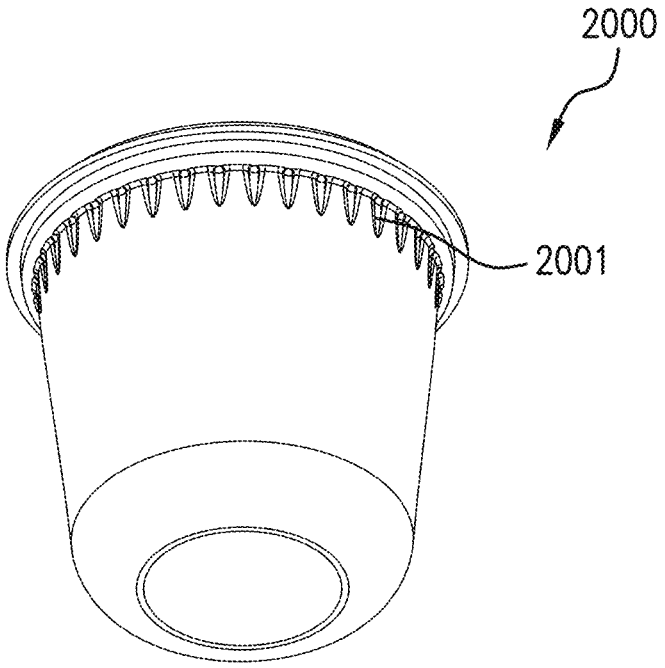
FIG. 20A illustrates an example of a shell with registration features, in accordance with an embodiment.

FIG. 20A illustrates a pulp-molded shell 2000 comprising a set of features 2001 (e.g., bumps or barbs) designed to interface with portions of a collar. The features may be registration features. The pulp-molded shell features may comprise indentations or protrusions, and may be on an outer or inner surface of the pulp-molded shell. The registration features may be located at or near a top of the shell. The registration features may be located at or near a neck of the shell. The registration features may be located within a region where a collar will engage with the shell.

Figure 20B:
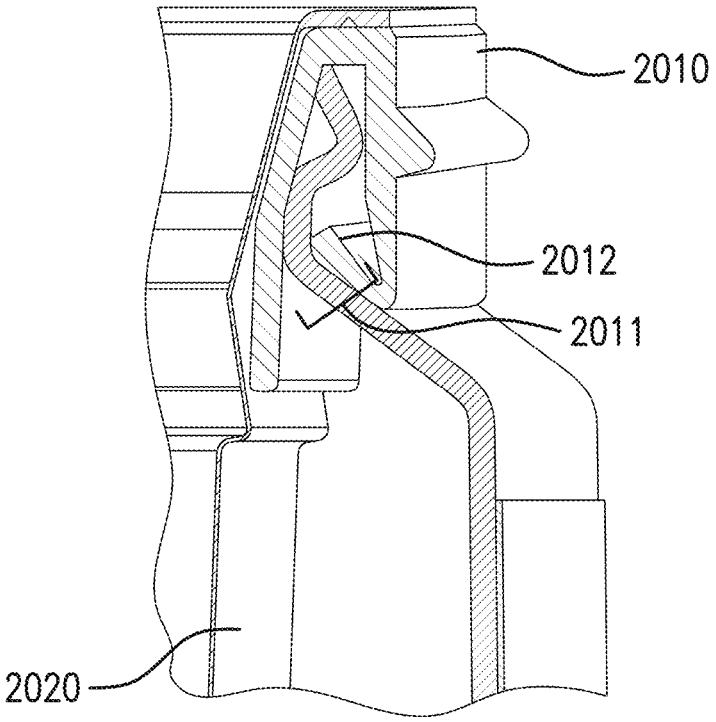
FIG. 20B illustrates a partial section close-up view of an example collar engaged with a shell with registration features, in accordance with an embodiment.

FIG. 20B illustrates the pulp-molded shell from FIG. 20A fastened to a collar 2010 and a liner 2020. The collar may utilize one or more mechanisms for gripping the pulp-molded shell. The collar may comprise an inner-space 2011 designed to accommodate a portion of the pulp-molded shell. The pulp-molded shell may or may not deform (e.g., bend) upon insertion into the collar inner space. The collar may comprise a feature 2012, such as a barb or protrusion, that interacts with the pulp-molded shell. The feature may overlap, insert into, pierce, or connect with a registration feature 2001 (see FIG. 20A) on the pulp-molded shell. In some instances, the collar features may naturally be positioned between one or more of the registration features. In some instances, the collar features may fall within one or more of the registration features. The registration features may aid in preventing rotation of a collar relative to the shell. The collar features, such as protrusions, may encounter edges of the registration features which may prevent rotation. The collar features may effectively interlock or engage with the registration features.

Figure 21:
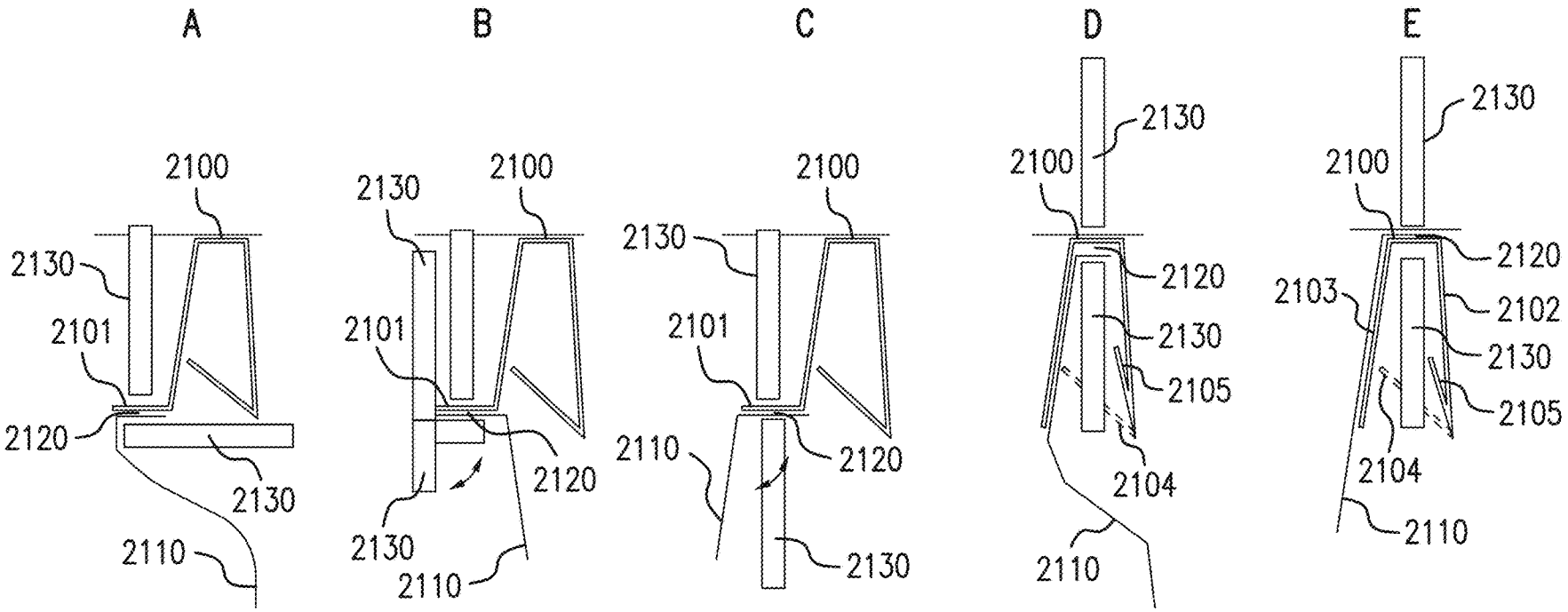
FIG. 21 illustrates examples of arrangements A, B, C, D, and E, for attaching a collar and liner, in accordance with an embodiment.

FIG. 21 illustrates multiple arrangements (panels A-E) for attaching a collar 2100 (with the outside edge of the collar depicted on the right side of each corresponding illustration) to a liner 2110. The liner may be attached to a lip 2101 of the collar, as is illustrated in panels A-C, inside of a collar inner-space, as is shown in panel D, on top of the collar, as is shown in panel E, or to an outer 2102 or inner 2103 edge of the collar. The attachment may include an adhesive or a weld 2120, which may be applied in spots (e.g., as a weld bead) or in lines. The welder may be an ultrasonic welder.

Different welder tip 2130 arrangements are shown in panels A-E of FIG. 21. The welder tips may be oriented to be perpendicular or angled (with respect to each other), as is shown in panels A and B. The welder tips may be oriented to be parallel or near parallel, as is shown in panels C-E. Welding may comprise inserting a welder tip into a collar inner-space, as is shown in panels D and E. In such cases, a feature such as a barb within the collar inner-space may be reoriented from its resting position 2104 to a second position 2105 in order to make space for the welder tip. Insertion of the welder tip into a collar inner-space may cause the feature to move to the second position. A feature may reposition from a second position back to its resting position upon removal of the welder tip.

The collar configurations as provided may advantageously provide a large degree of flexibility in engagement with the shells. For instance, the collar, liner, and shell connections may vary. This may allow pre-formed collars to be adapted to different container configurations.

Figure 22A:
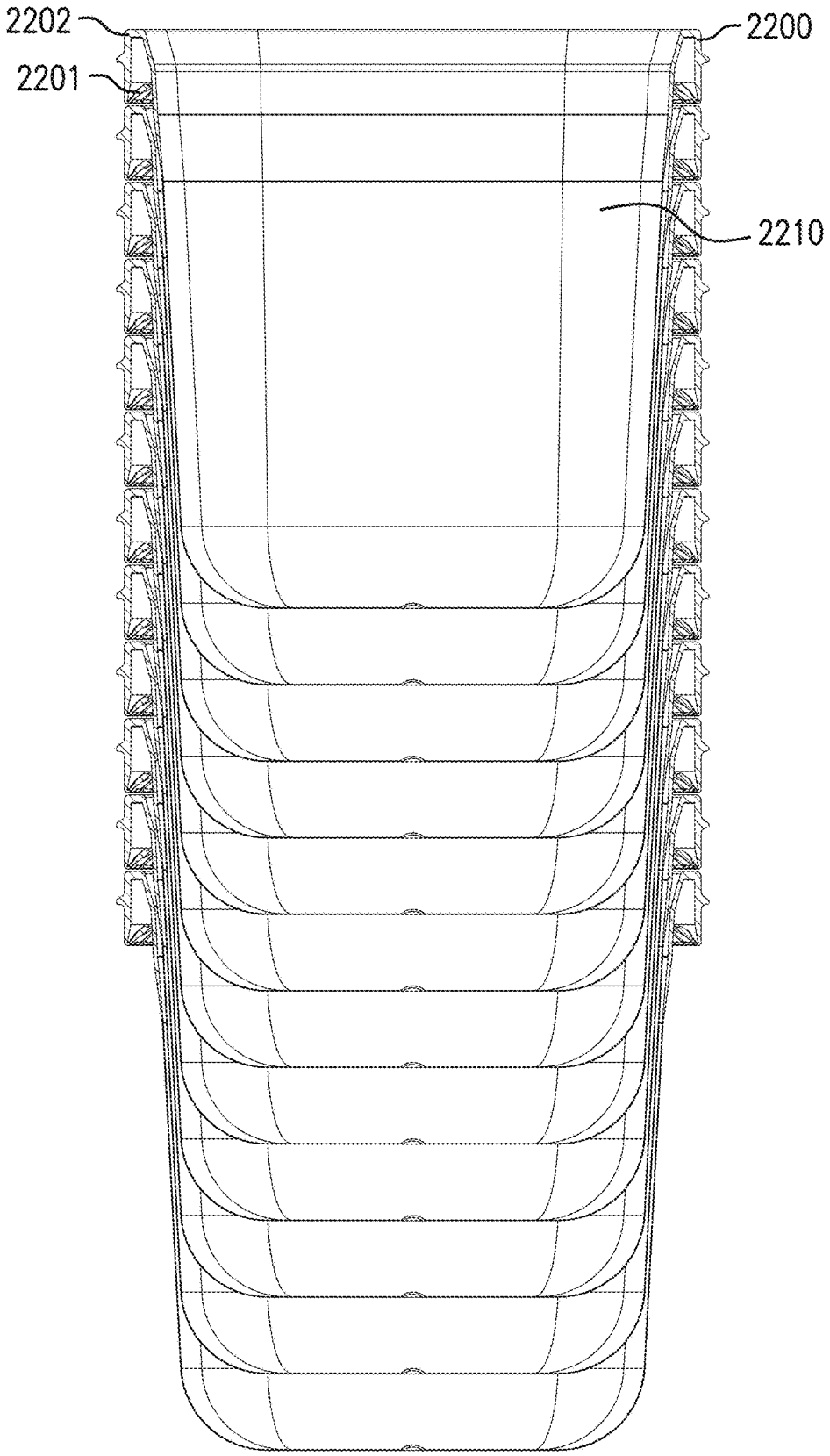
FIG. 22A illustrates an example of nested collars with liners, in accordance with an embodiment.

FIG. 22A shows a set of nested collar 2200 and liner 2210 tandems. A collection of collar-liner tandems may be stacked so that the liners nest, such that the collective space occupied by the collection of nested collar-liner tandems is less than the aggregate volumes of the collar-liner tandems that make up the collection of collar-liner tandems. A collar liner tandem may be fabricated as a single piece, or may be constructed by attaching a collar to a liner. A collar may have a shape that allows the bottom edge 2201 of an identical liner to rest on its top edge 2202, while a liner may have a shape that is capable of accommodating (e.g., nesting) a second, identical liner. A liner may be rigid or semi-rigid, and therefore capable of maintaining a defined shape with set dimensions. A liner may be pliable. The collar/liners and/or shells may be nested together. This may save space and allow for lower cost of transport and/or storage.

Figure 22B:
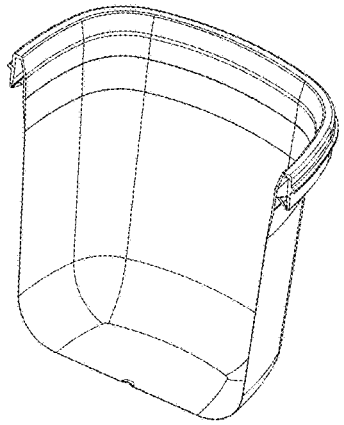
FIGS. 22B, 22C, and 22D, illustrate various example views of a non-circular collar-liner tandem capable of being nested, in accordance with an embodiment.
Figure 22C:
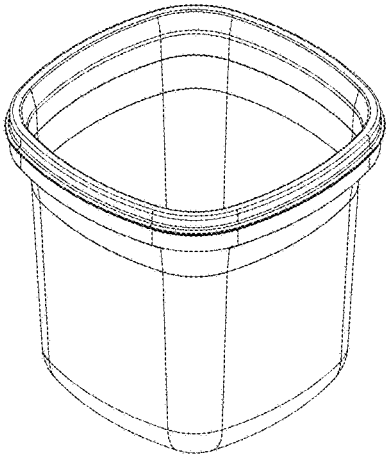
Figure 22D:
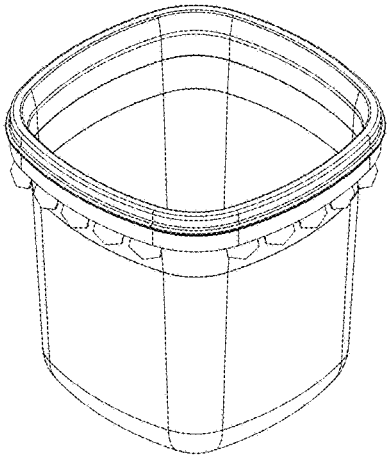

FIGS. 22B, 22C, and 22D, illustrate various example views of a non-circular collar-liner tandem capable of being nested with identical ones of the same.

Figure 22E:
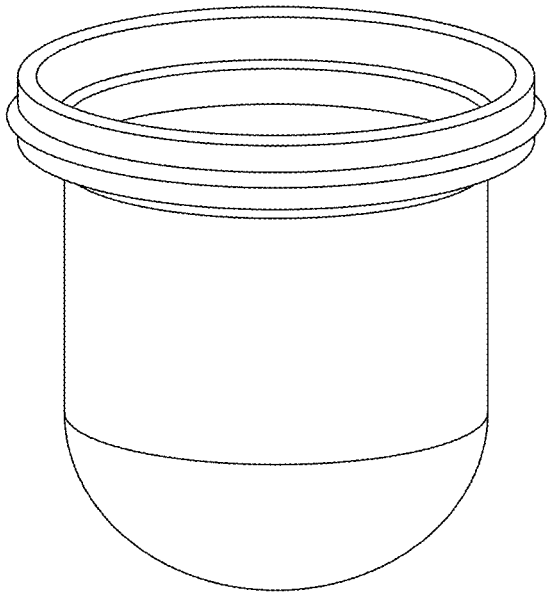
FIGS. 22E and 22F illustrate various example views of a circular collar-liner tandem capable of being nested, in accordance with an embodiment.
Figure 22F:
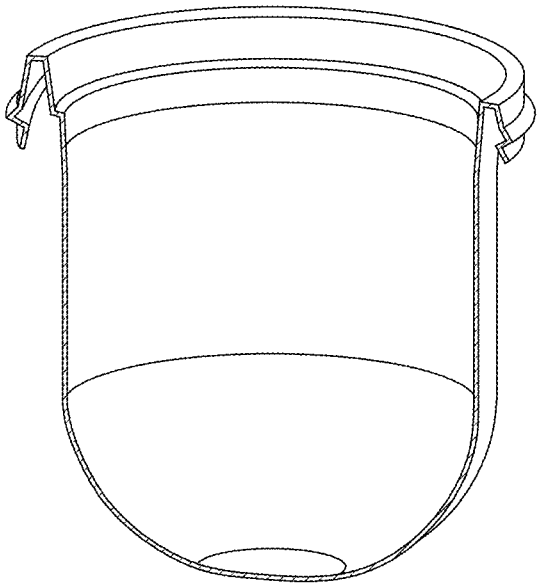

FIGS. 22E and 22F illustrate various example views of a circular collar-liner tandem capable of being nested with identical ones of the same.

Figure 23A:
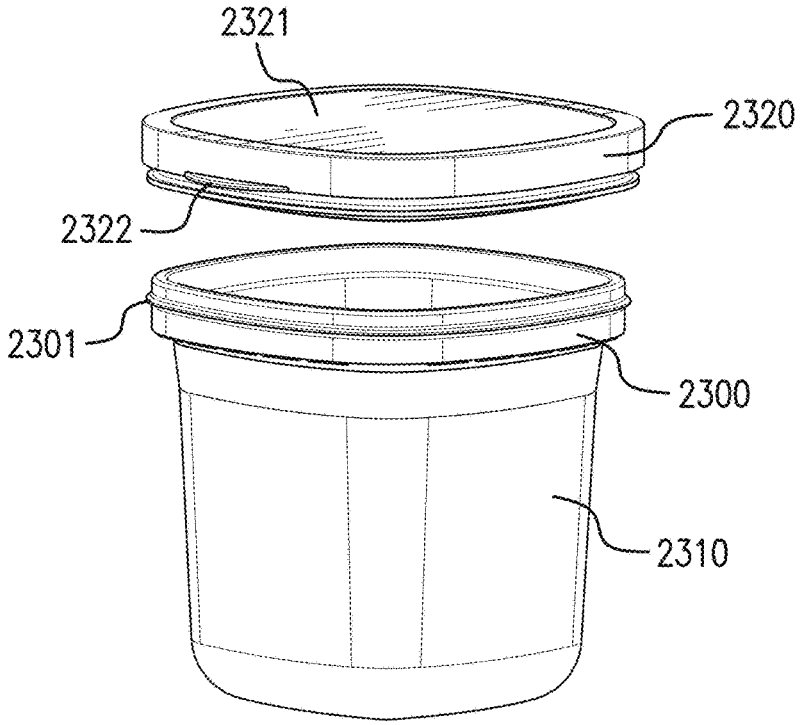
FIGS. 23A and 23B illustrate example views of containers with closures, in accordance with an embodiment.

FIG. 23A shows a container with a closure. A collar 2300 and liner 2310 tandem may be configured to connect with the closure 2320. The collar may have a feature 2301, such as a ridge, which a portion of the closure can fit over. The collar ridge feature may provide resistance to removal of the closure from the collar. The closure may comprise a solid top 2321 that is capable of completely enclosing the space encompassed by the liner. The closure may contain a protrusion 2322, such as a tab, that allows the closure to be gripped when it is coupled to the collar-liner tandem for removal of the closure from the collar.

Figure 23B:
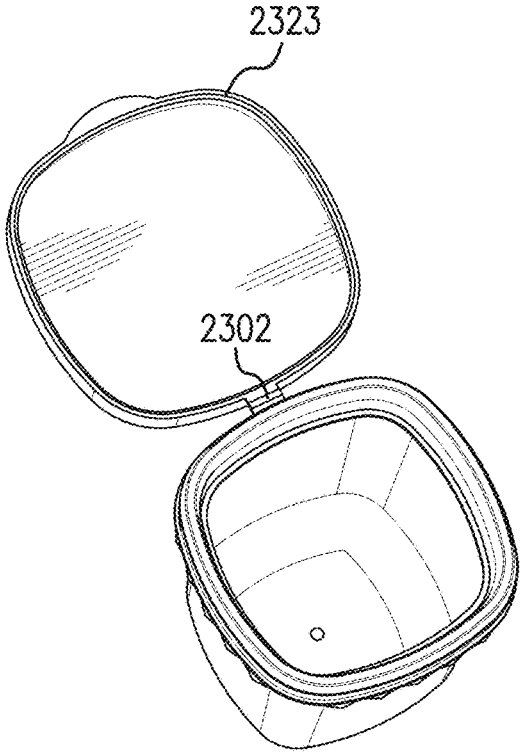

The closure may be distinct from the collar-liner tandem, as is shown in FIG. 23A, or may be connected to the collar-liner tandem, as is shown in FIG. 23B. The closure may be connected to the collar by a tab or hinge 2302. The tab or hinge may be pliable, allow the closure to reorient from an open position (shown) to a position in which it can connect with the collar. The closure may comprise a feature 2323, such as a ridge or indentation, that is configured to connect with a mating portion of the collar, thus strengthening the attachment between the closure and collar.

Figure 24A:
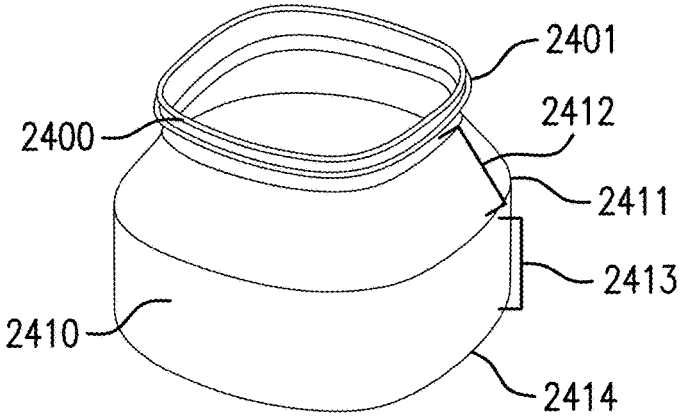
FIGS. 24A, 24B, and 24C, illustrate example views of a collar with a liner having a greater overall outside dimension than the collar, in accordance with an embodiment.
Figure 24B:
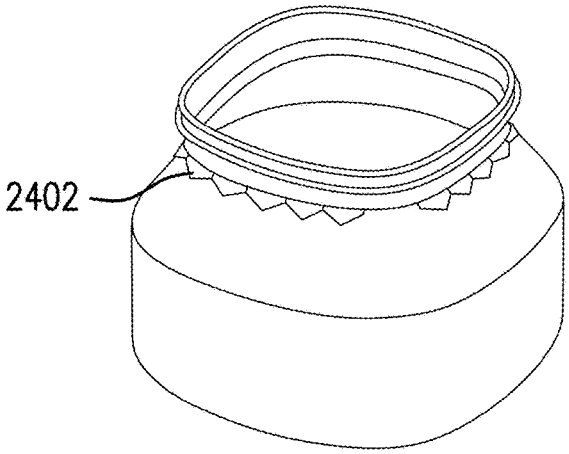
Figure 24C:
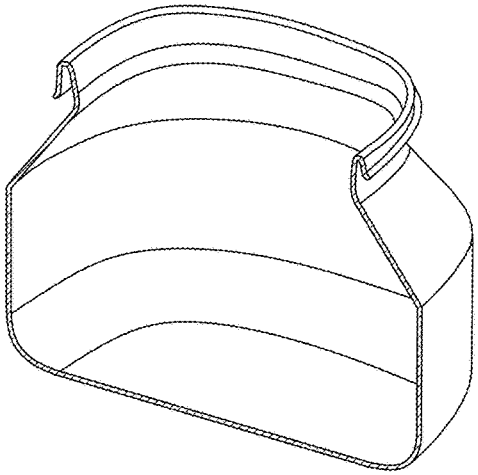

FIG. 24A shows a collar 2400 and liner 2410 tandem where the liner has an overall outside width that is wider than that of the collar. The collar and liner both have roughly square profiles as viewed in a plan view, with rounded (rather than sharp) edges 2401 and 2411. The top of the liner has an overall outside width that is roughly equal to that of the collar, followed by a portion 2412 that widens outward, a portion 2413 that is roughly vertical, and a rounded edge 2414 leading to a roughly flat bottom. A collar may comprise an inner-space, as described herein above, that is capable of accommodating a portion of a pulp-molded shell, a liner, a closure, a collar feature, another collar, or any combination thereof. FIG. 24B shows the collar and liner tandem of FIG. 24A with collar features 2402 positioned outside of the collar. These features may be capable of repositioning to an inner-space within the collar in a manner described herein above. FIG. 24C provides a side cutaway view of the collar-liner tandem of FIGS. 24A-24B. The liner may be affixed to an outer or inner surface or edge of the collar. As is shown in FIG. 24C, the collar may be thicker than the liner.

Figure 25A:
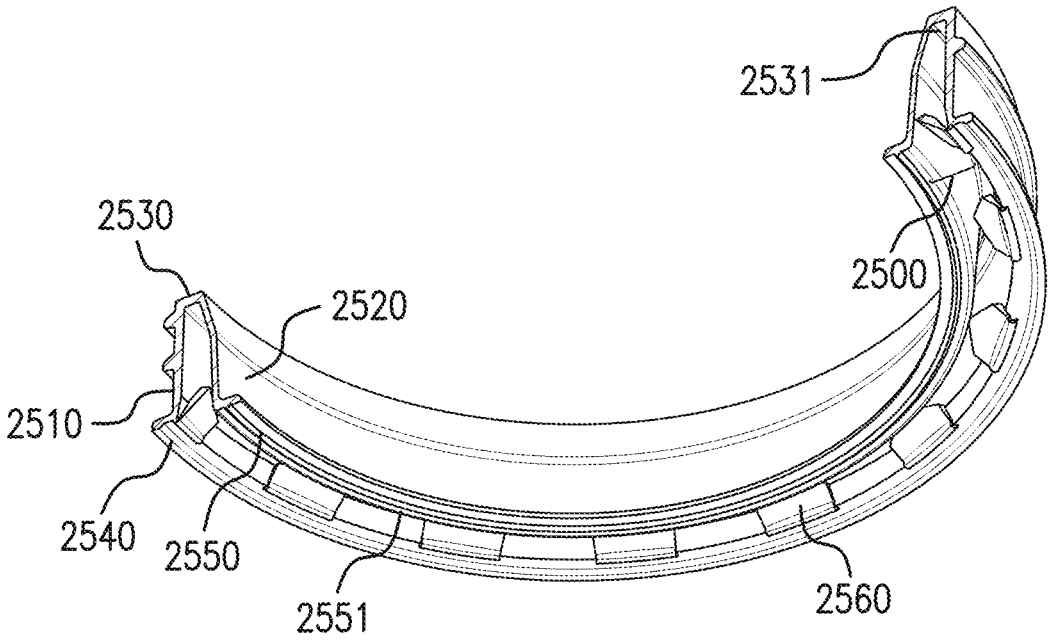
FIGS. 25A and 25B illustrate cutaway views of a collar, in accordance with an embodiment.
Figure 25B:
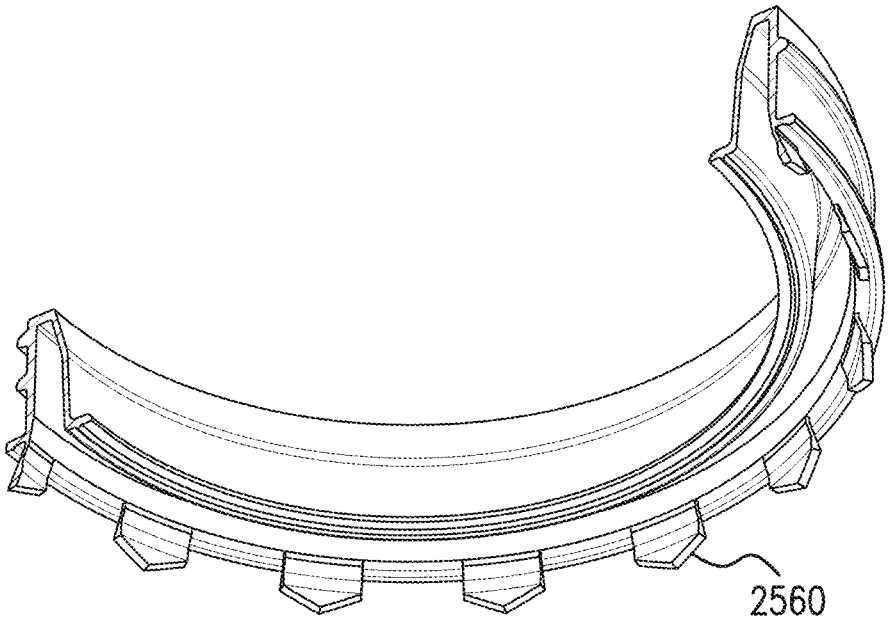
Figure 25C:
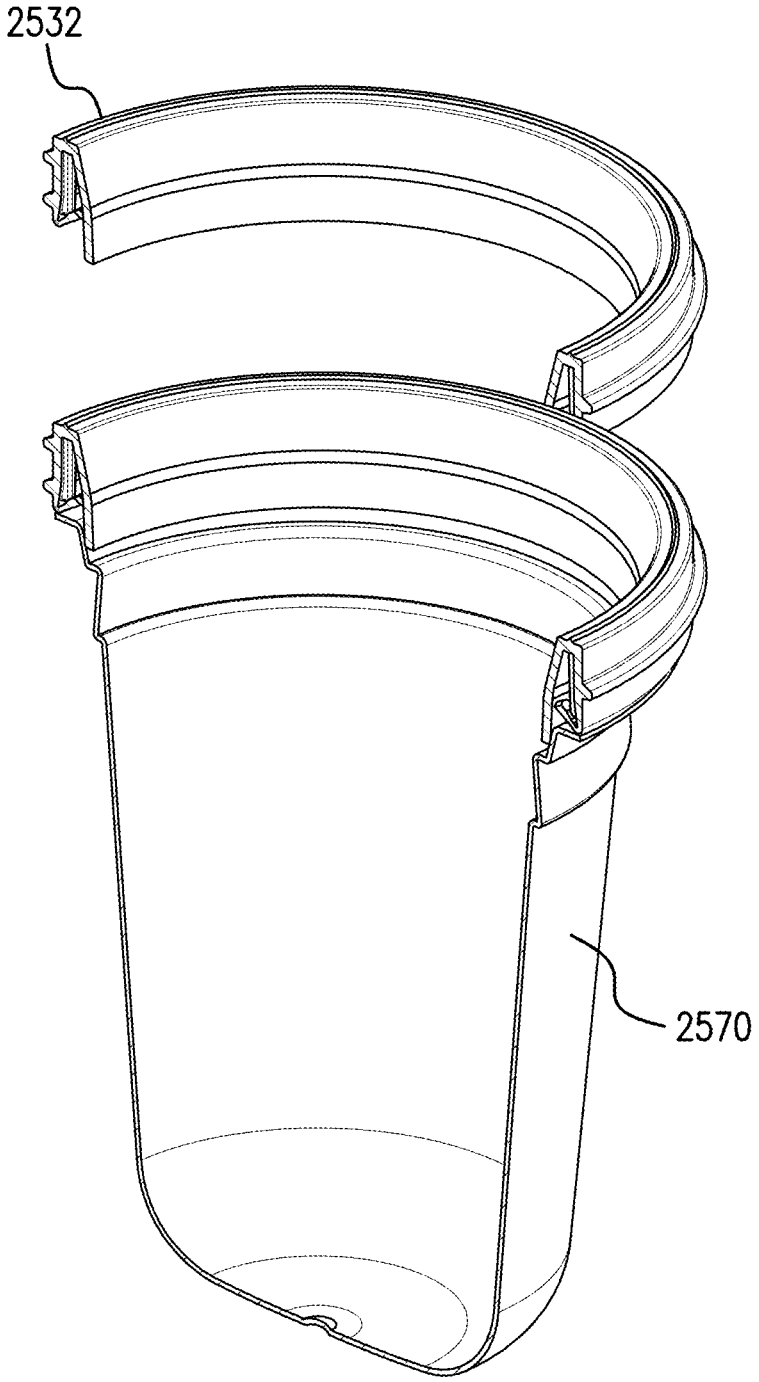
FIG. 25C illustrates a cutaway view of a collar, and the collar attached to a liner, in accordance with an embodiment.

FIGS. 25A and 25B illustrate a cutaway view of a collar 2532 (enumerated in FIG. 25C). The collar may comprise an inner-space 2500 bounded by an outer wall 2510, an inner wall 2520, and optionally a top wall 2530. The inner and outer faces of the inner and outer walls may optionally comprise outer and inner lips 2540 and 2550. In many cases, a liner (see example liners disclosed herein above) is attached (e.g., welded) to the bottom of a lip (e.g., inner lip 2550) or an inner-space facing portion of the top wall 2531. A liner may also be attached to an inner-space portion of the inner or outer wall, an outward facing portion of an inner or outer wall, or the top of an inner or outer lip. The collar may comprise a feature 2551 (e.g., a ridge) along which a liner may be attached. Alternatively, the liner may be pre-formed with the collar.

The collar may comprise a feature 2560 for gripping a pulp-molded shell. The pulp-molded shell may be any shell disclosed herein. The feature may be capable of adopting multiple positions. For example, the feature may be capable of rotating or bending from the collar inner-space to a position outside of the collar inner-space, as is shown in FIG. 25B.

FIG. 25C provides a cutaway view of the collar 2532 from FIGS. 25A and 25B, with this same collar attached to a liner 2570. The liner is attached to a ridge on the top wall 2531 of the collar 2532, and extends down the collar inner wall 2520 and below the collar. The liner shown is flush with the collar. A liner may also be offset from a collar, for example with a gap between the liner and the collar inner wall.

Figure 26A:
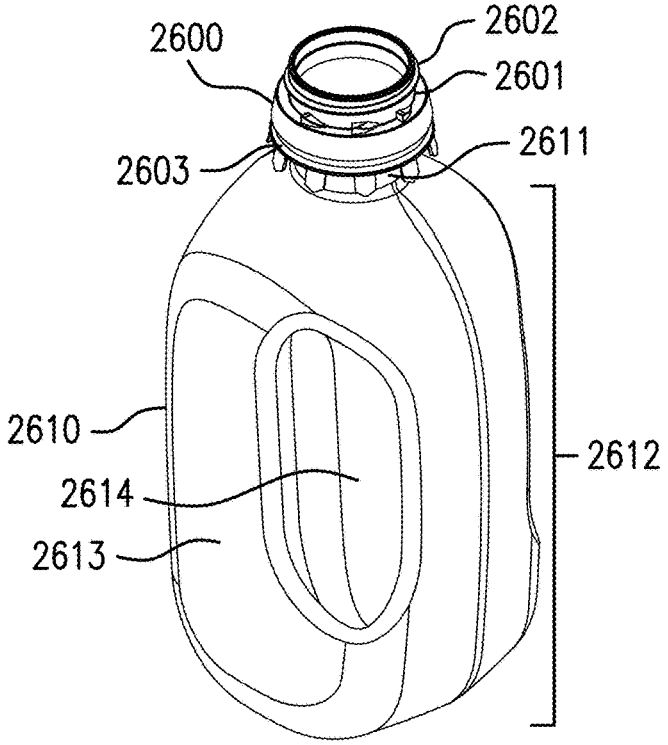
FIGS. 26A, 26B, 26C, 26D, and 26E, illustrate various views of a collar with a liner, in accordance with an embodiment.

FIG. 26A depicts a container comprising a round collar 2600 and a non-round liner 2610. The liner has a round neck 2611 leading to a wider, oblong body 2612. The body of the liner has a complex shape comprising a flat surface 2613 and an indented region 2614 suitable for gripping. The collar comprises a number of features 2601 and 2602 such as ratchets, lugs, or ribs that aid in gripping, orienting, and retaining a closure. The collar may also comprise a lip 2603 that may support a closure.

Figure 26B:
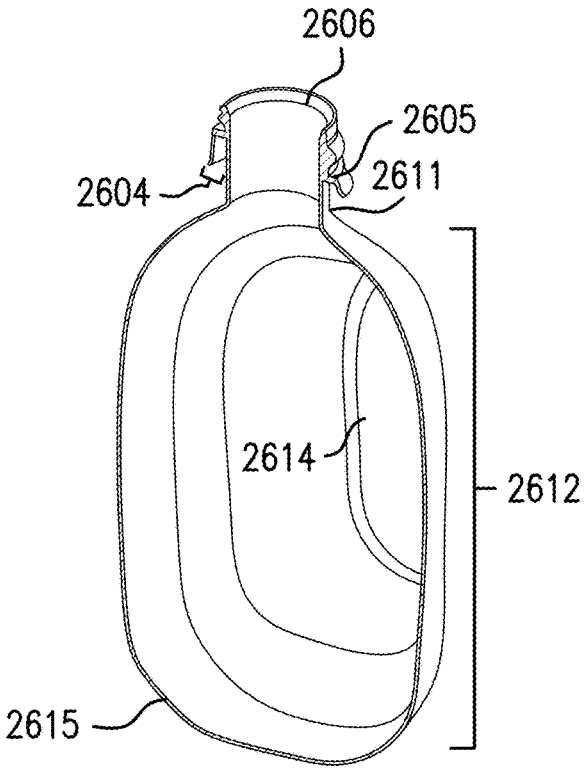

FIG. 26B provides a side cutaway view of the container shown in FIG. 26A. The collar may comprise an inner-space 2604 that can fit over a pulp molded shell. The inner-space may comprise a feature 2605, such as a barb, for gripping the pulp-molded shell. The liner may extend through a portion of the collar, and be attached to a collar inner wall 2606 (e.g., by welding or gluing) in a manner describe herein above. The liner may comprise a rounded edge 2615, a sharp edge, or any combination thereof, at the bottom of the liner. The liner may comprise a uniform thickness or variable thicknesses.

Figure 26C:
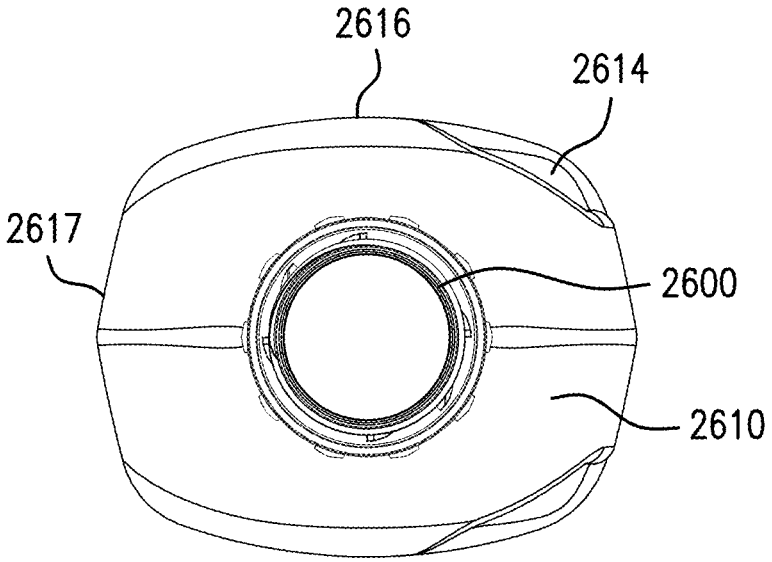

FIG. 26C provides a top-down view of the container from FIGS. 26A and 26B, illustrating how a collar and liner may have substantially different dimensions and shapes. For example, the depicted container has a round collar 2600 and an oblong liner 2610 comprising relatively flat edges 2616 and 2617 and complex indentations 2614.

Figure 26D:
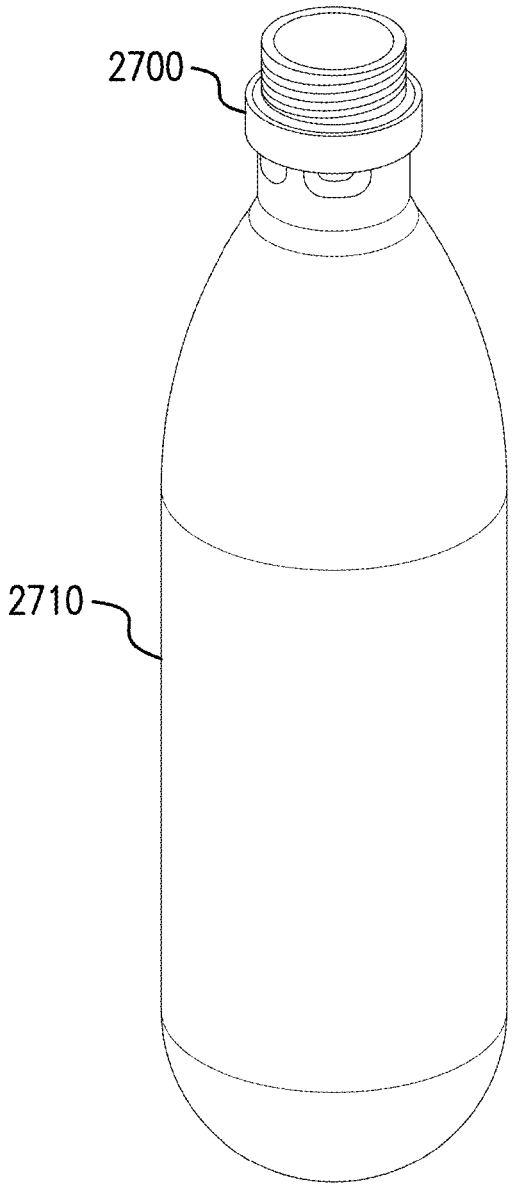
Figure 26E:
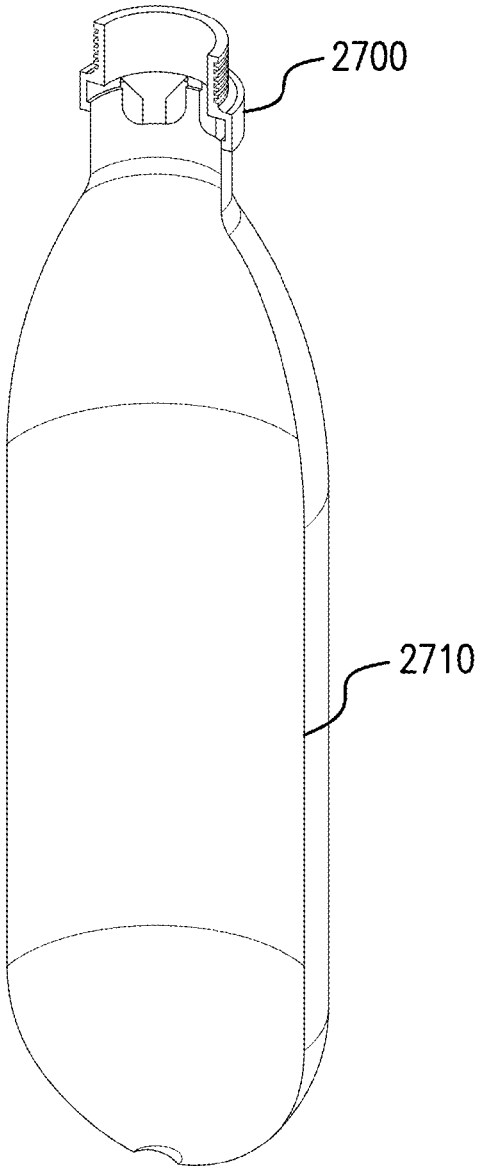

FIGS. 26D and 26E depict a container formed of a collar-liner tandem similar to that of FIG. 26A, but with a round collar 2700 and a round liner 2710, and absent the complex indentations 2614 of the collar-liner tandem 2600, 2610 of FIG. 26A.

The liner may be formed in any manner as described elsewhere herein. In some embodiments, the liner may be formed with one or more of the aforementioned features. The liner may be formed with one or more three-dimensional features and/or have a varying thickness to accommodate different configurations.

Figure 27A:
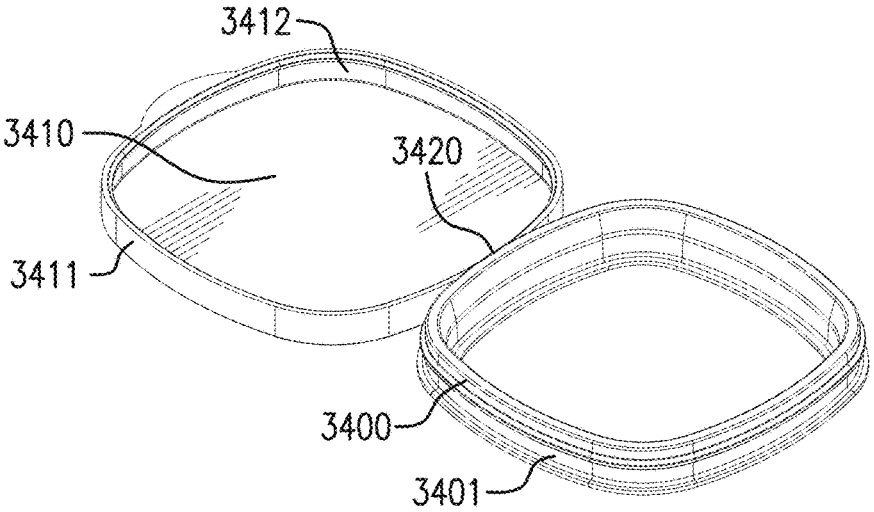
FIGS. 27A, 27B, 27C and 27D, illustrate example collars with closures, in accordance with an embodiment.

Reference is now made to FIGS. 27A-27F. FIG. 27A provides a design for a collar 3400 and closure 3410. In this design, the collar and closure comprise similar shapes that are roughly square with slightly curved edges. While in many instances, a closure and collar will have nearly identical shapes, in some instances a collar and closure will comprise different shapes. The closure may comprise a rim 3411 that can fit over the edge of the collar. The inner face of the rim may contain a feature 3412 (e.g., a first ridge) that can snap over a feature 3401 (e.g., a second ridge) on the edge of the collar, thereby fastening the closure to the collar.

Figure 27B:
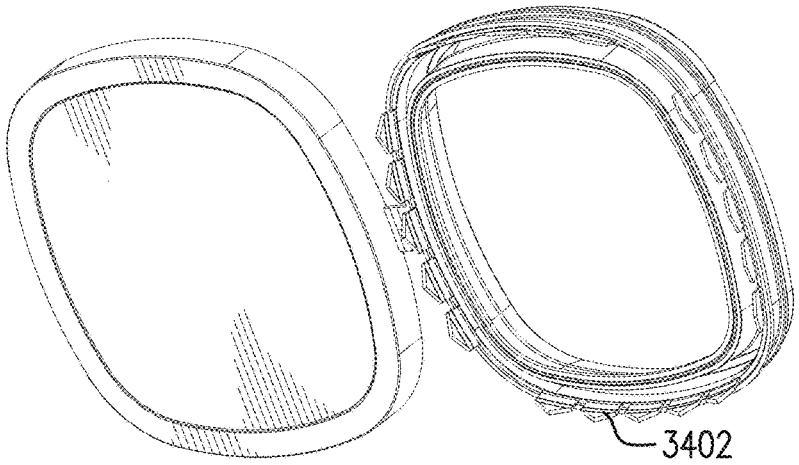

FIG. 27B provides a view of the opposite side of the collar shown in FIG. 27A. From the angle of FIG. 27B, it is possible to observe a set of collar protrusions or barbs 3402 that can aid in attachment of the collar to a pulp-molded shell, in a manner described herein above. In some instances, these protrusions may be capable of flipping from an inside-space within the collar to positions outside of the collar. The collar and closure may be connected by a flexible hinge or connecting piece 3420. The collar and closure may be integrally formed.

Figure 27C:
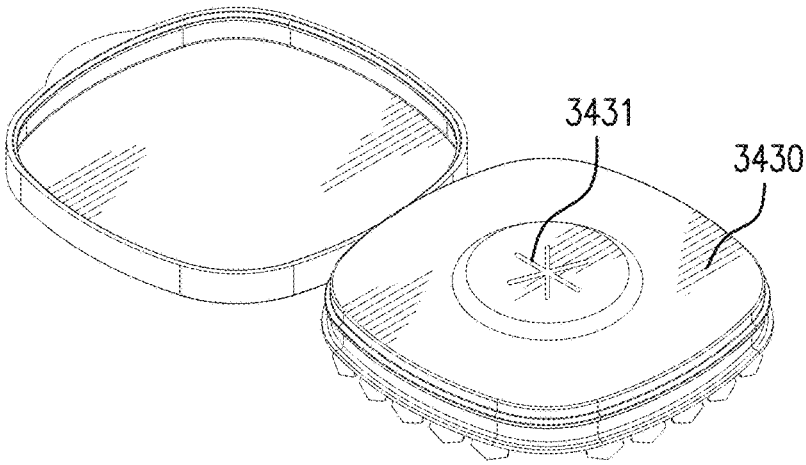

FIG. 27C shows the collar and closure from FIGS. 27A-27B, further comprising a covering 3430 over the opening in the collar. The covering may be a distinct piece that connects (e.g., snaps) onto the collar, or may be fabricated as part of the collar. In an embodiment, the collar, closure, and covering, may be integrally formed. The covering may comprise an opening 3431 such as the three crossing through-slits as shown in FIG. 27C. Such an opening 3431 might allow a material through (e.g., a tissue) while simultaneously minimizing liquid or gas effusion from the container. The opening 3431 may also hold a material from the container in an upright position that is easy to grip from outside of the container. For example, the opening 3431 may grip the middle portion of a tissue that is projecting through the opening, thus holding a portion of the tissue in an upright position.

Figure 27D:
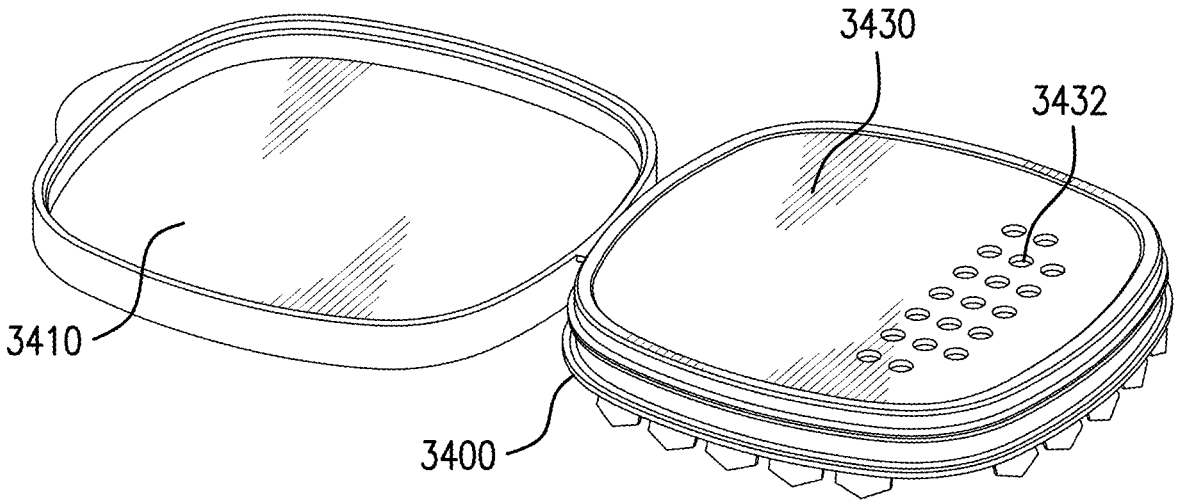

FIG. 27D shows a collar 3400, closure 3410, and covering 3430, arrangement similar to that of FIG. 27C, but with a plurality of openings 3432 in place of the three through-slits 3431. In the FIG. 27D embodiment, the plurality of openings 3432 may be appropriately sized to provide restrictive dispensing of a fluid or granular materials, such as spices, salad dressings, edible oils, other consumable product, fertilizers, sidewalk ice-melt, lotion, lubricating oils, or the like. While the plurality of openings 3432 is particularly illustrated as a "plurality" of openings, it will be appreciated that other configurations of openings are possible, such as a single opening having a dispensing area equal to, greater than, or less than, an aggregate of the individual dispensing areas of the plurality of openings 3432, or slots or any other shaped hole, versus circular holes, for example. All such openings consistent with an embodiment disclosed herein are contemplated and considered to fall within a scope of the appended claims.

Figure 27E:
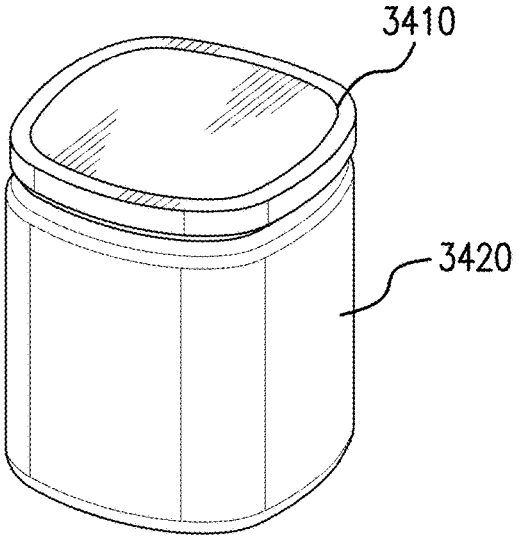
FIGS. 27E, 27F, and 27G, illustrate examples of a collar with closure attached to a shell, in accordance with an embodiment.
Figure 27F:
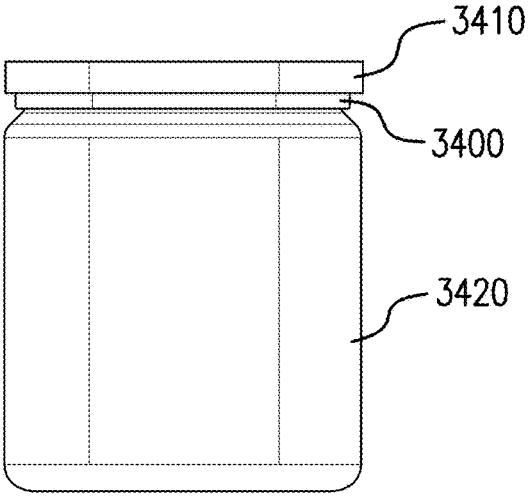
Figure 27G:
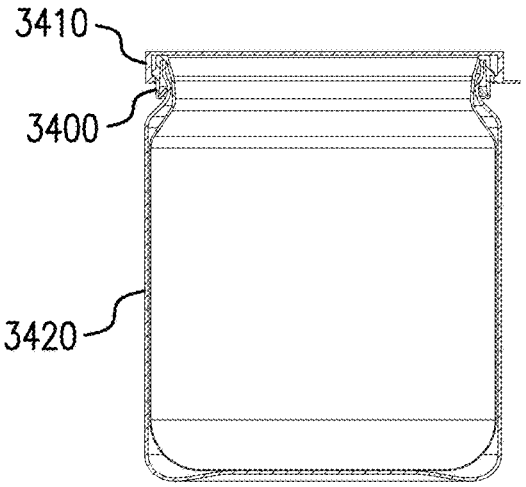

FIG. 27E shows the collar 3400 and closure 3410 connected to a pulp-molded shell 3420. In this instance, the pulp molded shell has roughly equal shape and area (from a top-down projection view) as the collar and closure. However, in other instances, a pulp-molded shell may have a different shape and/or area that the collar and/or closure. FIGS. 27F and 27G respectively show a side view and cutaway side view of the collar 3400 and closure 3410 of FIG. 27E where the closure 3410 and pulp-molded shell 3420 have equal overall outside dimensions. In other embodiments, the closure and shell may have different overall outside dimensions, as disclosed herein above. As an aside, it is noteworthy that the cutaway side view of FIG. 27G depicts a liner-collar configuration where the liner 3440 and the collar 3400 are molded as a single part, while FIGS. 27A-27D depict an independent collar 3400 absent such a liner, which is intended to indicate that the collar 3400 of FIGS. 27A-27D could be accepting of a liner that is independent of the collar, could be accepting of a liner that is integrally formed with the collar, or could be utilized absent the need for a liner.

Figure 28A:
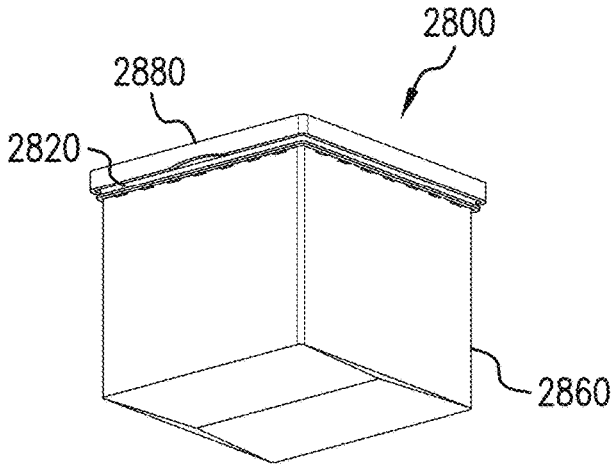
FIGS. 28A, 28B, and 28C, illustrate examples of a collar and a liner with closure attached to a corrugated shell, in accordance with an embodiment.
Figure 28B:
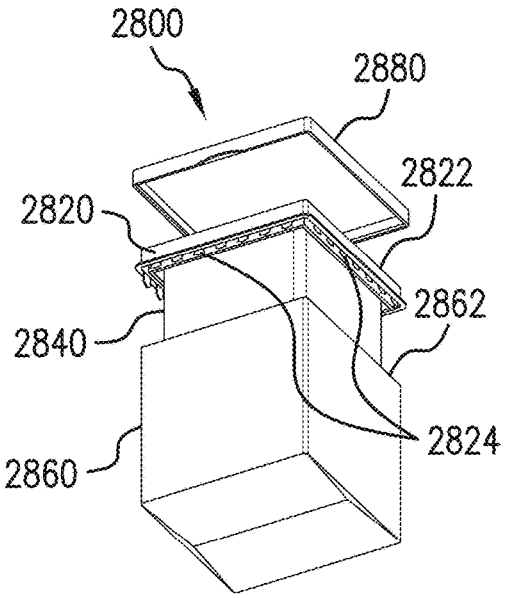
Figure 28C:
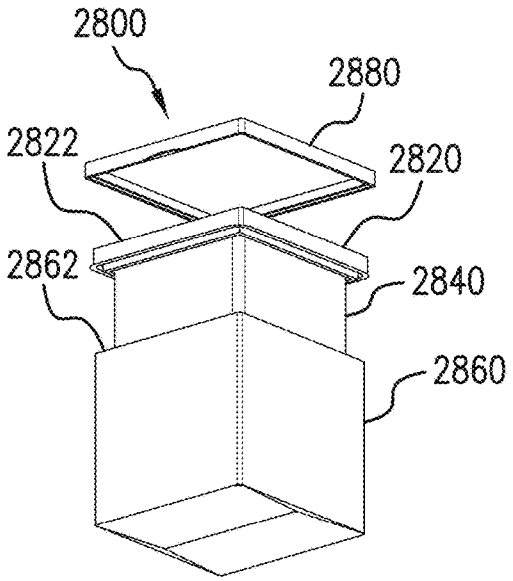

Reference is now made to FIGS. 28A-28C, which in general depict a container 2800 having a collar 2820, a liner 2840, a pulp-formed shell 2860, and a closure 2880. As depicted, the pulp-formed shell 2860 has a rectangular or square profile as observed in a top-down plan view of the container 2800, and has the form of a box-shaped carton. In an embodiment, the pulp-formed shell 2860 is formed from a pulp-formed corrugated cardboard material that is cut, scored, or slit in a flat-blank state and then folded to provide the pulp-formed shell 2860 in the box-shape depicted. As depicted, the collar 2820, liner 2840, and closure 2880 each have a similar rectangular profile, as observed in a top-down plan view of the container, as the pulp-formed shell 2860, thereby providing a mating arrangement wherein the liner 2840 fits within the pulp-formed shell 2860, the collar 2820 fits and engages with the top rectangular edges 2862 of the pulp-formed shell 2860, and the closure 2880 fits and engages with mating features 2822, such as ribs, formed on a top surface or edge of the collar 2820. In an embodiment, the closure 2880 removably snap-fit engages with the collar 2820 in a manner described herein or known in the art of snap-fit fixturing. Similar to other collars disclosed herein, an embodiment of the collar 2820 includes protrusions or barbs 2824 that are movable from a first position outside of an inner-space of the collar 2820 (depicted in FIG. 28B) to a second position inside of the inner-space of the collar 2820 (depicted in FIG. 28C). While the inner-space of the collar 2820 of FIGS. 28A-28C is not particularly enumerated in FIGS. 28A-28C, such inner-space is depicted, described and enumerated in other figures provided herein, see for example the inner-space 210, 320, 1015, 1230, 1824, 2500 depicted and described in connection with FIGS. 2A, 3A, 10, 12E, 18B, 25A. As with any other container disclosed herein, reference to a container, a collar, a liner, a pulp-formed shell, a protrusion or barb of a collar, an inner-space of a collar, or any other feature having a similar name when used in connection with the several figures provided herewith, will be understood by one skilled in the art to be informative of the structural design of any such named feature in any one of the several figures provided herewith. As described in connection with other embodiments disclosed herein, the protrusion or barbs 2824 when moved from the first position to the second position are instrumental in capturing and removably retaining the collar 2820 to the pulp-formed shell 2860. From the foregoing, it will be recognized and understood by one skilled in the art that the box-shaped pulp-formed shell 2860 may have any shape known in the art of corrugated containers.

Figure 28D:
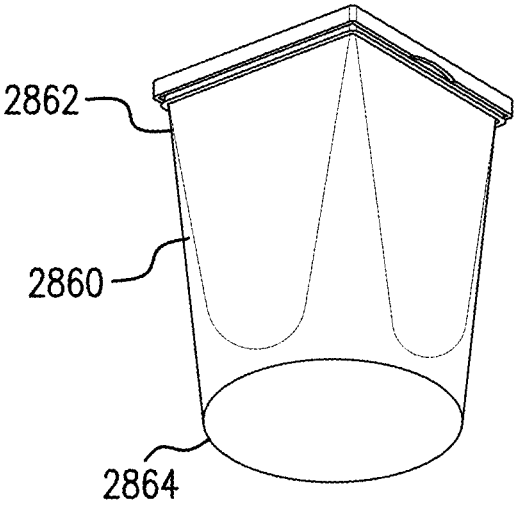
FIGS. 28D and 28E illustrate examples of a collar with closure attached to a shell having an outside surface that varies from top to bottom, in accordance with an embodiment.
Figure 28E:
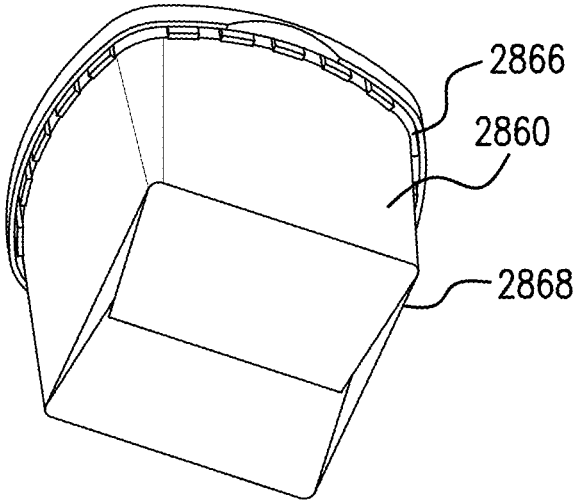

With reference now to FIGS. 28D and 28E, an embodiment of the pulp-formed shell 2860 includes an arrangement wherein: as viewed in at least one cross-section plan view of the container, an overall outside surface of the pulp-formed shell has a cross-section in the form of; a circle, an oval, a rectangle, or a square; as viewed in cross-section plan views of the container, an outside surface of the pulp-formed shell transitions, from top 2862 to bottom 2864, from a rectangular cross-section to an oval cross-section; as viewed in cross-section plan views of the container, an outside surface of the pulp-formed shell transitions, from top 2866 to bottom 2868, from an oval cross-section to a rectangular cross-section; as viewed in cross-section plan views of the container, an outside cross-sectional perimeter of the pulp-formed shell transitions, from top 2862 to bottom 2864, from a plurality of linear perimeter cross-sections to a continuous curved perimeter cross-section; as viewed in cross-section plan views of the container, an outside cross-sectional perimeter of the pulp-formed shell transitions, from top 2866 to bottom 2868, from a continuous curved perimeter cross-section to a plurality of linear perimeter cross-sections.

With respect to the pulp-formed shell 2860 being a box-shaped carton, the size of the carton can vary significantly from a large carton box, through to a small cosmetic size package. The shape of the carton can vary also. It can have a tall aspect ratio with the collar connected to a small face of the carton, it can have a low aspect ratio, with a collar at a larger face, or it can be in between with a more cubic shape. For a given collar, there can be different lengths of carton that can adjoin to it, so that a family of container sizes can result from a single collar size. The shape of the collar can be substantially similar to the shape of the carton, or the collar can have a different shape from the carton. The collar could variably deform the sides of the carton. With regard to the liner and collar, they can be integral and made during a single process, or they can be assembled to each other from independent collar and liner parts. The collar can be installed to the carton either before or after the liner is installed. The liner can vary and can be of any of the types disclosed herein. The liner type can include: (i) a poly bag that is connected near the open perimeter of the carton with the use of the collar, (ii) the liner can be formed (e.g., vacuum formed, thermoformed) to be shaped proximately to the inside of the carton so that it 'drops into' the carton. With regard to the closure, seal or lid, for tamper evidence or protection of the contents, a removable seal can be made to fit either the collar or the liner itself. There can be a lid arranged to cooperate with the collar. Optionally, inset from its perimeter, the lid can have a smaller resealable opening to allow access to the container contents without necessitating the removal of the entire lid.

Figure 29:
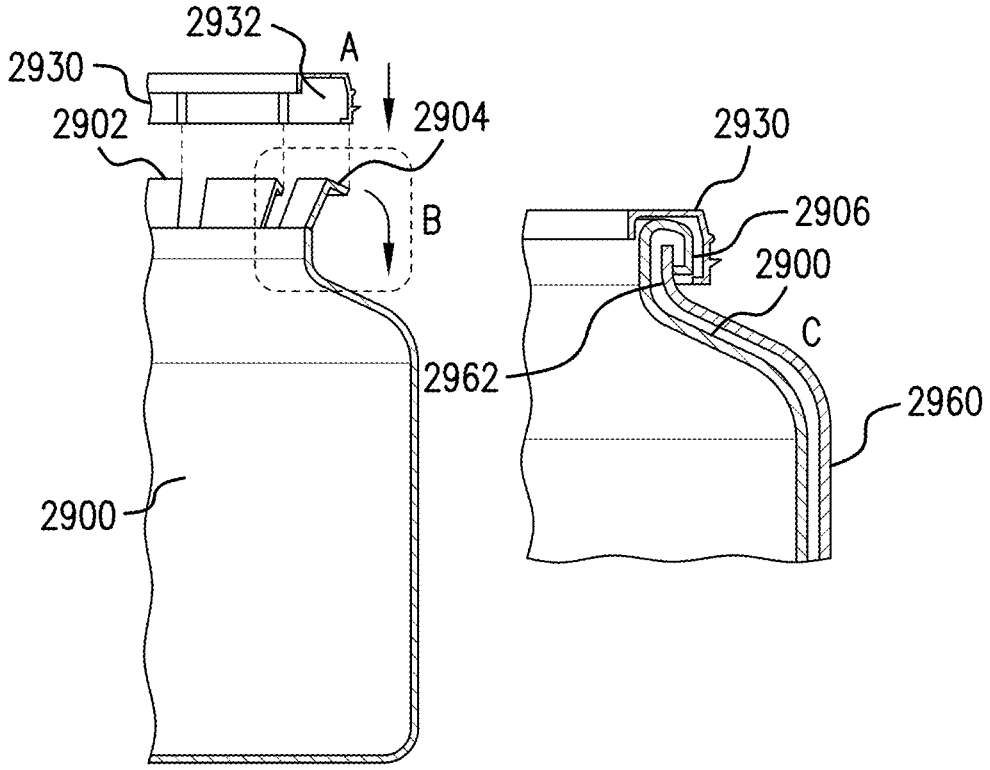
FIG. 29 illustrates partial cross section views of a collar, closure, and shell, in accordance with an embodiment.

Reference is now made to FIG. 29, which depicts partial cutaway side views of a liner 2900, a collar 2930, and a pulp-formed shell 2960. In this embodiment, the liner 2900 comprises a plurality of protrusions or barbs 2902 that are integrally formed with the liner 2900. The protrusions or barbs 2902 may be formed in a first position 2904, and then bent over into a second position 2906 by the installation of the collar 2930 onto the top of the liner 2900, where the collar has an inverted U-shaped inner-space 2932 around a perimeter of the collar 2930 that receives and deforms the protrusions or barbs 2902 of the liner 2900. When the liner 2900 and collar 2930 are engaged with the pulp-formed shell 2960, the protrusions or barbs 2902 of the liner, now being in the second position 2906, engage with, deform, or at least partially pierce, a neck 2962 of the pulp-formed shell 2960 to removably secure the liner-collar tandem to the pulp-formed shell 2960. In an embodiment, the liner 2900 is first assembled to the pulp-formed shell 2960, and then the collar 2930 is assembled to the liner-shell combination to deform the protrusions or barbs 2902 from the first position 2904 to the second position 2906. In another embodiment, the collar 2930 is first assembled to the liner 2900 causing the protrusions or barbs 2902 to deform from the first position 2904 to the second position 2906, and then the liner-collar tandem is assembled to the pulp-formed shell 2960 where the protrusions or barbs 2902 become engaged with the neck 2962 of the pulp-formed shell 2960. In an embodiment, the liner 2900 may be blow molded to a final form fitting arrangement within the pulp-formed shell 2960.

With respect to the arrangement depicted in FIG. 29, it will be appreciated that the connectivity of the liner, collar, and shell, is not limited to the protrusions or barbs being disposed on the collar, but also includes an arrangement where the protrusions or barbs are disposed on the liner. As depicted in FIG. 29, the liner is the carrier of integrally formed barbed features, and it is the insertion/installation of the collar that forces the 'activation' of the barbed features such that the barbs 'clamp/engage' the pulp-formed shell, which in an embodiment may be a revolute (discussed further herein below). The collar engages the barbs via mechanical features (pins, teeth, barbs, posts, ribs etc), or alternatively via welding (inductive, heat, friction, or adhesive), into an engaged position with the barbs where the barbs maintain their function of gripping and keeping the assembly together, at least until a user chooses to disassemble the assembly. In an embodiment, the barbed features are formed (e.g., molded) with the liner in a state that is conducive to known techniques of injection molding, including the use of preforms in an injection blow molding process.

Figure 30C:
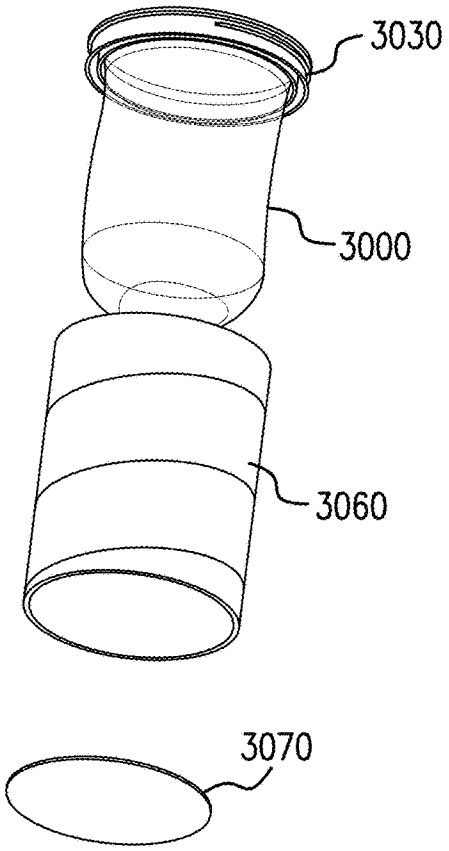
FIGS. 30A, 30B, and 30C, illustrate various views of a collar and liner with a revolute shell, in accordance with an embodiment.
Figure 30B:
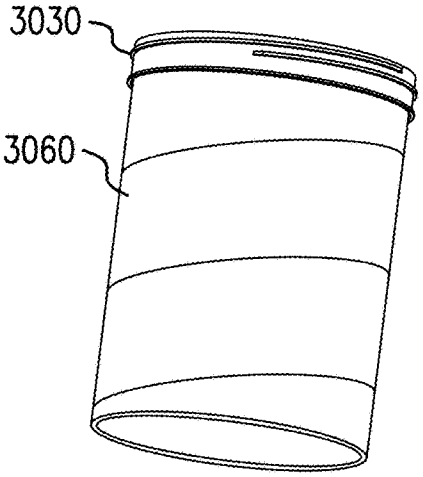
Figure 30A:
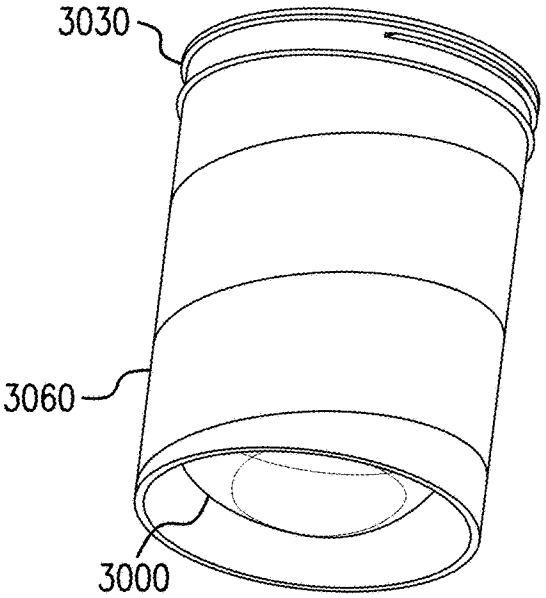

Reference is now made to FIGS. 30A-30C, which depict various views of a liner 3000, a collar 3030, a pulp-formed shell 3060, and an optional bottom 3070. In this embodiment, the liner 3000 and collar 3030 may be of any similarly named form disclosed herein. Alternative to other forms of the pulp-formed shell disclosed herein, the pulp-formed shell 3060 of FIGS. 30A-30C is formed from a revolute pulp-formed material, such as a paper or cardboard tube for example. A typical container shape arising from the revolute is a container with a circular cross section since the basic revolute cylinder is circular. However, and while still using a common cylindrical revolute, a collar that is not circular in a section may be fit to the revolute via a circular portion of the collar that transitions to a non-circular portion of the collar, thereby giving a cross-section that is more rectangular, triangular, or hexagonal, for example. In an embodiment, these alternate section shapes may be softened shapes with rounded corners or even curved sides where a true rectangle would have straight sides. All such non-circular collars are contemplated and considered to be inherently disclosed herein. Less typical but nonetheless constructable, are revolute paper formed shapes that are formed with square or rectangular cross sections, or near square and near rectangular cross sections but with a slight positive crown to the faces. All such non-circular revolute forms for the pulp-formed shell disclosed herein are contemplated and considered to be inherently, if not explicitly, disclosed herein.

Figure 31C:
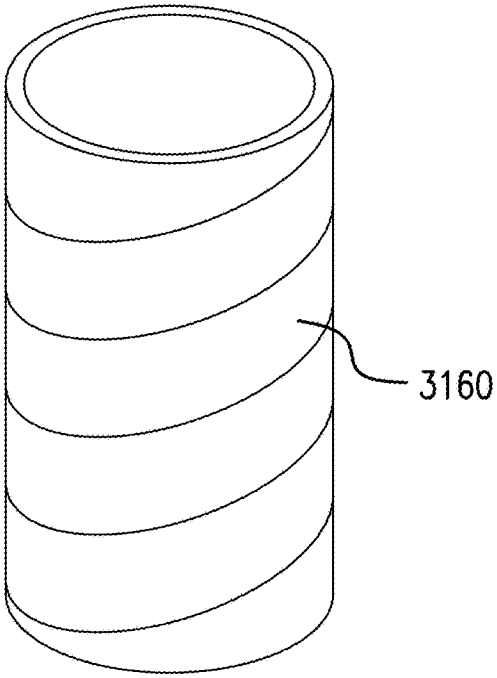
FIGS. 31A, 31B, and 31C, illustrate various alternative views of a collar and liner with a revolute shell, in accordance with an embodiment.
Figure 31B:
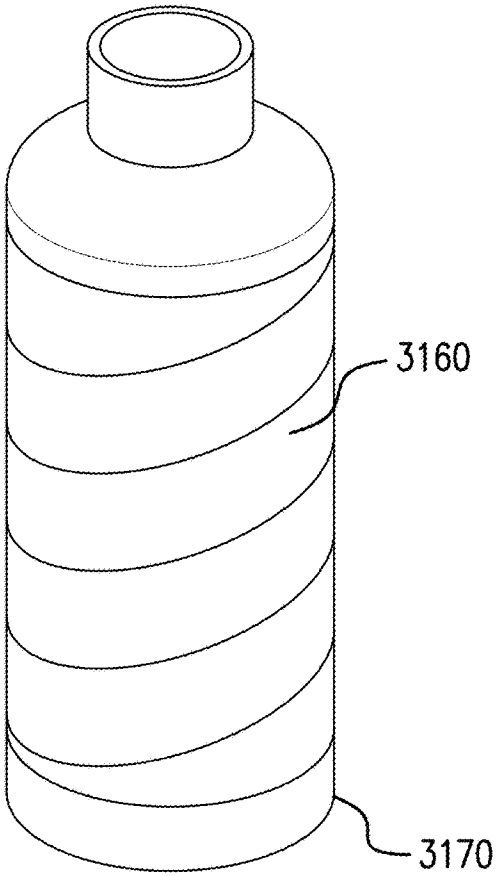
Figure 31A:
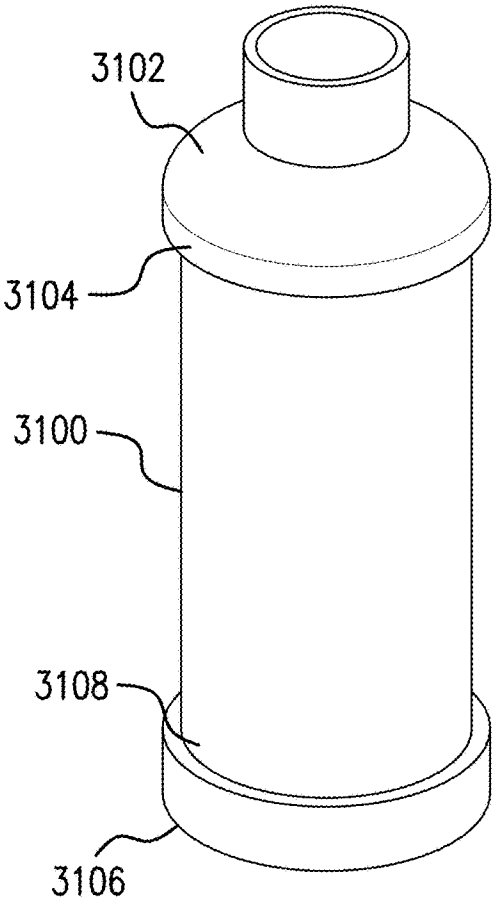

Reference is now made to FIGS. 31A-31C, which depict various views of a liner 3100, a pulp-formed shell 3160, and an optional bottom 3170, similar to that of FIGS. 30A-30C where here the pulp-formed shell 3160 is also formed from a revolute pulp-formed material. A distinction between the container construct of FIGS. 31A-31C and the container construct of FIGS. 30A-30C, is that the pulp-formed shell 3160 serves as a sleeve that slides over the liner 3100, which is least structural through its midsection, and where the pulp-formed shell 3160 provides an external support to a less structural liner 3100. In an embodiment, the revolute pulp-formed shell 3160 slides down over the top of the liner 3100, and in another embodiment slides up over the bottom of the liner 3100. The liner 3100 may be formed with an upper portion 3102 that provides a shoulder 3104 that engages with a top edge of the revolute pulp-formed shell 3160, or may be formed with a lower portion 3106 that provides a shoulder 3108 that engages with a bottom edge of the revolute pulp-formed shell 3160, depending on which direction the pulp-formed shell 3160 is assembled to the liner 3100. The lower portion 3106 of the liner 3100 optionally forms a bottom of the container. The upper and lower portions 3102, 3106 of the liner 3100 may be thicker and more rigid than the midsection contained within the pulp-formed shell 3160. Similar to the revolute of FIGS. 30A-30C, a typical container shape arising from the revolute of FIGS. 31A-31C is a container with a circular cross section since the basic revolute cylinder is circular.

Since the revolute is stronger than the liner as it is adding structure to the liner, it is anticipated that the liner will be cylindrically shaped where it is in contact with the inner wall of the revolute. In an embodiment where the liner is transparent or translucent, this embodiment would provide visibility into the contents of the container through visible portions of the liner wall, similar to a conventional rigid blow molded bottle, but would derive most of its structural integrity, for compressive loading, from the revolute pulp-formed shell. In an embodiment, the liner will have features that are formed during its manufacturing process. In an embodiment, a single part liner may have the following portions. An upper portion that would typically have an orifice for filling, closing and dispensing, material, where the orifice may have a small diameter as compared to the container diameter. The orifice area may be threaded, or may have ribs, flanges, bumps or other features, or may have no features to facilitate closing and/or opening, and/or reclosing, of the container. The upper portion may have threads to accept a screw cap, or a snap-fit feature to accept a snap-on lid. The orifice area may not necessarily be circular if a snap-on lid is used. A middle portion of the liner would expectedly be thin, light weight, and use a minimal amount of plastic since this area would be the receiver of the resolute cylinder as its support. The liner could be inset to 'accept' and 'locate' the section of revolute once installed. There could be a 'keying feature' in the liner that matches a feature on the revolute to insure that the revolute does not rotate relative to the liner. A lower portion of the liner may have a rounded low stress shape if the revolute acts as the contact with the ground/surface upon which the container may sit. Optionally, the bottom of the liner protrudes from the revolute and has contact with the ground with either a flattish base, or otherwise 'feet' features that are typical in blow molded bottles. If the liner were to be configured to be in contact with the ground/surface, then the bottom would be made stiff and robust relative to the middle thinner portion of the liner so as to provide adequate seating support. In an embodiment, the liner may be a blow molding variant, such as injection blow molding, extrusion blow molding, or stretch blow molding, for example. In an embodiment, the revolute ends may be cut in a plane normal to the axis of the revolute cylinder, or the cuts could be curved or otherwise shaped so as to add visual interest or clocking/keying functionality with respect to the liner. The revolute could be cut to have a tab for user grasp to commence a 'Peel to Remove' operation of the revolute for subsequent recycling.

Figure 32A:
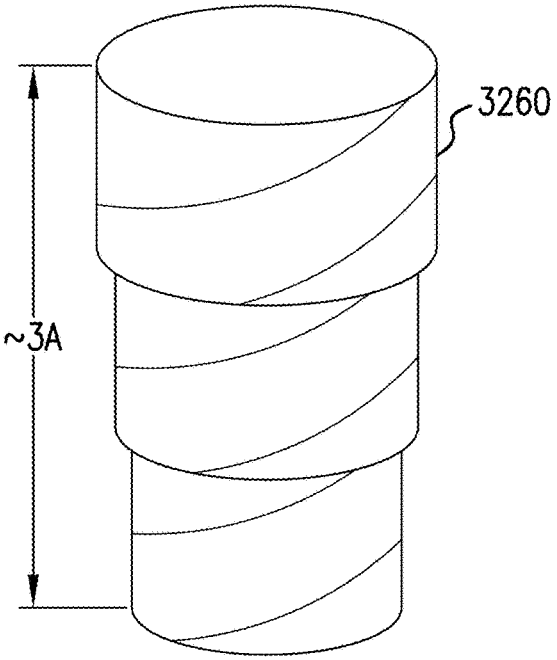
FIGS. 32A, 32B, and 32C, illustrate various views of a telescoping revolute shell for use with a collar and liner, in accordance with an embodiment.
Figure 32B:
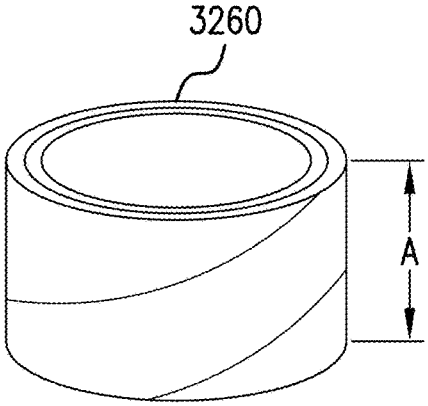
Figure 32C:
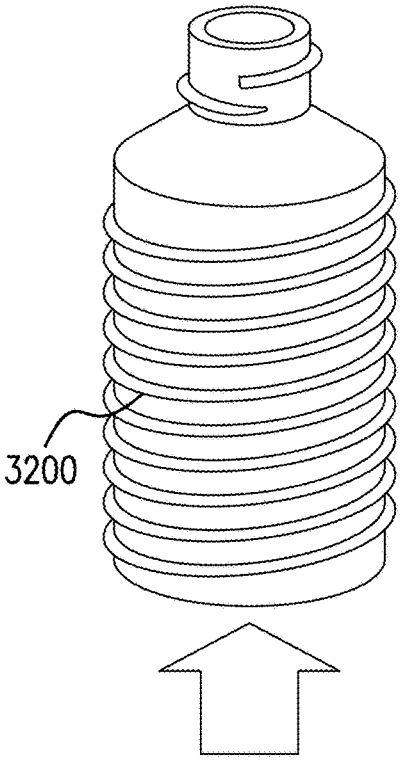
Figure 33C:
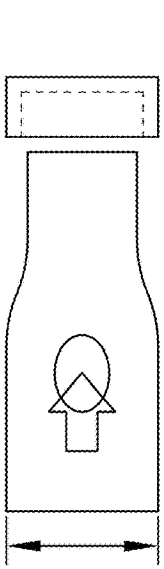
Figure 33B:
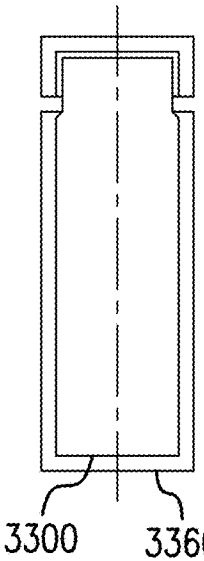
Figure 33D:
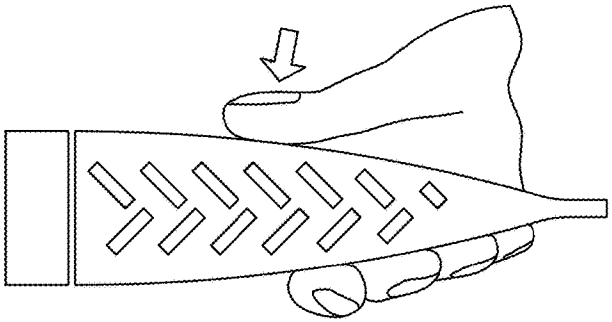
Figure 33A:
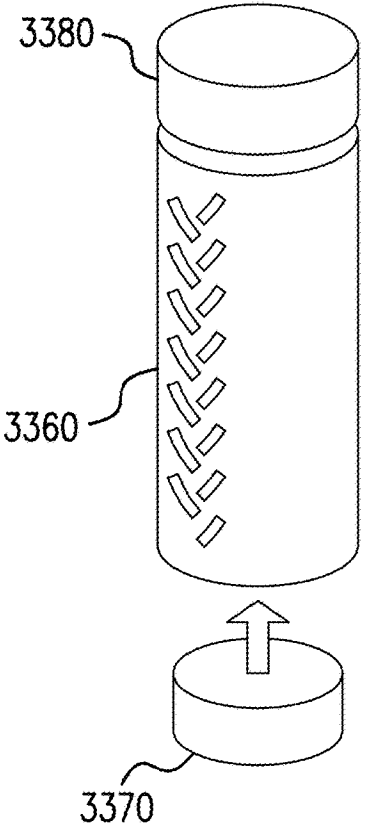

Reference is now made to FIGS. 32A-32C, which depict various views of a liner 3200 and a pulp-formed shell 3260, where here the pulp-formed shell 3260 is also formed from a revolute pulp-formed material. A distinction between the container construct of FIGS. 32A-32C and other container constructs disclosed herein having a revolute pulp-formed shell, is that the pulp-formed shell 3260 provides a sleeve that telescopingly slides over the liner 3200 to provide a container having a variable length. In an embodiment, the construct of the liner 3200 is such that it can collapse as the telescoping pulp-formed shell 3260 collapses. In an embodiment, the telescoping pulp-formed shell 3260 may collapse from a dimension of 3A to a dimension of A, as depicted in FIGS. 32A and 32B.

In an embodiment, the telescoping pulp-formed shell 3260 allows the engagement of two or more revolute parts to move relative to each other to facilitate a change in overall container volume. Cooperatively, the liner also changes in its volume. This could be beneficial from at least two perspectives. First, the collapsed container could be shipped assembled in its low volume state to the point of filling, thereby facilitating low volume shipping of empty containers. Second, the collapsible container offers a functionality that is hard to achieve with molded paper fiber or formed revolute sections, such as the ability to dispense contents that do not easy flow out, where the user by collapsing the container can encourage the contents to dispense. In an embodiment, the liner may include features, such as ribs or grooves, that facilitate vertical collapse of the liner, or may include features for engagement with the revolute to also facilitate vertical collapse of the liner. In an embodiment, the two or more parts of the revolute that are in movable engagement with each other may have sequentially larger diameters to slidingly engage with each other. In an embodiment, other features may be incorporated into the revolute to enhance performance and utility. For example, an embodiment includes an arrangement where small protrusions, channels, or other suitable guiding structure, is formed in the revolute that guide the motion and function, and acts as limiters to the motion, as the telescoping pulp-formed shell expands and contracts in length, thereby avoiding an unintentional separation of parts. While expansion/contraction motion of the telescoping pulp-formed shell may be achieved in a linear motion along a central axis of the revolute, another motion may be achieved via a twist-to-collapse/extend motion made by the user, which motion could correspond with associated curved track and protrusions in the revolute. Additionally, bumps, or ridges along the length of one revolute section that engage with features on another revolute section could be utilized to help select specific relative locations for the revolute parts, provide audible feedback, and/or provide mechanical engagement for positional locking.

Reference is now made to FIGS. 33A-33D, which depict various views of a liner 3300, a collar 3330, a pulp-formed shell 3360, an optional bottom 3370, and an optional closure 3380. Like other embodiments disclosed herein employing a revolute pulp-formed shell, this embodiment also employs a pulp-formed shell 3360. A point of distinction that this embodiment has over those other embodiments, is that the revolute pulp-formed shell 3360 is collapsible when squeezed, thereby facilitating dispensing of the material within the liner 3300 via a squeezing action imparted to the outer surface of the revolute pulp-formed shell 3360.

In an embodiment, the squeezable pulp-formed shell allows a user to facilitate dispensing of a container's volume while using a single main revolute component. This embodiment would be beneficial by offering functionality that is hard to achieve with molded paper fiber or formed revolute sections, such as the ability to dispense contents that do not easily flow out. The user's collapsing of the container can encourage the contents to dispense, such as when dispensing sun lotion, toothpaste, food stuffs, adhesives, and the like. Spring-like features may be added to the squeezable pulp-formed shell to enable the return or partial return of the pulp-formed shell to its pre-squeezed state.

As described herein, one or more protruding features in a collar and/or liner may be used to secure a shell relative to the collar and/or liner. The protruding features may partially or completely pierce or indent the molded pulp material of the shell. This may allow the protruding features to grip the shell. This may prevent axial and/or rotational movement of the shell relative to the collar and/or liner. In some instances, a plurality of protruding features may be provided. The protruding features may be provided circumferentially around the collar and may grip the shell at multiple positions. In some instances, relatively even spacing may be provided. In some instances, two, three, four, five, six, seven, eight, nine, ten, or more protruding features may be provided. The protruding features may collectively grip the shell with sufficient strength that may allow the collar to remain affixed to the shell during use of the container. This may include closing and opening of a closure that may go around a collar. For instance, a threaded cover may be twisted on and/or off the collar multiple times, while the collar maintains its grip on the shell. The protruding features may be able to withstand at least 5 lb/in, 10 lb/in, 15 lb/in, 20 lb/in, 25 lb/in, 30 lb/in, 40 lb/in, 50 lb/in, 60 lb/in, 80 lb/in for various diameter closures. For instance, the protruding features may be able to withstand any of the values provided for larger diameter closures to wide mouth container of 2 or 4 quart volume.

A protruding feature may be capable of adopting a plurality of positions. A position may orient the protruding feature to point toward the interior of the collar or away from the collar. A position may enable attachment to a pulp-molded shell. A position may enable insertion of the pulp-molded shell into the collar. A protrusion may interconvert between a first position that fastens the collar to the pulp-molded shell and a second position that enables the pulp-molded shell to detach from the collar.

The collar may be manually separated from the shell. For instance, the shell may be pulled out from the collar when a user is disposing of a container. When a user has completed using a container, the shell may be removed from the collar and/or liner. The shell may be formed from a compostable material, and may be composted. The collar and/or liner may be formed from a recyclable and/or reusable material. In some instances, the collar and/or liner may be more durable than the shell. The collar and/or liner may be reused or recycled. The shell and the collar may be treated differently when the user has completed using the container.

In some embodiments, the collar may be designed so that it remains on the shell and able to withstand sufficient force during regular use of the container. However, the collar and/or shell may be designed so that the shell can be manually separated from the collar when the user is ready to dispose of or reuse the various components. This may incentivize a user to dispose or reuse the various components appropriately. When materials are too difficult to manually separate, a user may become discouraged and not take appropriate steps. By contrast, when the materials are easy enough to manually separate, the user may be more encouraged to follow the proper steps for the various components after use. In some embodiments, the liner may include a drop in liner that contacts a collar in a permanent, semi-permanent or non connected, or where the pulp shell is sufficient to function as the liner when connected to the collar. In some instances, a liner with a lidding seal containing the usable product may be provided, that a user may engage upon replacement to an existing collar shell as a refill.

After use, a container may be deconstructed. In some instances, this involves the removal of a portion of the pulp-molded shell or the entire pulp-molded shell from a collar. Deconstruction may also involve removal of a liner from a container (e.g., separation of a liner from a collar). A collar may be attached to a new liner or pulp-molded shell, and in this way go through numerous cycles of use.

Facile collar recycling may be aided by collar designs enabling easy disengagement from pulp-molded shells. In some instances, the pulp-molded shell may be deformed (e.g., crumpled) to loosen its connection with a collar prior to disengagement. In further instances, a collar's connection to a pulp-molded shell may be weakened by deconstruction (e.g., detachment of constituent parts) of a multi-component pulp-molded shell. In many instances, a collar can be disengaged from a pulp-molded shell by hand, without the use of tools.

A collar design may calibrate the strength with which it connects to a pulp-molded shell. A collar may comprise features (such as barbs or ridges) that interact with a pulp-molded shell. The number, size, shape, and orientation of these features can be tailored to provide desired levels of grip strength and separability. In some instances, a collar feature may be formed with a first shape and orientation that is different than its final shape and orientation in the completed container. A collar feature may be reshaped or repositioned prior to its connection with a pulp-molded shell, or may be reshaped or repositioned upon contact with a pulp-molded shell. A collar feature may impart a high degree of resistance to rotation of the collar relative to the pulp-molded shell. In some instances, a collar may have greater resistance to rotating against a pulp-molded shell than disengaging (e.g., pulling apart) from a pulp-molded shell.

A collar may be tightened around a pulp-molded shell. In many instances, the shape of the collar forces the pulp-molded shell to distort (e.g., bend) upon insertion into the collar, which can provide resistance against detachment. For example, a collar may comprise outer and inner walls that may be tightened against a pulp-molded shell. In some instances, a collar is crimped to a pulp-molded shell. In some instances, the crimping is reversible. A collar may also be connected to a pulp-molded shell with an adhesive, such as a glue.

In some instances, the liner may be integral to the collar as a molded preform. In such instances, the collar and liner may be produced through different manufacturing processes. For example, fabrication may comprise stretch blow molding of the liner and injection molding of the collar. Fabrication of a collar, liner, or other plastic component may comprise injection molding, blow molding, compression molding, film insert molding, gas assist molding, rotational molding, structural foam molding, or thermoforming. Two components of a container may be fabricated as a single piece. A liner of film material may be provided to a collar or collar set, wherein the liner collar and shell combinations are provided in various combinations with the various embodiments provided herein.

The liner and collar may comprise different physical properties or materials. The collar and liner may have different tensile strengths, yield strengths, flexural strengths, compressive strengths, shear strengths, hardness, elasticities, and plasticities, The collar may comprise a greater thickness than the liner. The collar may have a greater mass than the liner. The collar may impart rigidity or structural integrity upon the liner.

The protrusions may advantageously allow a shell to be pulled out from the collar. The protrusions may bend back to allow the shell to slip out. In some instances, the shell may tear away from the collar with sufficient force. Alternatively, the collar may comprise a feature that may allow the collar to open up to release the shell. For example, a tab or similar feature may be provided that may allow the circumference of the collar to open up (e.g., like a clamshell) and/or separate. In some instances, the collar may be formed from a recyclable material. The collar may be recycled upon completion of use. In some instances, the collar may be reusable. A user may return the collar to a point of sale and receive a rebate, which may enable the collars to be collected and reused by manufacturers.

From all of the foregoing, it will be appreciated that various aspects of embodiments are disclosed herein where combinations of features disclosed may be combined with other features whether or not particularly illustrated, and where such aspects include the following.

Aspect 1. A container comprising: a pulp-formed shell configured to contain a material therein, the pulp-formed shell comprising an opening through which the material may pass, the pulp-formed shell being formed from a first material; a collar comprising one or more engagement features configured to engage at least a portion of the pulp-formed shell by pinching, indenting, deforming, or any combination of pinching, indenting and deforming, at least a portion of the pulp-formed shell, the collar being formed from a second material.

Aspect 2. The container of Aspect 1, wherein: the second material is different from the first material.

Aspect 3. The container of Aspect 1, wherein: the second material is the same as the first material.

Aspect 4. The container of any one of Aspects 1 to 3, wherein: the pulp-formed shell is made from a corrugated material.

Aspect 5. The container of any one of Aspects 1 to 3, wherein: the pulp-formed shell is made from a revolute material.

Aspect 6. The container of any one of Aspects 1 to 5, wherein: the collar is attachable and removable from the pulp-formed shell to facilitate ease of separation for recycling.

Aspect 7. The container of Aspect 6, wherein: the collar, subsequent to be attached to the pulp-formed shell, is configured to be detachable from the pulp-formed shell by a user, or by recycling equipment configured to crush the container.

Aspect 8. The container of any one of Aspects 1 to 7, wherein: the collar comprises an inverted u-shaped inner space configured to fit over a rim of the pulp-formed shell; the one or more engagement features being disposed within the inverted u-shaped inner space.

Aspect 9. The container of Aspect 8, wherein: the inverted u-shaped inner space is annular.

Aspect 10. The container of any one of Aspects 8 to 9, wherein: the one or more engagement features are formable in a first initial position, and movable to a second final position.

Aspect 11. The container of Aspect 10, wherein: the first initial position is an outer position relative to the inverted u-shaped inner space; the second final position is an inner position relative to the inverted u-shaped inner space.

Aspect 12. The container of any one of Aspects 1 to 11, wherein: the one or more engagement features comprise a plurality of barbs having an inwardly tapered end configured to engage with the pulp-formed shell.

Aspect 13. The container of any one of Aspects 1 to 12, wherein: the collar further comprises one or more intruding, protruding, or both intruding and protruding, portions configured to mate with or complement an engagement feature of the pulp-formed shell that deters rotation, removal, or both rotation and removal, of the collar from the pulp-formed shell.

Aspect 14. The container of any one of Aspects 1 to 13, further comprising: a closure disposed on or engage with the collar; wherein the collar further comprises an engagement feature configured to engage with the closure.

Aspect 15. The container of Aspect 14, wherein: the closure comprises an internal thread; and the engagement feature comprises an external thread configured to engage with the internal thread of the closure.

Aspect 16. The container of Aspect 14, wherein: the closure is integrally formed with the collar via a flexible connection, the flexible connection being configured to allow the closure to fold over to engage with and removably disengage with the collar.

Aspect 17. The container of any one of Aspects 14 to 16, wherein: the closure comprises a solid cover absent openings configured to completely enclose the container when the closure is engaged with the collar.

Aspect 18. The container of any one of Aspects 14 to 17, wherein: the collar further comprises a covering, the covering comprising one or more through-cuts configured to allow resistive removal or dispensing of a sheet or fiber form of the material contained within the pulp-formed shell.

Aspect 19. The container of any one of Aspects 14 to 17, wherein: the collar further comprises a covering, the covering comprising one or more openings configured to allow resistive removal or dispensing of fluid or granular forms of the material contained within the pulp-formed shell.

Aspect 20. The container of any one of Aspects 1 to 19, wherein: the collar comprises two nested collars, an outer collar and an inner collar, the inner collar being nested within an inner space of the outer collar, the inner collar comprising the one or more engagement features.

Aspect 21. The container of Aspect 20, wherein: the outer collar comprises engagement features configured to retain the inner collar within the inner space of the outer collar.

Aspect 22. The container of any one of Aspects 20 to 21, wherein: the outer collar and the inner collar both comprise an inverted u-shaped inner space, the inner collar being nested within the inverted u-shaped inner space of the outer collar.

Aspect 23. The container of any one of Aspects 1 to 22, further comprising: a liner attached to the collar, a substantial portion of the liner being disposed within the pulp-formed shell and configured to contain the material therein.

Aspect 24. The container of Aspect 23, wherein: the liner is a thin film liner made from a plastic material.

Aspect 25. The container of Aspect 24, wherein: the plastic material is flexible such that the liner can collapse upon itself.

Aspect 26. The container of Aspect 23, wherein: the liner is made from a metal material.

Aspect 27. The container of any one of Aspects 23 to 25, wherein: the liner is bonded to the collar.

Aspect 28. The container of Aspect 27, wherein: the collar comprises a lip, and the liner is bonded to the lip.

Aspect 29. The container of any one of Aspects 23 to 25, wherein: the liner is integrally formed with the collar to form a single article.

Aspect 30. The container of any one of Aspects 23 to 26, wherein: the liner is disposed within the inverted u-shaped inner space of the collar.

Aspect 31. The container of any one of Aspects 1 to 30, wherein: the pulp-formed shell comprises a plurality of pulp-formed portions that telescopingly engage with each other such that the intrinsic length of the container is adjustable.

Aspect 32. The container of any one of Aspects 1 to 31, wherein: the pulp-formed shell is deformable to allow dispensing of the material therein by compressing an exterior surface of the pulp-formed shell.

Aspect 33. The container of any one of Aspects 1 to 32, wherein: as viewed in a plan view of the container, an overall outside dimension of the pulp-formed shell is larger than an overall outside dimension of the collar.

Aspect 34. The container of any one of Aspects 1 to 32, wherein: as viewed in a plan view of the container, an overall outside dimension of the pulp-formed shell is the same as an overall outside dimension of the collar.

Aspect 35. The container of any one of Aspects 1 to 34, wherein: as viewed in at least one cross-section plan view of the container, an overall outside surface of the pulp-formed shell has a cross-section in the form of; a circle, an oval, a rectangle, or a square.

Aspect 36. The container of any one of Aspects 1 to 35, wherein: as viewed in cross-section plan views of the container, an outside surface of the pulp-formed shell transitions, from top to bottom, from a rectangular cross-section to an oval cross-section.

Aspect 37. The container of any one of Aspects 1 to 35, wherein: as viewed in cross-section plan views of the container, an outside surface of the pulp-formed shell transitions, from top to bottom, from an oval cross-section to a rectangular cross-section.

Aspect 38. The container of any one of Aspects 1 to 35, wherein: as viewed in cross-section plan views of the container, an outside cross-sectional perimeter of the pulp-formed shell transitions, from top to bottom, from a plurality of linear perimeter cross-sections to a continuous curved perimeter cross-section.

Aspect 39. The container of any one of Aspects 1 to 35, wherein: as viewed in cross-section plan views of the container, an outside cross-sectional perimeter of the pulp-formed shell transitions, from top to bottom, from a continuous curved perimeter cross-section to a plurality of linear perimeter cross-sections.

Aspect 40. The container of any one of Aspects 1 to 39, wherein: the pulp-formed shell is a pulp-molded shell.

It should be understood from the foregoing that, while particular implementations have been illustrated and described, various modifications can be made thereto and are contemplated herein. It is also not intended that the invention be limited by the specific examples provided within the specification. While the invention has been described with reference to the aforementioned specification, the descriptions and illustrations of the preferable embodiments herein are not meant to be construed in a limiting sense. Furthermore, it shall be understood that all aspects of the invention are not limited to the specific depiction, configurations or relative proportions set forth herein which depend upon a variety of conditions and variables. Various modifications in form and detail of the embodiments of the invention will be apparent to a person skilled in the art. It is therefore contemplated that the invention shall also cover any such modifications, variations, and equivalents.

The invention claimed is:

1. A container comprising:

a pulp-formed shell configured to contain a material therein, the pulp-formed shell comprising an opening through which the material may pass, the pulp-formed shell being formed from a first material; and a collar connectable to the pulp-formed shell, the collar comprising a plurality of engagement features configured to engage at least an outer surface of the pulp-formed shell by pinching, indenting, deforming, or any combination of pinching, indenting and deforming, at least a portion of the pulp-formed shell, the collar having an inner-space within which an end of the pulp-formed shell is receivable, the plurality of engagement features being discontinuously spaced about a periphery of collar, wherein the collar is formed from a second material; and a plurality of intrusions formed at an exterior of the collar, wherein each of the plurality of intrusions is associated with a respective engagement feature of the plurality of engagement features arranged within the inner-space.

2. The container of claim 1, wherein:

the second material is different from the first material.

3. The container of claim 1, wherein:

the second material is the same as the first material.

4. The container of claim 1, wherein:

the pulp-formed shell is made from a corrugated material.

5. The container of claim 1, wherein:

the pulp-formed shell is made from a revolute material.

6. The container of claim 1, wherein:

the collar is attachable and removable from the pulp-formed shell to facilitate ease of separation for recycling.

7. The container of claim 6, wherein:

the collar, subsequent to be attached to the pulp-formed shell, is configured to be detachable from the pulp-formed shell by a user, or by recycling equipment configured to crush the container.

8. The container of claim 1, wherein:

the plurality of engagement features comprise a plurality of barbs that are discontinuously spaced about a periphery of collar, the plurality of barbs each having an inwardly tapered end configured to engage with the pulp-formed shell.

9. The container of claim 1, wherein:

the plurality of intrusions are configured to mate with or complement an engagement feature of the pulp-formed shell that deters rotation, removal, or both rotation and removal, of the collar from the pulp-formed shell.

10. The container of claim 1, further comprising:

a closure disposed on or engage with the collar;

wherein the collar further comprises an engagement feature configured to engage with the closure.

11. The container of claim 1, wherein:

the collar comprises two nested collars, an outer collar and an inner collar, the inner collar being nested within an inner space of the outer collar, the inner collar comprising the plurality of engagement features.

12. The container of claim 1, further comprising:

a liner attached to the collar, a substantial portion of the liner being disposed within the pulp-formed shell and configured to contain the material therein.

13. The container of claim 1, wherein:

the pulp-formed shell comprises a plurality of pulp-formed portions that telescopingly engage with each other such that the intrinsic length of the container is adjustable.

14. The container of claim 1, wherein:

the pulp-formed shell is deformable to allow dispensing of the material therein by compressing an exterior surface of the pulp-formed shell.

15. The container of claim 1, wherein:

as viewed in a plan view of the container, an overall outside dimension of the pulp-formed shell is larger than an overall outside dimension of the collar.

16. The container of claim 1, wherein:

as viewed in a plan view of the container, an overall outside dimension of the pulp-formed shell is the same as an overall outside dimension of the collar.

17. The container of claim 1, wherein:

as viewed in at least one cross-section plan view of the container, an overall outside surface of the pulp-formed shell has a cross-section in the form of; a circle, an oval, a rectangle, or a square.

18. The container of claim 1, wherein:

as viewed in cross-section plan views of the container, an outside surface of the pulp-formed shell transitions, from top to bottom, from a rectangular cross-section to an oval cross-section.

19. The container of claim 1, wherein:

as viewed in cross-section plan views of the container, an outside surface of the pulp-formed shell transitions, from top to bottom, from an oval cross-section to a rectangular cross-section.

20. The container of claim 1, wherein:

as viewed in cross-section plan views of the container, an outside cross-sectional perimeter of the pulp-formed shell transitions, from top to bottom, from a plurality of linear perimeter cross-sections to a continuous curved perimeter cross-section.

21. The container of claim 1, wherein:

as viewed in cross-section plan views of the container, an outside cross-sectional perimeter of the pulp-formed shell transitions, from top to bottom, from a continuous curved perimeter cross-section to a plurality of linear perimeter cross-sections.

* * * * *